US012560375B2

(12) United States Patent
Kim

(10) Patent No.: US 12,560,375 B2
(45) Date of Patent: Feb. 24, 2026

(54) REFRIGERATOR

(71) Applicant: LG Electronics Inc., Seoul (KR)

(72) Inventor: Junghun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 166 days.

(21) Appl. No.: 18/285,554

(22) PCT Filed: Apr. 22, 2022

(86) PCT No.: PCT/KR2022/005817
§ 371 (c)(1),
(2) Date: Oct. 4, 2023

(87) PCT Pub. No.: WO2022/225377
PCT Pub. Date: Oct. 27, 2022

(65) Prior Publication Data

US 2024/0183606 A1 Jun. 6, 2024

(30) Foreign Application Priority Data

Apr. 23, 2021 (KR) ..... 10-2021-0053269

(51) Int. Cl.
*F25D 23/02* (2006.01)
*F25D 27/00* (2006.01)

(52) U.S. Cl.
CPC ..... *F25D 23/028* (2013.01); *F25D 27/00* (2013.01); *F25D 2323/02* (2013.01)

(58) Field of Classification Search
CPC ..... F25D 27/00; F25D 27/005; F25D 23/028; F25D 2400/36; F25D 2400/361; F25D 2400/40; F25D 2323/02; F25D 2327/00
See application file for complete search history.

(56) References Cited

U.S. PATENT DOCUMENTS 9,879,900 B1 * 1/2018 Ammerman ..... F25D 23/04
2018/0160824 A1 6/2018 Lee
2018/0274852 A1 * 9/2018 Kang ..... F25D 23/025
(Continued)

FOREIGN PATENT DOCUMENTS

CN 102937358 A 2/2013
CN 103250018 3/2016
(Continued)

OTHER PUBLICATIONS

Translation KR20190135396A (Year: 2019).*
(Continued)

*Primary Examiner* — Andrew Roersma
(74) *Attorney, Agent, or Firm* — Fish & Richardson P.C.

(57) ABSTRACT

A refrigerator includes a cabinet forming a storage space and a door for opening and closing the storage space, the door including a door body with an insulator filled therein, and a door panel mounted in front of the door body. The door panel includes a lighting device configured to emit light, a front plate forming a front surface of the door panel and configured to transmit light therethrough, a back cover forming a rear surface of the door panel, and a bracket disposed between the front plate and the back cover and including the lighting device mounted on the bracket. The door body includes a body plate forming a front surface of the door body, and the back cover faces the body plate when the door panel is mounted.

14 Claims, 45 Drawing Sheets

(56) References Cited

U.S. PATENT DOCUMENTS

| | | | | |
|---|---|---|---|---|
| 2019/0257571 | A1* | 8/2019 | Park | F25D 23/028 |
| 2019/0271500 | A1* | 9/2019 | Lee | G02B 6/0083 |
| 2021/0055038 | A1* | 2/2021 | Lee | F25D 23/126 |
| 2021/0318061 | A1* | 10/2021 | Lee | F25D 23/028 |
| 2023/0258388 | A1* | 8/2023 | Yu | G02F 1/153 312/405 |

FOREIGN PATENT DOCUMENTS

| | | | | |
|---|---|---|---|---|
| CN | 108224889 | A | 6/2018 | |
| CN | 210425735 | U | 4/2020 | |
| CN | 112230472 | A | 1/2021 | |
| CN | 212320193 | | 1/2021 | |
| JP | 2015-206478 | A | 11/2015 | |
| JP | 2017-003248 | | 1/2017 | |
| JP | 2018-197628 | A | 12/2018 | |
| KR | 10-0904322 | | 6/2009 | |
| KR | 10-2019-0135396 | | 12/2019 | |
| KR | 10-2021-0022515 | | 3/2021 | |
| TW | 201725352 | A | 7/2017 | |
| WO | WO-2021006463 | A1 * | 1/2021 | F25D 27/00 |
| WO | WO-2021212934 | A1 * | 10/2021 | H05B 45/28 |

OTHER PUBLICATIONS

Extended European Search Report in European Appln. No. 22792075.8, mailed on Mar. 3, 2025, 10 pages.

Office Action in Chinese Appln. No. 202280017960.1, mailed on Sep. 30, 2025, 13 pages (with English translation).

* cited by examiner

REFRIGERATOR

CROSS-REFERENCE TO RELATED APPLICATIONS

This application is a National Stage application under 35 U.S.C. § 371 of International Application No. PCT/KR2022/005817, filed on Apr. 22, 2022, which claims the benefit of Korean Patent Application No. 10-2021-0053269, filed on Apr. 23, 2021. The disclosures of the prior applications are incorporated by reference in their entirety.

TECHNICAL FIELD

The present disclosure relates to a refrigerator.

BACKGROUND ART

In general, a refrigerator is a home appliance for storing food at low temperature in an internal storage space that is shielded by a refrigerator door, and is configured to store the stored food in an optimal state by cooling the inside of the storage space using cold air generated through heat exchange with a refrigerant circulating through the refrigeration cycle.

Such a refrigerator is gradually being enlarged and multi-functional according to a trend of changes in dietary life and high-quality products, and a refrigerator equipped with various structures and convenience devices in consideration of user convenience is being developed.

In order to harmonize with an environment in which the refrigerator is disposed or with surrounding furniture or home appliances, structures for varying an outer appearance of a door front of the refrigerator are developed.

U.S. Pat. No. 8,789,900 discloses a structure in which a deco panel forming an outer appearance is installed on a door front of a refrigerator, and here, the outer appearance of the door front is formed according to a user's preference by detachably configuring the deco panel.

However, the refrigerator having this structure has a problem in that, when a user wants to change the outer appearance, the entire deco panel needs to be removed and replaced, and it is not possible to use the deco panel before replacement any longer.

Chinese Patent No. 103250018 discloses a refrigerator in which a reflective layer and a transparent panel are disposed on a door front and colored light emitting members are mounted on both ends of the reflective layer to cause the transparent panel to glow with set color.

However, the refrigerator having this structure has a problem in that it is not possible to ensure stable installation of the light emitting member due to the characteristics of the door that is repeatedly opened and closed.

The reflective layer is formed of a metal material and has a problem in that an electrical defect occurs when being in contact with the light emitting member in a bent form.

Since the light emitting members are disposed on right and left side ends, there is a problem in that the transparent panel does not glow with uniform brightness as a whole, and in particular, there is a problem in that light is not transmitted to bent side ends for arrangement of the light emitting members, which causes a dark appearance.

In addition, the light emitting members are exposed depending on the location of a user, and thus there is a problem in terms of a poor outer appearance.

DISCLOSURE

Technical Problem

An object of an embodiment of the present disclosure is to provide a refrigerator that is changed in various outer appearances according to user preference without replacing a door panel.

An object of an embodiment of the present disclosure is to provide a refrigerator for easily changing color of a front surface of a door.

An object of an embodiment of the present disclosure is to provide a refrigerator for making a front surface glow with uniform brightness and for preventing a lighting device from being exposed to a user.

An object of an embodiment of the present disclosure is to provide a refrigerator for preventing a door panel from being deformed and damaged even if a door is repeatedly opened and closed and is used for a long time.

An object of an embodiment of the present disclosure is to provide a refrigerator for minimizing the thickness of a door panel including a lighting device to make a front surface glow brightly.

An object of an embodiment of the present disclosure is to provide a refrigerator in which a door panel configured to emit light to form a front appearance of a door is detachably mounted on a door body.

Technical Solution

An embodiment of the present disclosure provides a refrigerator including a cabinet forming a storage space and a door for opening and closing the storage space, the door including a door body with an insulator filled therein, and a door panel mounted in front of the door body, wherein the door panel includes a lighting device configured to emit light, a front plate forming a front surface of the door panel and configured to transmit light therethrough, a back cover forming a rear surface of the door panel, and a bracket disposed between the front plate and the back cover and including the lighting device mounted on the bracket, wherein the door body includes a body plate forming a front surface of the door body, and the back cover faces the body plate when the door panel is mounted.

The refrigerator may further include a light guide plate disposed behind the front plate and configured to guide light emitted from the lighting device to the front plate.

The back cover may include a cover protrusion protruding toward the light guide plate and configured to support the light guide plate.

The back cover may further include a cover perimeter part formed at a perimeter of the cover protrusion and spaced apart from the light guide plate.

The bracket may be disposed on the cover perimeter part, and the lighting device may emit light toward an end of the light guide plate.

The bracket may include an upper bracket forming an upper surface of the door panel, and a lower bracket forming a lower surface of the door panel, wherein the lighting device is mounted on at least one of the upper bracket or the lower bracket.

The back cover may connect the upper bracket to the lower bracket.

A wire hole configured to allow a wire connected to the lighting device to enter and exit may be formed on the back cover.

A body hole through which a wire inside the door body enters and exits toward the door panel may be formed on the body plate, and the wires may be connected to each other when the door panel is mounted on the door body.

The back cover may be formed of a plate-shaped metal material.

The back cover may be in contact with the body plate.

The back cover may be disposed between the front plate and the body plate.

The door panel may be detachably mounted on the door body.

Advantageous Effect

The following effects may be expected in a refrigerator according to the proposed embodiment.

A door panel forming a front surface of the refrigerator may include a front plate through which light is capable of passing, a lighting device that emits light, and a light guide plate that reflects light emitted from the lighting device in a forward direction, and an entire front surface of the door may glow according to user need.

In particular, a plurality of light sources included in the lighting device may emit light with different colors, and thus the front surface of the door may flow with color set by the user. That is, color of the door front may be advantageously changed according to user selection even without replacing the panel that forms the front surface of the door.

That is, there may be an advantage in that the outer appearance of the refrigerator is easily changed and user preferences is satisfied by changing color of the door front at a desired time without separation and mounting of the panel.

Only some of a plurality of doors may glow brightly or may glow with different colors, and the plurality of doors may have directivity, may be sequentially turned on or off, or may be changed in color, and accordingly, there may be an advantage in that various shapes of an outer appearance or changes in the outer appearance are combined using the plurality of doors.

The front plate may substantially form a front surface of the door, and light may be emitted to the entire front plate by the light guide plate behind the front plate. Thus, there may be an advantage in that the entire front surface of the door is glow and the entire door front has uniform brightness and color.

In particular, like in the case in which a storage space is divided into right and left sides, when the upper and lower length of the door is long or the door has a large size, the front plate may advantageously have uniform brightness and color by the light guide plate.

The lighting device may be positioned at an outer end of the door panel, and a light source may emit light toward an end of the light guide plate, and thus there may be an advantage in that the light device is prevented from being exposed to a user, and light of the light source is prevented from being directed directly to the eyes to prevent glare of the user.

In particular, the lighting device may emit light downward from an upper end of the door panel, and accordingly, there may be an advantage in that, when the user stands in front of the refrigerator, light is prevented from being exposed directly to the user or glare of the user is prevented even if the lighting device is positioned higher than the user's line of sight.

Inside the door panel, a right bracket for supporting the front plate and the light guide plate and a support bracket may be arranged to face each other, and the right bracket and the support bracket may maintain the front plate and the light guide plate at a set interval, and in particular, the light guide plate may be maintained at an exact position. Accordingly, even in a process of repeatedly opening and closing the door, the door panel may not be damaged, and the position of the light guide plate may be maintained, and accordingly, there may be an advantage in that light emitted from the lighting device is ensured to be effectively directed to the front panel.

An out frame formed of metal may be provided on a perimeter of the door panel and may be bent multiple times to restrain a front surface of the front plate and a rear surface of the back cover. Thus, internal components of the door panel may be maintained in a firm fixed state, and even if the door is repeatedly opened and closed, the internal components of the door panel may be prevented from being moved to prevent the door panel from being damaged.

The out frame may be formed of a plate-shaped metal material and may be bent after the door panel is assembled, and thus a rear part of the out frame may be in contact with a rear surface of the back cover formed of a metal material. In the state in which the out frame and the back cover are in contact with each other, the back cover and the out frame may be firmly fixed via spot welding.

Accordingly, the door panel may be firmly assembled without coupling with a separate screw, bolt, or rivet, and accordingly, there may be an advantage in that the thickness of the door panel is minimized because additional components for coupling and a structure for arranging the additional components are not required. The thickness of the door panel may be minimized, and thus there may be an advantage in that an increase in the thickness of the door is prevented and insulation capability is maintained by ensuring a sufficient space for filling the insulator.

The back cover may be disposed behind the light guide plate, and a central portion of the back cover may protrude forward to form a cover protrusion. The cover protrusion may be in contact with the light guide plate and may surface-contact a predetermined region including the center of the light guide plate to stably support the light guide plate from the rear. Accordingly, even if impact is applied due to opening and closing of the door, the light guide plate may be stably supported to prevent the light guide plate from being deviated from a mounting position or from being damaged.

In particular, the cover protrusion may be simply formed by foaming when the back cover is molded and may be formed on an entire surface of the back cover except for a perimeter thereof, and thus there may be an advantage in that light guide plate is stably supported.

When the lighting device is disposed at a lower end of a door panel, a supporting member may maintain a constant distance between a light source of the lighting device and an end of the light guide plate. In particular, the state in which the light guide plate is supported by the supporting member by its own weight, and thus even if the door is repeatedly opened and closed, the position of the light guide plate may be maintained by the supporting member, and thus light emitted from the light source may be effectively and stably transferred to the front plate.

The lighting device may be provided on both upper and lower ends of the door panel, and in this case, a front surface of the door, that is, the door panel may glow brighter and more clearly.

BEST MODE

Hereinafter, detailed embodiments will be described in detail with reference to the accompanying drawings. However, the present disclosure is limited to the embodiments in which the spirit of the present disclosure is proposed, and other degenerate idea or other embodiments included in the scope of the present disclosure may be easily proposed by addition, changes, deletions, etc. of other elements.

Prior to a description, directions are defined. In an embodiment of the present disclosure, a direction toward a door is defined as a front direction with respect to a cabinet shown in FIGS. 1 and 2, a direction toward the cabinet with respect to the door is defined as a rear direction, a direction toward a bottom on which a refrigerator is installed is defined as a downward direction, and a direction away from the bottom is defined as an upward direction.

Figure 1:
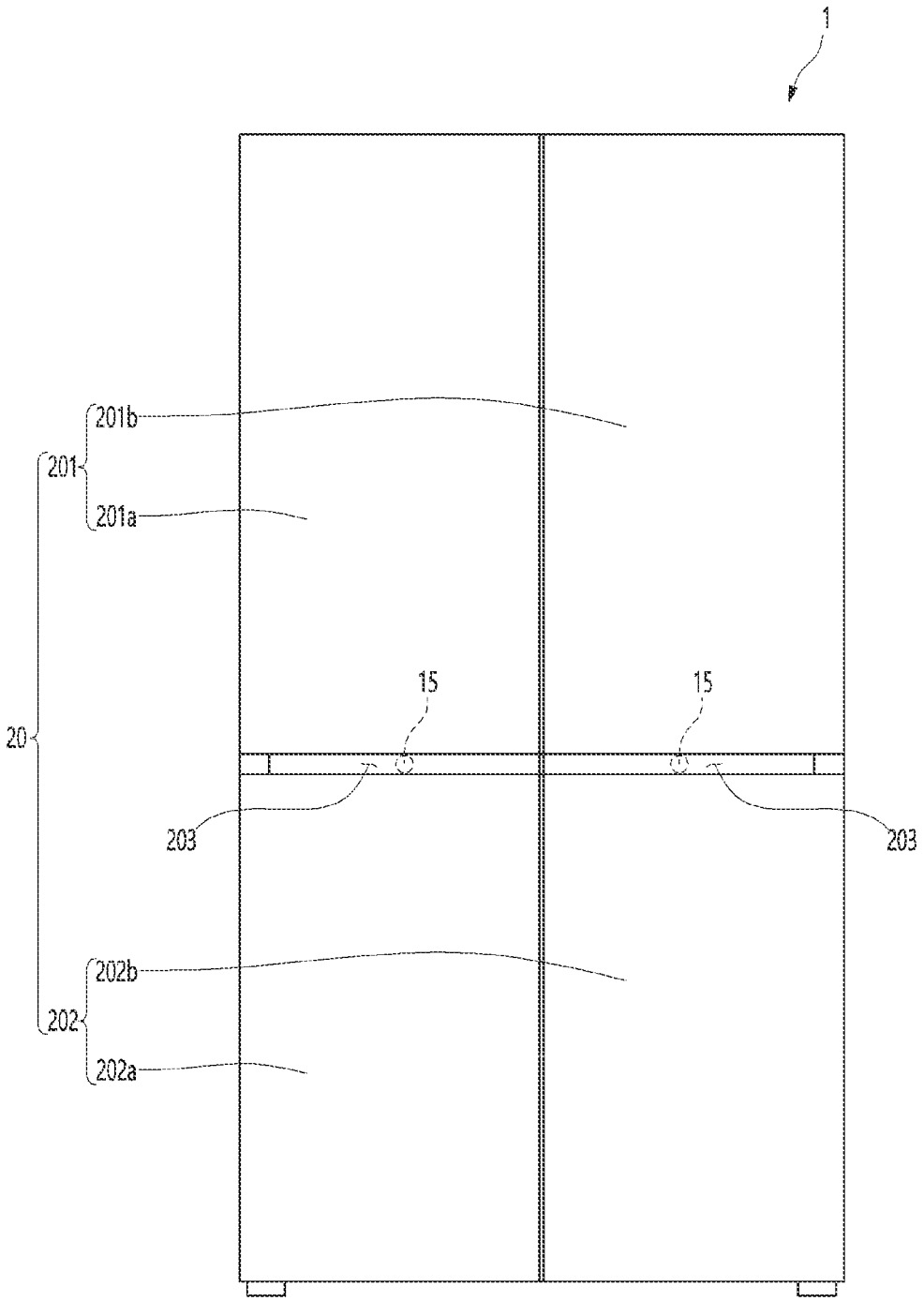
FIG. 1 is a front view of a refrigerator according to a first embodiment of the present disclosure.
Figure 2:
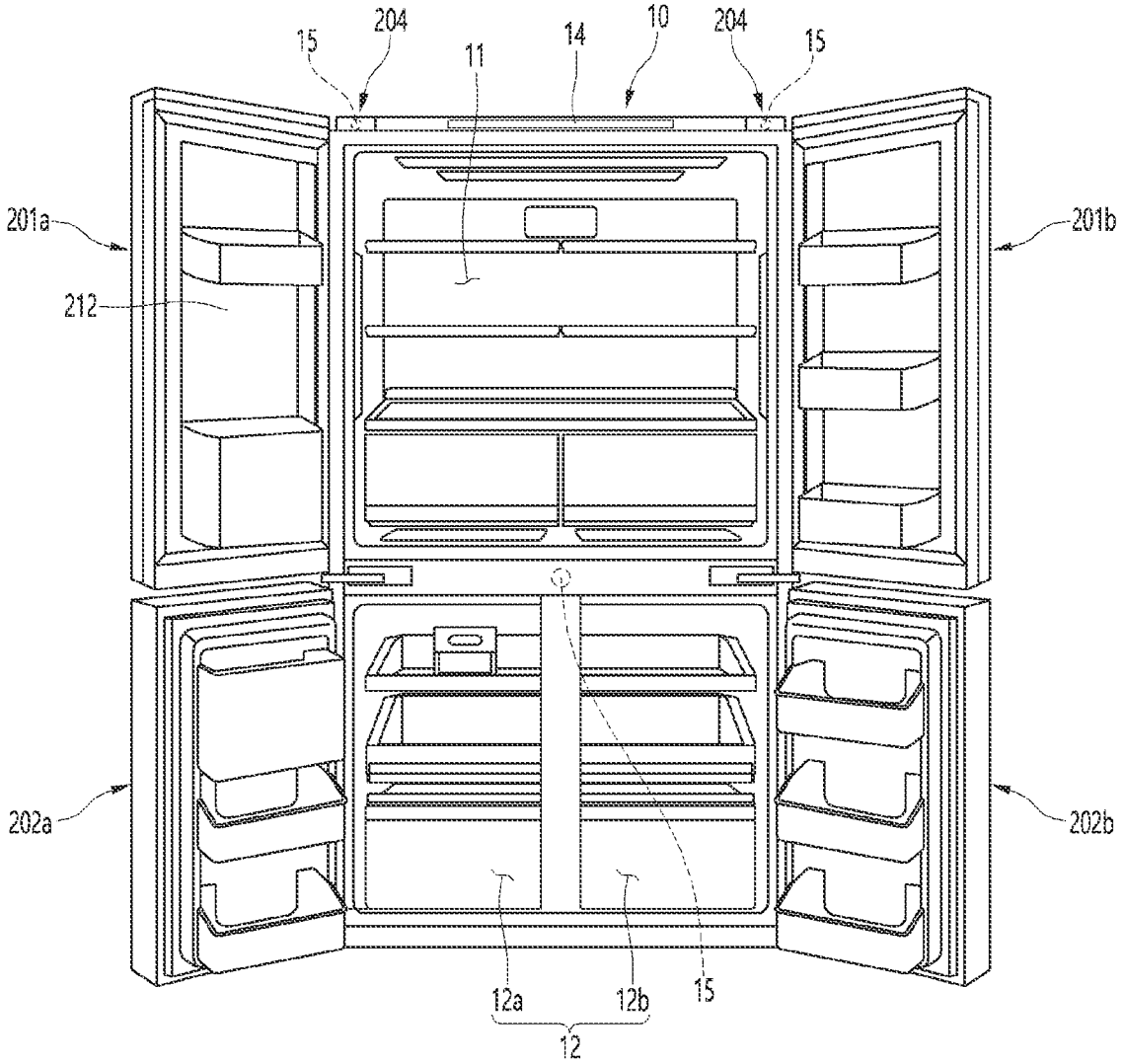
FIG. 2 is a front view of the refrigerator with an open door.

FIG. 1 is a front view of a refrigerator according to a first embodiment of the present disclosure. FIG. 2 is a front view of the refrigerator with an open door.

As shown in the drawings, an outer appearance of a refrigerator 1 according to the first embodiment of the present disclosure may be formed by a cabinet 10 forming a storage space, and a door 20 for opening and closing the storage space of the cabinet 10.

For example, the cabinet 10 may form the storage space partitioned up and down, a refrigerating compartment 11 may be formed at an upper part, and a freezing compartment 12 may be formed at a lower part. The refrigerating compartment 11 may be referred to as an upper storage space, and the freezing compartment may be referred to as a lower storage space. The lower storage space may be divided into a left lower storage space 12*a* and a right lower storage space 12*b*, and the left lower storage space 12*a* and the right lower storage space 12*b* may also be maintained at different temperatures.

The door 20 may be configured to open and close each of the refrigerating compartment 11 and the freezing compartment 12. For example, the door 20 may be rotatably mounted on the cabinet 10, and the refrigerating compartment 11 and the freezing compartment 12 may each be opened and closed by rotation. Needless to say, the door 20 may also be withdrawn to open and close each of the refrigerating compartment 11 and the freezing compartment 12.

The door 20 may include a refrigerating compartment door 201 for opening and closing the refrigerating compartment 11, and a freezing compartment door 202 for opening and closing the freezing compartment 12. The refrigerating compartment door 201 may be referred to as an upper door, and the freezing compartment door 202 may be referred to as a lower door.

The refrigerating compartment door 201 may include a pair of a left refrigerating compartment door 201*a* and a right refrigerating compartment door 201*b* that are arranged side by side, and outer ends of the left refrigerating compartment door 201*a* and the right refrigerating compartment door 201*b* may be rotatably mounted on the cabinet 10. Thus, the left refrigerating compartment door 201*a* and the right refrigerating compartment door 201*b* may open and close the refrigerating compartment 11 while being independently rotated.

The freezing compartment door 202 may include a pair of a left freezing compartment door 202*a* and a right freezing compartment door 202*b* that are arranged side by side, and outer ends of the left freezing compartment door 202*a* and the right freezing compartment door 202*b* may be rotatably mounted on the cabinet 10. Thus, the left freezing compartment door 202*a* and the right freezing compartment door 202*b* may open and close the freezing compartment 12 while being independently rotated.

The refrigerating compartment door 201 and the freezing compartment door 202 may be spaced apart from each other in a vertical direction, and a handle 203 for opening and closing the freezing compartment door 202 may be recessed in a space between the refrigerating compartment door 201 and the freezing compartment door 202. A handle (not shown) for opening and closing the refrigerating compartment door 201 may also be recessed at a lower end of the refrigerating compartment door 201.

A front appearance of the refrigerator 1 may be formed in the state in which the door 20 is closed and may form most of the out appearance of the refrigerator 1 viewed from the front in the state in which the refrigerator 1 is installed.

The door 20 may have a structure in which a front surface selectively emits light. Thus, a user may change front color of the door 20 without separating or disassembling the door 20 and may change the overall outer appearance of the refrigerator 1.

Hereinafter, the structure of the door 20 will be described in detail with reference to drawings.

Figure 3:
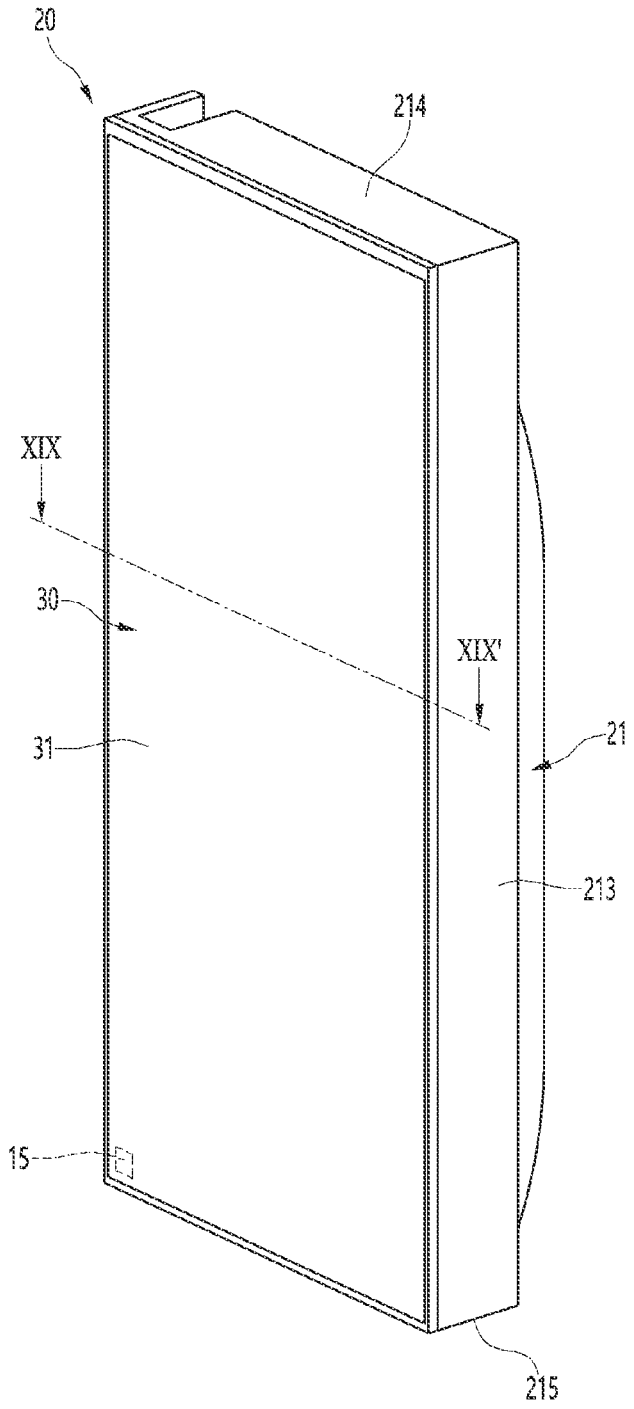
FIG. 3 is a perspective view of the door.
Figure 4:
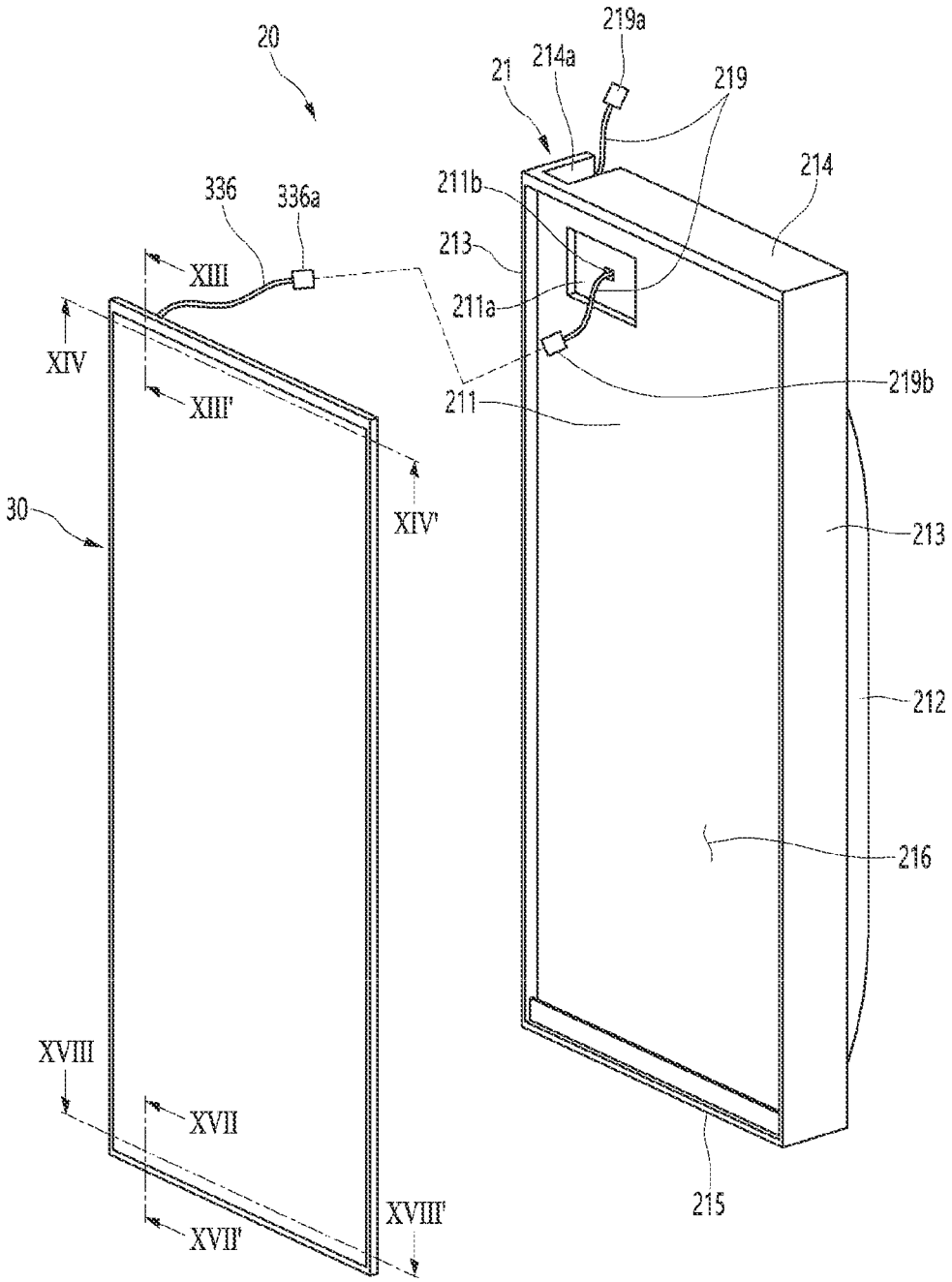
FIG. 4 is an exploded perspective view of a door panel and a door body included in the door.

FIG. 3 is a perspective view of the door. FIG. 4 is an exploded perspective view of a door panel and a door body included in the door.

As shown in the drawings, the door 20 may include a door body 21 forming the overall shape of the door 20, and a door panel 30 forming a front appearance of the door 20. That is, the door 20 may be configured in such a way that the door panel 30 is mounted on a front surface of the door body 21.

The door body 21 may include a body plate 211 forming a front surface and a door liner 212 forming a rear surface. The body plate 211 may be formed of a metal material and may be formed in a plate shape having a size corresponding to the door panel 30. The door liner 212 may be formed of a plastic material, and may be molded to mount a basket or the like on a back of the door 20. A gasket may be mounted around the door liner 212 to contact the cabinet 10 when the door 20 is closed, thereby preventing cold air inside the storage space from leaking.

The door body 21 may include a side deco 213 forming right and left side surfaces of the door body 21. The side deco 213 may connect right and left side ends of the body plate 211 and right and left side ends of the door liner 212.

The door body 21 may include an upper cap deco 214 and a lower cap deco 215 that form upper and lower surfaces of the door body 21. The upper cap deco 214 may be connected to an upper end of the side deco 213, an upper end of the body plate 211, and an upper end of the door liner 212. The lower cap deco 215 may be connected to a lower end of the side deco 213, a lower end of the body plate 211, and a lower end of the door liner 212.

An outer appearance of the door body 21 may be formed by the body plate 211, the door liner 212, the side deco 213, the upper cap deco 214, and the lower cap deco 215. An insulator (refer to 217 of FIG. 19) may be filled in an internal space of the door body 21, which is formed by coupling the body plate 211, the door liner 212, the side deco 213, the upper cap deco 214, and the lower cap deco 215, and may provide an insulation structure to prevent heat from being transferred through the door 20. The insulator 217 may be formed by injecting a foaming liquid into the door body 21.

A panel receiving space 216 opened forward may be formed on a front surface of the door body 21. That is, a front end of the side deco 213 and front ends of the upper cap deco 214 and the lower cap deco 215 may protrude more forward than a front surface of the body plate 211, and thus the panel receiving space 216 with an open front side may be formed in front of the body plate 211. The panel receiving space 216 may be formed with a size corresponding to the size of the door panel 30 and the door panel 30 may be inserted into the panel receiving space 216. A perimeter of the door panel 30 may be supported by a peripheral surface of the panel receiving space 216, that is, protruding portions of the side deco 213, the upper cap deco 214, and the lower cap deco 215.

As shown in FIG. 4, the door panel 30 may be detachably mounted on the door body 21. That is, the door panel 30 may be mounted on the door body 21 in the assembly state. The door panel 30 may also be separated from the door body 21 in the assembly state.

The door panel 30 may be formed in a plate shape and may be formed with a size corresponding to a front surface of the door body 21. Thus, when the door panel 30 is mounted on the front surface of the door body 21, the door panel 30 may be formed to have a sense of unity with the door body 21.

A rear surface of the door panel 30 may be in close contact with the body plate 211 in the state in which the door panel 30 is mounted on the door body 21. The door panel 30 may be firmly coupled to the body plate 211 by an adhesive or an adhesive sheet.

A front surface of the door panel 30 may be exposed forward in the state in which the door panel 30 is mounted on the door body 21 and may substantially form the front appearance of the door 20. The door panel 30 may be configured to emit light from an entire front thereof and may be configured to glow with various colors.

To this end, a lighting device 35 may be provided inside the door panel 30. A wire 336 may be connected to the lighting device 35 in order to supply and control power. The wire 336 may be exposed to the outside from the rear surface of the door panel 30, and a panel connector 336*a* may be disposed at an end of the wire 336.

A connector receiver 211*a* may be formed on a front surface of the door body 21, that is, a front surface of the body plate 211. The connector receiver 211*a* may be recessed on the body plate 211, and a wire 219 and a body connector 219*b* disposed at one end of the wire 219 may be formed in the connector receiver 211*a*. The wire 219 may be introduced into the door body 21 through a hinge mount 214*a* recessed in an upper surface of the door 20 and may be exposed forward through a body hole 211*b* of the connector receiver 211*a*.

When the door panel 30 is assembled, the wires 336 and 219 may be connected to each other by coupling the panel connector 336*a* and the body connector 219*b*. The panel connector 336*a*, the body connector 219*b*, and a part of the wires 336 and 219 may be accommodated in the connector receiver 211*a*.

Thus, when the door panel 30 is mounted, a rear surface of the door panel 30 may be in contact with or adjacent to a front surface of the body plate 211, and an interval between the door panel 30 and the body plate 211 may be minimized to prevent an increase in the thickness of the door 20.

The connector receiver 211*a* may be formed to face a wire hole 335 of the rear surface of the door panel 30 and may be formed adjacent to the hinge mount 214*a*. Needless to say, depending on a part of the door panel 30, in which the lighting device 35 is disposed, the wire hole 335 may be formed at a lower and other position than the upper portion, and the connector receiver 211*a* may also be formed at a corresponding position.

The wire 219 exposed out of the door 20 through the hinge mount 214*a* may be connected to a wire at the cabinet 10 by a connection connector 219*a* when the door 20 is mounted on the cabinet 10.

Hereinafter, the structure of the door panel 30 will be described in detail with referenced to the drawings.

Figure 5:
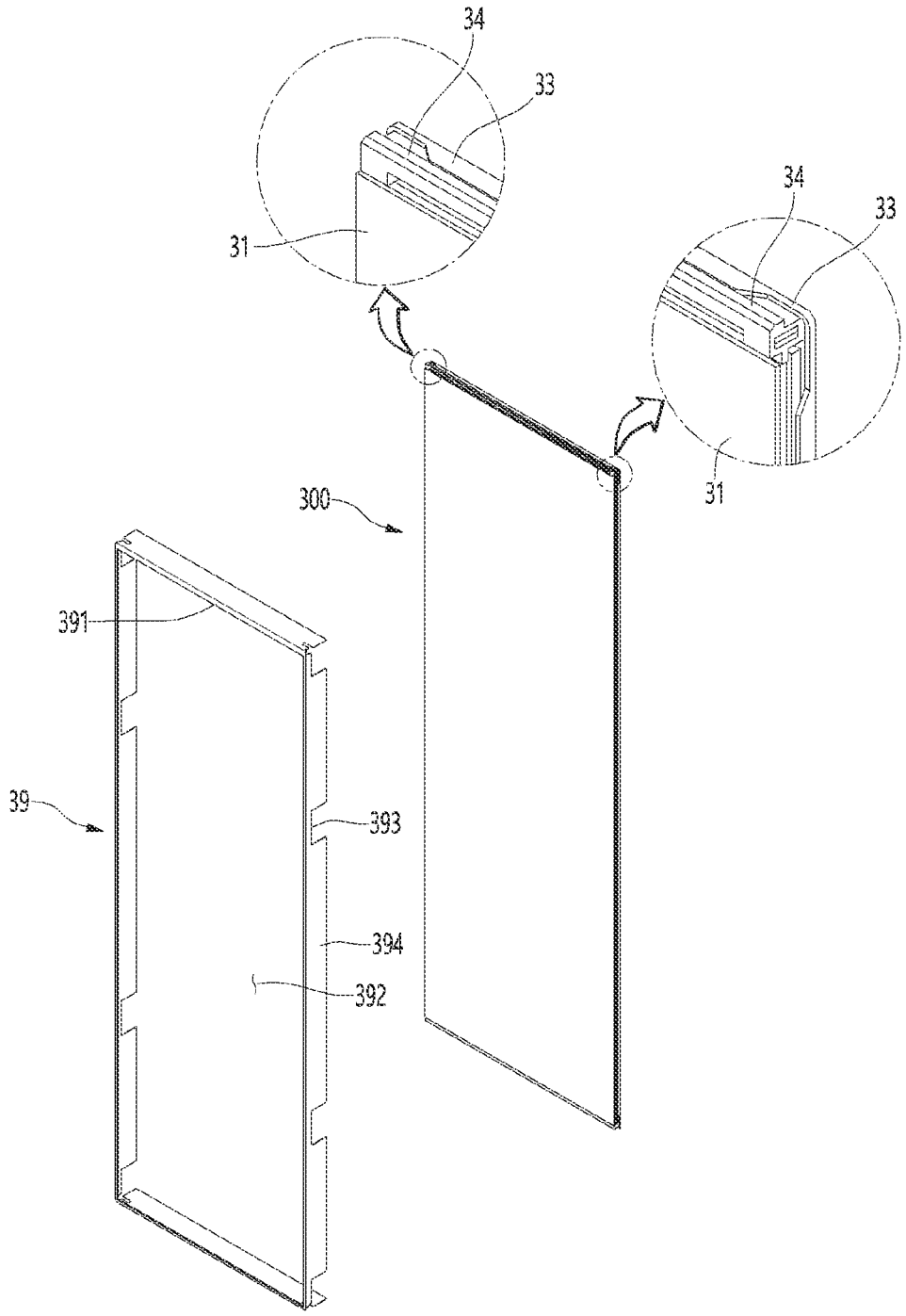
FIG. 5 is an exploded perspective view of an out frame that is a component of the door panel.
Figure 6:
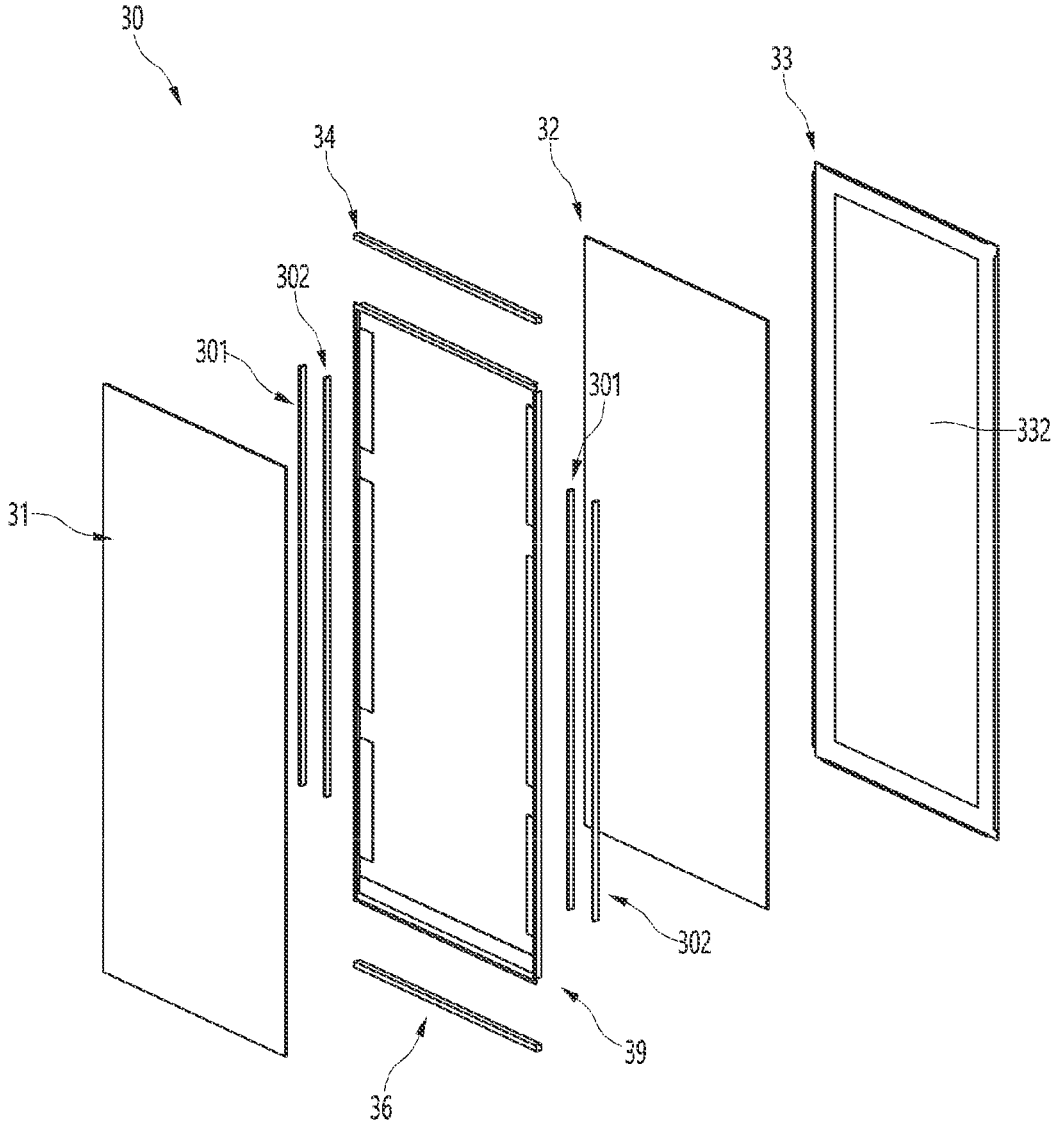
FIG. 6 is an exploded perspective view of a door panel viewed from the front.
Figure 7:
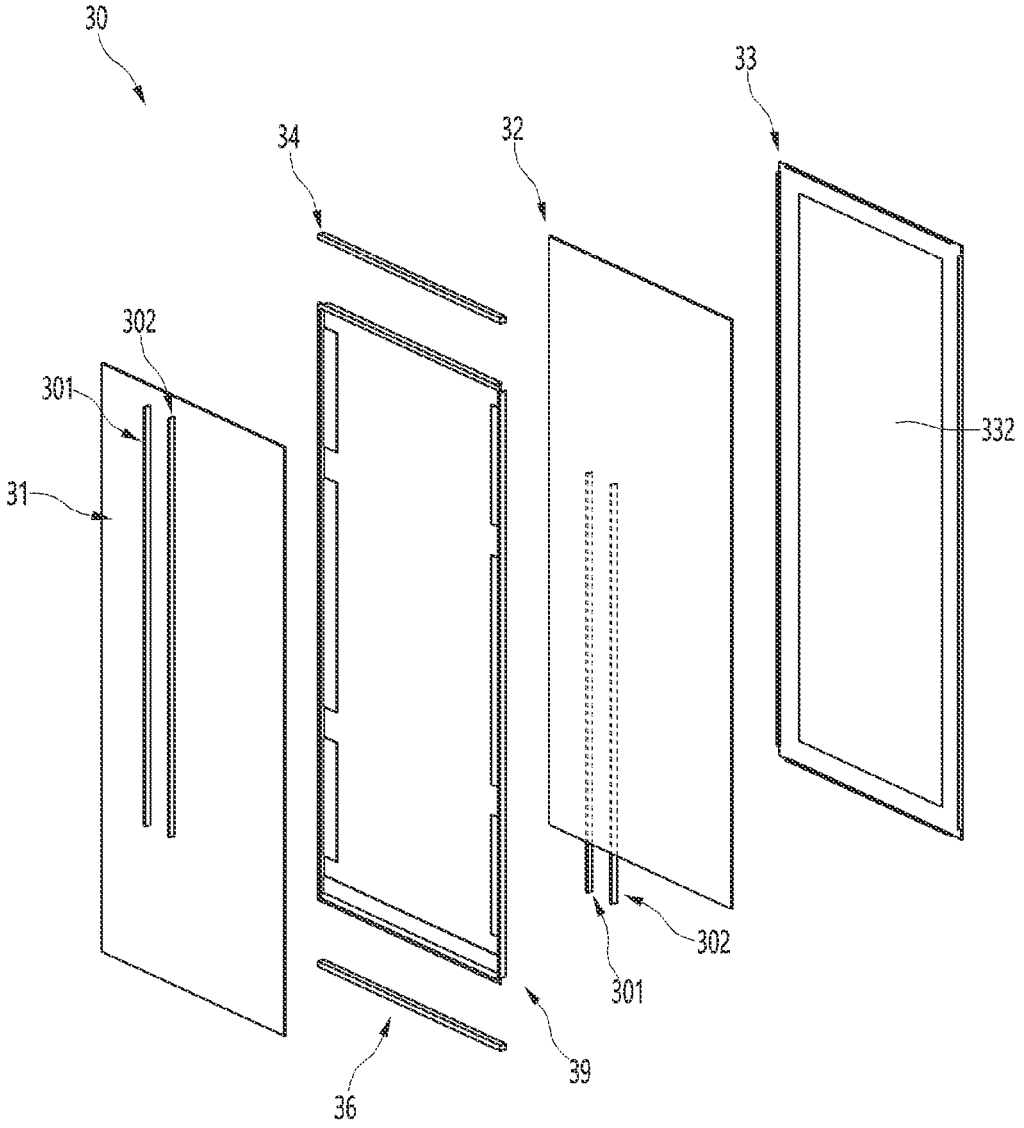
FIG. 7 is an exploded perspective view of the door panel viewed from the rear.

FIG. 5 is an exploded perspective view of an out frame that is a component of the door panel. FIG. 6 is an exploded perspective view of a door panel viewed from the front. FIG. 7 is an exploded perspective view of the door panel viewed from the rear.

As shown in the drawing, the door panel 30 may include a front plate 31 forming a front appearance of the door panel 30, the lighting device 35 for emitting light to cause the front plate 31 to glow, and a light guide plate 32 for guiding light emitted from the lighting device 35.

The door panel 30 may further include an upper bracket 34 for mounting the lighting device 35. The door panel 30 may further include a lower bracket 36 for supporting the front plate 31 and the light guide plate 32 at a position facing the upper bracket 34. The door panel 30 may further include a back cover 33 forming a rear surface. The door panel 30 may further include an out frame 39 forming a perimeter.

The door panel 30 may further include a front plate 31 forming a front appearance, a lighting device 35 for emitting light to cause the front plate 31 to glow, an upper bracket 34 and a lower bracket 35 that form upper and lower surfaces of the door panel 30, respectively, and a back cover 33 forming a rear surface.

These components are now described in more detail, and the front plate 31 may be formed in a rectangular plate shape and may be formed of a material that transmits light therethrough. For example, the front plate 31 may be formed of a glass or transparent plastic material or may be formed of other materials capable of transmitting light. The front plate 31 may be referred to as a transparent plate or a front plate.

The front plate 31 may be formed to be transparent to transmit light reflected by the light guide plate 32. In this case, the transparency may refer to a degree by which light is capable of passing. The front plate 31 may be formed with color as necessary. For example, the front plate 31 may be formed with specific color. As necessary, a specific design or pattern may be printed and formed and a film with a specific design or pattern printed thereon may be added, coated, or deposited to form the outer appearance of the front plate 31. The front plate 31 may be configured to transmit light emitted from the lighting device 35 but components behind the front plate 31 may not be seen therethrough.

The front plate 31 may be formed with a somewhat smaller size than the size of the door panel 30 and may be formed with a larger size than the light guide plate 32. A perimeter of the front plate 31 may be supported by the out frame 39.

The light guide plate 32 may be positioned at a rear spaced apart from the front plate 31 and may be configured to guide light emitted from the lighting device 35 disposed at the upper end of the light guide plate 32 forward.

For example, the light guide plate 32 may be formed of a transparent polymer material such as acrylic. The light guide plate 32 may have a diffusing agent added thereto for diffusing light incident on the light guide plate 32 or a pattern for diffusing light may be further formed on the light guide plate 32.

A reflective layer 321 may be further formed on a rear surface of the light guide plate 32. The reflective layer 321 may reflect light diffused along the light guide plate 32 in a forward direction, that is, toward the front plate 31 and may be formed an entire rear surface of the light guide plate 32. The reflective layer 321 may be formed by coating, vapor deposition, or film adhesion.

The light guide plate 32 may be formed as a whole in the rectangular plate shape and may be formed with a smaller size than the size of the front plate 31. The light guide plate 32 may be supported from the rear by the back cover 33, and upper and lower ends of the light guide plate 32 may be fixed by the upper bracket 34 and the lower bracket 36.

Front spacers 301 may be disposed at right and left side ends of a front surface of the light guide plate 32, and rear spacers 302 may be disposed at right and left side ends of a rear surface of the light guide plate 32.

The front spacers 301 may be disposed at right and left side ends of the light guide plate 32, respectively, and may extend in a vertical direction. A front surface of the front spacer 301 may be in contact of a rear surface of the front plate 31, and the rear surface may be in contact with a front surface of the light guide plate 32. That is, the front spacer 301 may have a thickness corresponding to an interval between the front plate 31 and the light guide plate 32, and the light guide plate 32 may be maintained in an appropriate interval with the front plate 31.

The rear spacers 302 may be disposed at right and left side ends of the light guide plate 32, respectively, and may extend in a vertical direction. A front surface of the rear spacer 302 may be in contact with a rear surface of the light guide plate 32, and the rear surface may be in contact with the front surface of the back cover 33. That is, the rear spacer 302 may have a thickness corresponding to an interval between the light guide plate 32 of the panel and the back cover 33, and the light guide plate 32 may be maintained in an appropriate interval with the back cover 33.

That is, in a situation in which the door 20 is repeatedly opened and closed, the light guide plate 32 may be maintained in a predetermined interval with the front plate 31 and the back cover 33 and may not deviate from a position at which the light guide plate 32 is originally installed. The light guide plate 32 may be disposed on the same extension line as a light source provided in the lighting device 35 to maintain a constant position to allow light emitted from the light source to pass through an end of the light guide plate 32.

The front spacer 301 and the rear spacer 302 may be formed of an elastic material. Thus, when the door 20 is opened and closed, impact transmitted to the door 20 and the door panel 30 may be buffered by the front spacer 301, thereby preventing the front plate 31 and the light guide plate 32 from being damaged.

Even when the light guide plate 32 is slightly expanded or contracted due to a temperature difference, the front spacer 301 and the rear spacer 302 may be elastically deformed to ensure a stable support state of the light guide plate 32. To this end, the front spacer 301 may be adhered to the front plate 31, maintaining a simple contact state with the light guide plate 32, and the rear spacer 302 may be adhered to the back cover 33, maintaining a simple contact state with the light guide plate 32.

The upper bracket 34 may be disposed at an upper end of the door 20 of the pane and may fixedly install the lighting device 35 for emitting light to the light guide plate 32. Thus, the upper bracket 34 may be referred to as a right bracket. The upper bracket 34 may extend to a right end of the door 20 of the panel from a left end and may be formed to be equal to or longer than a right and left direction length of the light guide plate 32.

In the state in which the door panel 30 is assembled, the upper bracket 34 may be positioned higher than a lower end of a front surface part 391 of the out frame 39, and thus when a user sees from the front, a light source 362 mounted on the upper bracket 34 and the upper bracket 34 may not be visible to the user.

In particular, when the user sees a front surface of the door 20 from the front of the refrigerator 1, the lighting device 35 may not be directly exposed, and the light source 362 may emit light downward from a position higher than the user's line of sight, thereby preventing glare of the user.

The lower bracket 36 may be disposed at the lower end of the door 20 of the pane and may support the lower end of the front plate 31 and the lower end of the light guide plate 32 from below. Thus, the lower bracket 36 may also be referred to as a support bracket. The upper bracket 34 may extend to a right end of the door 20 of the panel from a left end and may be formed to be equal to or longer than a right and left direction length of the light guide plate 32.

The back cover 33 may form the rear surface of the door panel 30 and may support the light guide plate 32, the upper bracket 34, and the lower bracket 36. The back cover 33 may be formed of a material such as stainless or aluminum. The back cover 33 may be formed with a size corresponding to the size of the door panel 30, and the light guide plate 32 may be mounted in an inner space of the back cover 33. In addition, the upper bracket 34 and the lower bracket 36 may be mounted on the back cover 33. That is, the back cover 33 may connect the upper bracket 34 to the lower bracket 36.

The rear surface of the light guide plate 32 may be supported by a cover protrusion 332 protruding the center of the back cover 33. Thus, the light guide plate 32 may be maintained in a stable mounting state. In addition, the upper bracket 34 and the lower bracket 36 may be disposed along the upper and lower ends of the back cover 33, respectively.

The out frame 39 may form a peripheral surface of the door panel 30. The out frame 39 may surround perimeters of the front plate 31 and the back cover 33 and may maintain the state in which the door panel 30 is assembled.

The out frame 39 may be formed of a plate-shaped metal material. The out frame 39 may be bent multiple times to restrain the front perimeter of the front plate 31 and the back perimeter of the back cover 33 and may form the perimeter of the door panel 30. In the state in which the out frame 39 restrains the front plate 31 and the back cover 33, the light guide plate 32, the upper bracket 34, the lower bracket 36, the front spacer 301, and the rear spacer 302 included in the door panel 30 may be maintained to be assembled between the front plate 31 and the back cover 33.

That is, the door panel 30 may be assembled to one panel assembly 300 except for the out frame 39, and the panel assembly 300 may be fixed by bending the out frame 39.

In detail, in order to assemble the door panel 30, first, the upper bracket 34 and the lower bracket 36 on which the front plate 31, the light guide plate 32, the back cover 33, the front spacer 301, the rear spacer 302, and the lighting device 35 may be disposed to assemble the formed of the panel assembly 300. In this case, the panel assembly 300 may be in a temporary and basic assembly state rather than a complete and final assembly state.

Needless to say, in this case, the front plate 31 may also have a shape the door panel 30 and may be maintained in a state in which the out frame 39 is to be coupled to the front plate 31. In particular, the front plate 31 may maintain the minimum thickness in a simple stacked structure without a coupling structure such as a screw, a bolt, or a rivet.

The out frame 39 may be mounted to restrain at least one a portion of the perimeter of the front of the front plate 31 by the front surface part 391, in which an opening 392 is formed. In this case, an edge 393 of the out frame 39 may cover the peripheral surface of the panel assembly 300 in the coupling state. A rear surface part that further extends from the edge 393 may be bent to restrain at least a portion of the perimeter of the rear surface of the back cover 33.

That is, a space between stacked layers of the panel assembly 300 may be shielded by mounting and bending the out frame 39, and simultaneously, components of the panel assembly 300 may be maintained in a solidly coupled state. A rear surface part 394 may be firmly fixed to the back cover 33 by welding, bonding, or bonding to maintain a final assembly state of the door panel 30 and to maintain an assembly position of components of the panel assembly 300.

Structures of the back cover 33, the upper bracket 34, the lower bracket 36, and the out frame 39 will be described below in more detail with reference to the drawings.

Figure 8:
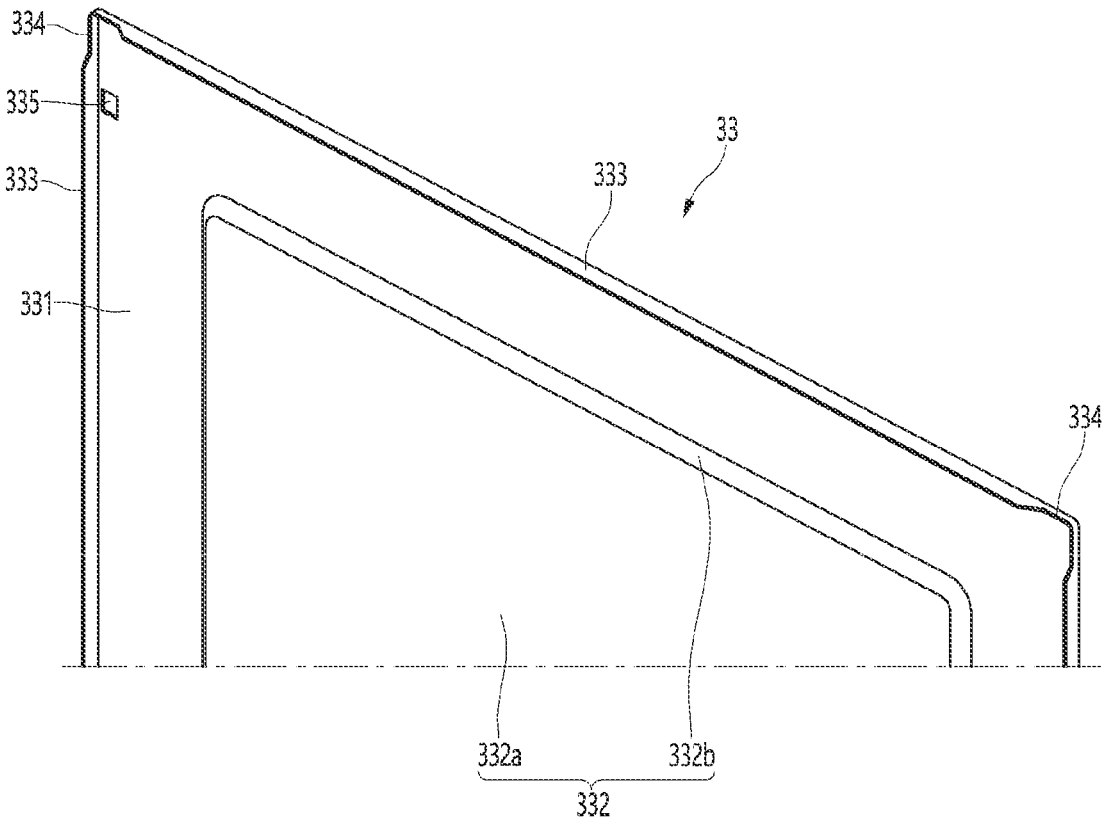
FIG. 8 is a partial perspective view of a back cover of the door panel.

FIG. 8 is a partial perspective view of a back cover of the door panel.

As shown in the drawing, the back cover 33 may be formed of a plate-shaped metal material and central and edge portions thereof may protrude forward. For example, the back cover 33 may be formed of a steel material and the overall shape thereof may be molded by foaming.

The back cover 33 may include a cover perimeter part 331 and a cover protrusion 332. The cover perimeter part 331 may form a rear surface of the back cover 33. The cover protrusion 332 may protrude forward from the cover perimeter part 331. The cover protrusion 332 may be in contact with the rear surface of the light guide plate 32 and a central part of the back cover 33 may protrude forward. That is, the cover protrusion 332 may be molded to support the light guide plate 32 from the rear by foaming molding of the back cover 33.

The cover protrusion 332 may be formed in a shape that protrudes forward with respect to the cover perimeter part 331 and is recessed when viewed from the rear. The cover perimeter part 331 recessed backward relatively may be formed along the perimeter of the cover protrusion 332.

In detail, the cover protrusion 332 may include a contact part 332*a* in contact with the light guide plate 32 and a bent part 332*b* that is formed along the perimeter of the contact part 332*a* and extends backward. The contact part 332*a* may form a protruding plane of the cover protrusion 332 and may be formed to surface-contact the light guide plate 32.

The contact part 332*a* may be formed in an approximately rectangular shape and may be formed somewhat smaller than the size of the light guide plate 32. The contact part 332*a* may form most of the remaining area of the back cover 33 except for a portion shielded by the out frame 39. The contact part 332*a* may extend parallel to the rear surface of the light guide plate 32 and may support most of the area except for the perimeter of the light guide plate 32.

The bent part 332*b* may connect the contact part 332*a* and the cover perimeter part 331. The bent part 332*b* may be bent backward from the edge of the contact part 332*a* and may have a predetermined height. Thus, the cover perimeter part 331 may be positioned rearward than the contact part 332*a* and may provide a space for the upper bracket 34 and the lower bracket 36 to be disposed at the upper end and lower end inside the door panel 30.

In the state in which the door panel 30 is assembled, the light guide plate 32 may be maintained in the state of being supported by the contact part 332*a*. Thus, the light guide plate 32 may be maintained at a mounting position within the door panel 30 to effectively direct light emitted from the lighting device 35 toward an end of the light guide plate 32. In addition, through stable support of the cover protrusion 332, the light guide plate 32 may be prevented from being excessively bent or deformed.

A cover edge 333 protruding forward may be formed at an end of the cover perimeter part 331. The cover edge 333 may be formed along the cover perimeter part 331 and may be bent forward. The back cover 33 may be formed with an open space in the front by the cover edge 333, and may accommodate the light guide plate 32, the upper bracket 34, and the lower bracket 36 therein.

The cover edge 333 may protrude with a higher protruding height than the cover protrusion 332. The front end of the cover edge 333 may further protrude compared with a front surface of the light guide plate 32 in the state in which the light guide plate 32 is supported by the cover protrusion 332.

Cut corners 334 may be formed at both ends of upper and lower surfaces and upper and lower ends of right and left side surfaces of the cover edge 333. Both ends of upper and lower surfaces of the cover edge 333 may be inclined or stepped by the inclined shapes of both ends of the corners 334. In addition, the upper and lower surfaces of the cover edge 333 may be matched to each other with the upper bracket 34 and the lower bracket 36 to maintain the state in which the upper bracket 34 and the lower bracket 36 do not move and remain coupled to an exact position.

The wire hole 335 may be opened in an upper end corner of the cover perimeter part 331. The wire hole 335 may be positioned at a position corresponding to an arrangement position of the lighting device 35. The wire hole 335 may be opened to allow the wire 336 connected to the lighting device 35 to enter and exit. Thus, the wire hole 335 may provide a path for allowing the wire 336 for supplying power to the lighting device 35 to enter and exit in the state in which the door panel 30 is assembled. The panel connector 336*a* may be disposed at an end of the wire 336 drawn out through the wire hole 335. The wire hole 335 may be formed at a position that does not interfere with a bent portion of the out frame 39 in the state in which the out frame 39 and the back cover 33 are coupled to each other.

Hereinafter, the upper bracket 34 and the lighting device 35 will be described below in more detail with reference to the drawings.

Figure 9:
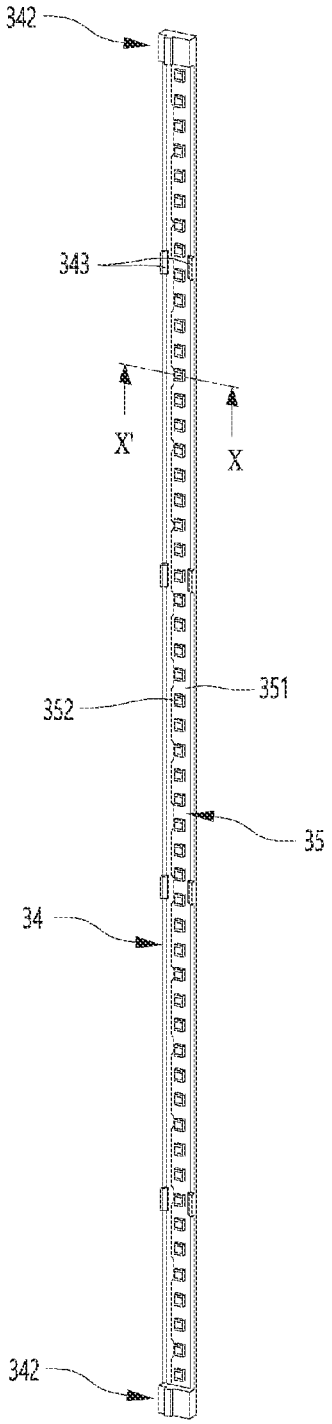
FIG. 9 is a perspective view of the case in which a lighting device and a right bracket as components of the door panel are coupled to each other.
Figure 10:
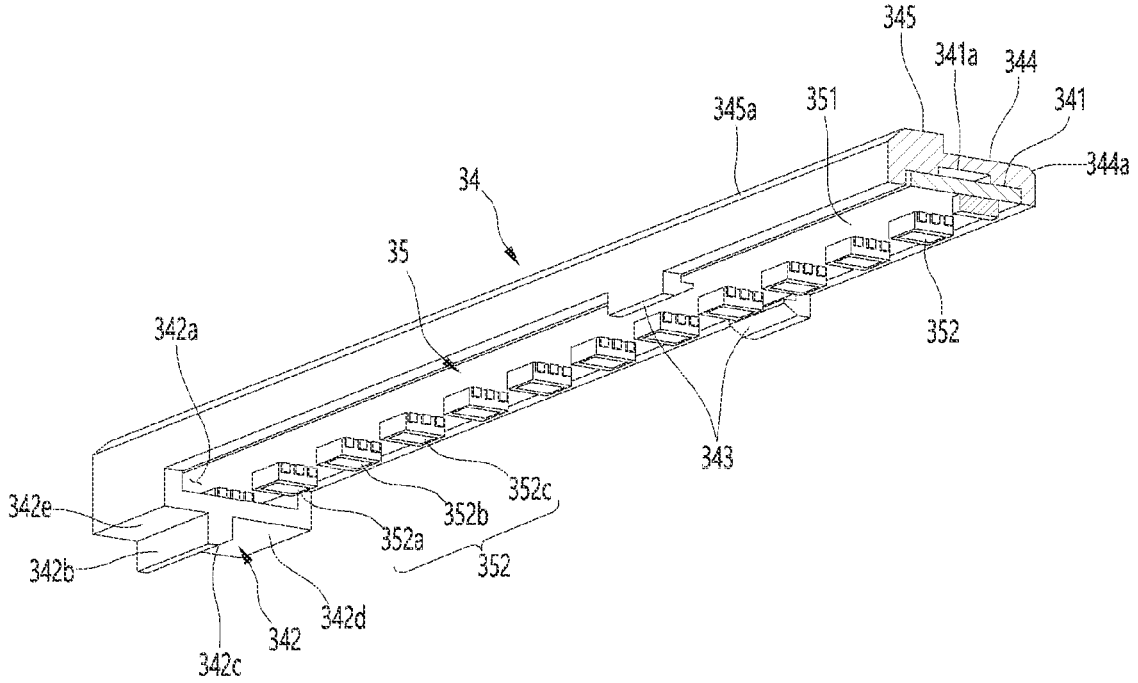
FIG. 10 is an exploded perspective view taken along X-X' of FIG. 9.
Figure 11:
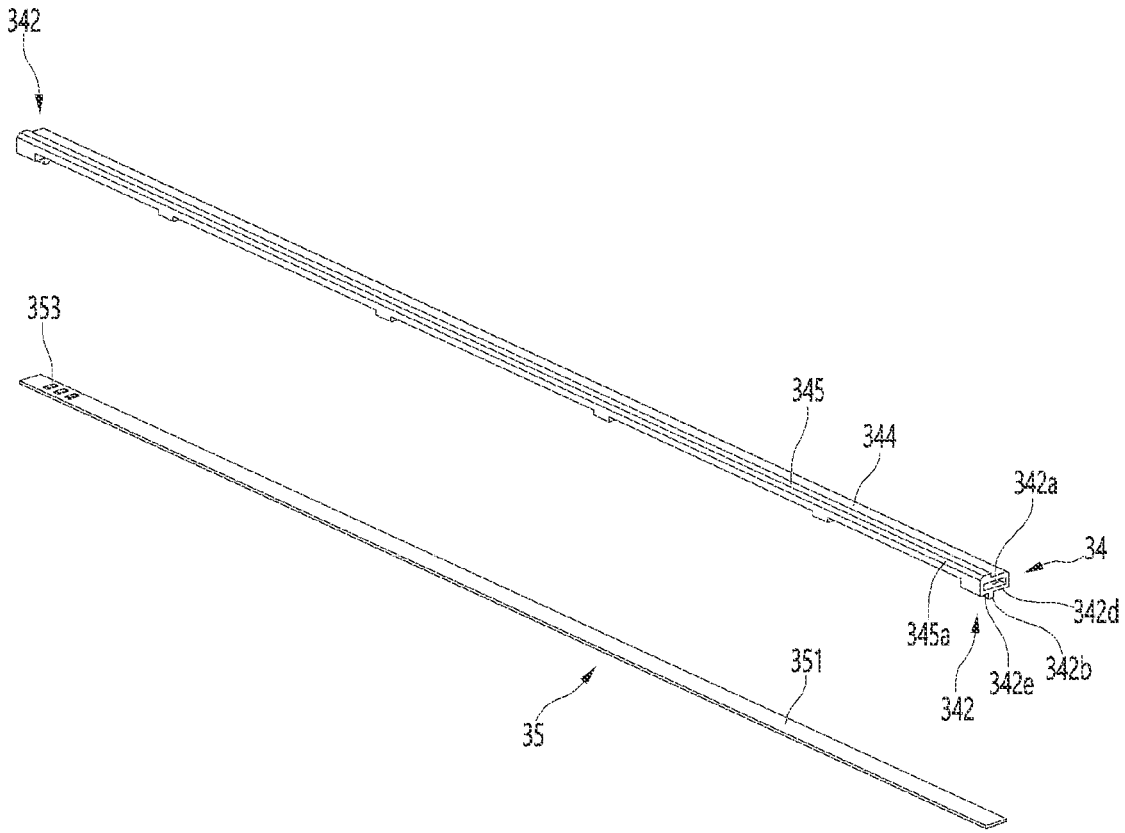
FIG. 11 is an exploded perspective view of the case in which the lighting device and the right bracket are disassembled when viewed from above.
Figure 12:
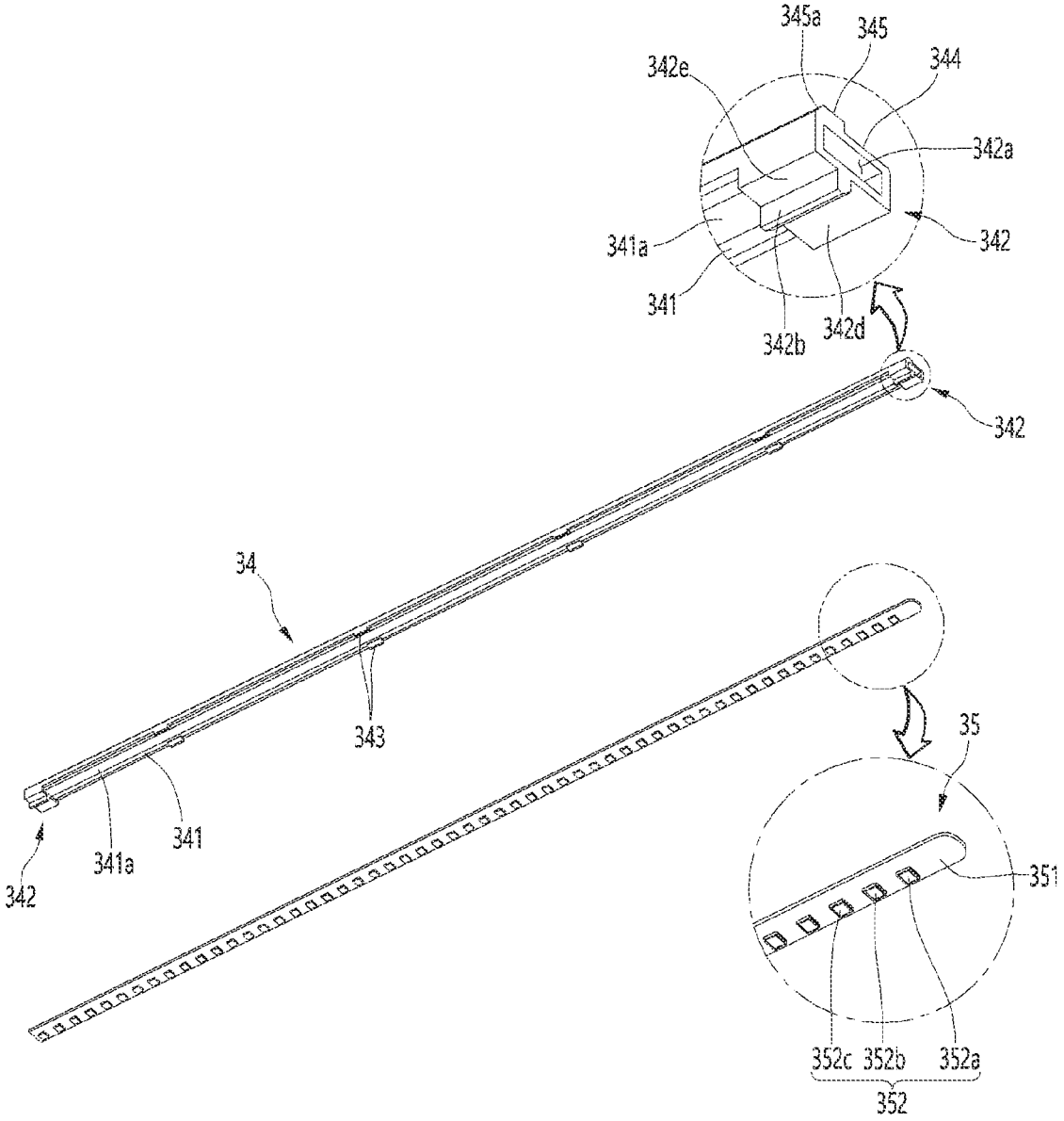
FIG. 12 is an exploded perspective view of the case in which the lighting device and the right bracket are disassembled when viewed from below.
Figure 13:
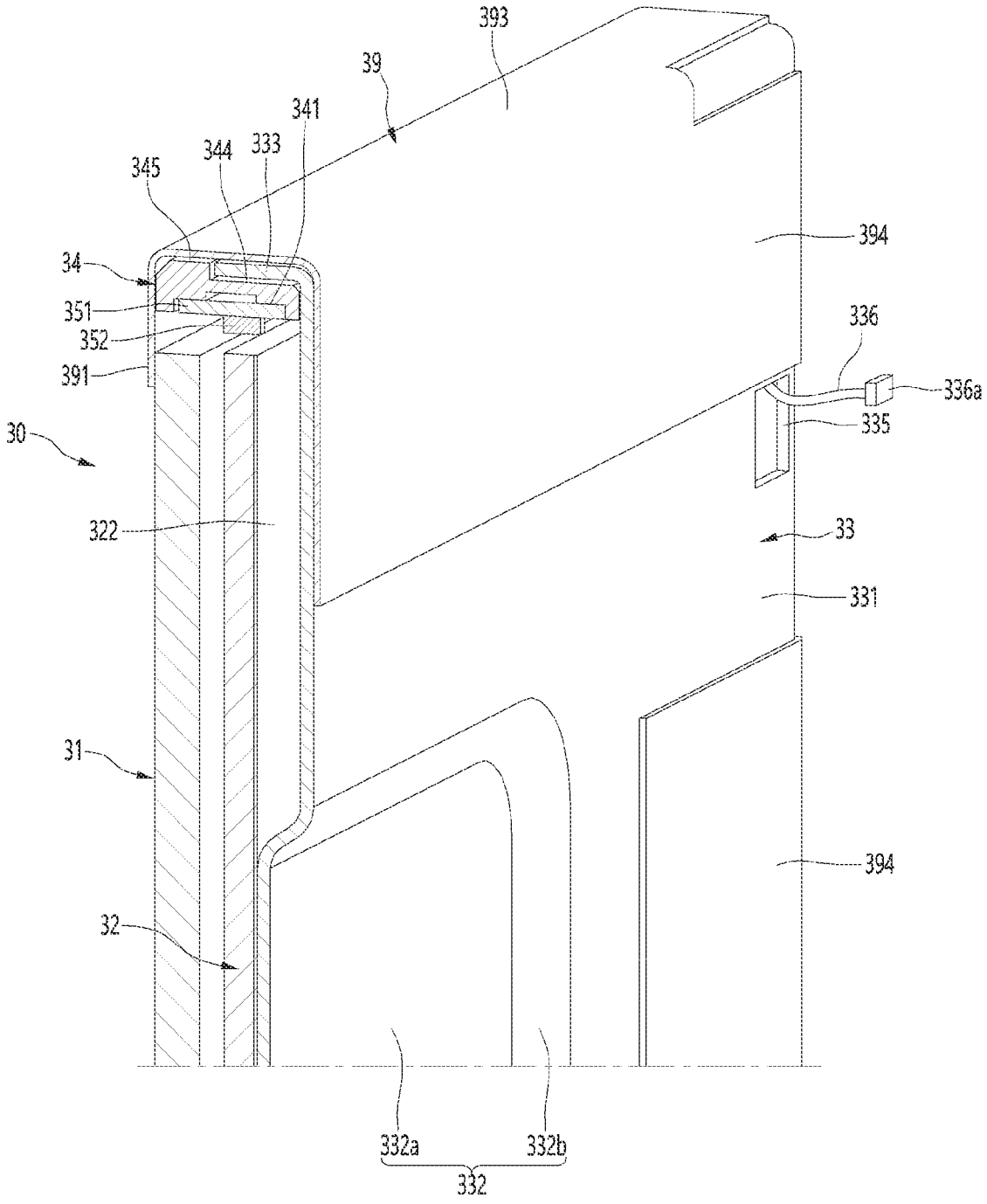
FIG. 13 is an exploded perspective view taken along XIII-XIII' of FIG. 4.
Figure 14:
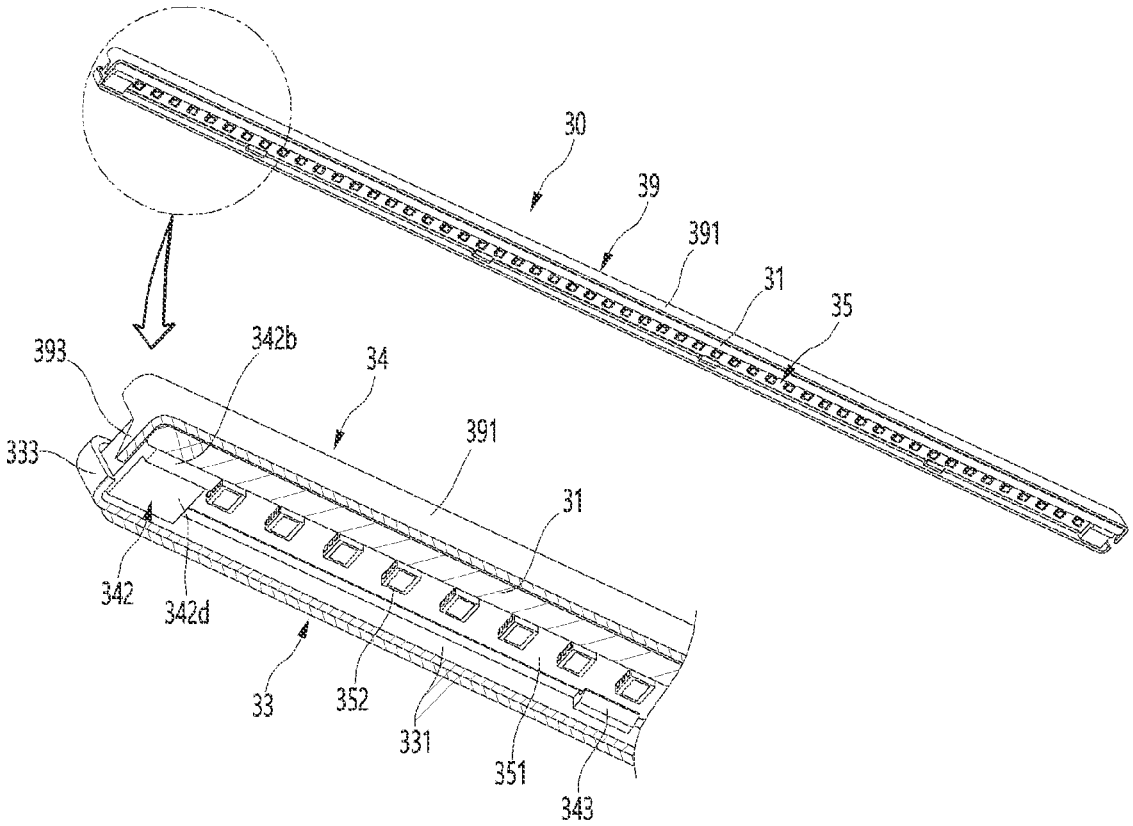
FIG. 14 is an exploded perspective view taken along XIV-XIV' of FIG. 4.

FIG. 9 is a perspective view of the case in which a lighting device and a right bracket as components of the door panel are coupled to each other. FIG. 10 is an exploded perspective view taken along X-X' of FIG. 9. FIG. 11 is an exploded perspective view of the case in which the lighting device and the right bracket are disassembled when viewed from above. FIG. 12 is an exploded perspective view of the case in which the lighting device and the right bracket are disassembled when viewed from below. FIG. 13 is an exploded perspective view taken along XIII-XIII' of FIG. 4. FIG. 14 is an exploded perspective view taken along XIV-XIV' of FIG. 4.

As shown in the drawings, the upper bracket 34 may be disposed at the upper end of the door panel 30 in the state of being coupled to the lighting device 35. The lighting device 35 may be mounted inside the door panel 30 with the upper bracket 34 in the state of being coupled to the upper bracket 34. In this case, the state in which the upper bracket 34 and the lighting device 35 are coupled to each other may also be referred to as a light assembly.

The lighting device 35 may include a substrate 351 extending long along the upper end of the door panel 30, and a light source 352 mounted on the substrate 351. For example, the light source 352 may include an LED. The plurality of light sources 352 may be arranged in a line along the substrate 351, and in the state in which the lighting device 35 is mounted, the light sources 352 may be arranged to face the upper end of the light guide plate 32. The plurality of light sources 352 may be arranged above the upper end of the light guide plate 32 and may be consecutively arranged at a predetermined interval along the light guide plate 32.

The light source 352 may be configured to glow with various colors. For example, the plurality of light sources 352 may be configured to emit light with various colors. For example, the light sources 352 may include a red light source 352*a*, a green light source 352*b*, and a blue light source 352*c*.

That is, the plurality of light sources 352 may be configured by repeatedly disposing red, green, and blue light sources. Needless to say, arrangement of the plurality of light sources 352 may also be changed as necessary. When the light sources 352 with different colors are combined and turned on, color of an outer appearance, represented through the door panel 30, may be embodied in various ways. As necessary, the light sources 352 may be configured to selectively emit light with a plurality of colors.

The plurality of light sources 352 may be consecutively arranged in a line along a lower surface of the substrate 351. In this case, the light sources 352 may be arranged at equal intervals and may include one set of the red light source 352*a*, the green light source 352*b*, and the blue light source 352*c*. The light sources 352 may also be configured by repeatedly arranging a plurality of sets. A substrate connector 353 to which the wire 336 is connected may be further formed on an upper surface of the substrate 351.

The lighting device 35 may be mounted on the upper bracket 34, and when the upper bracket 34 is mounted, the lighting device 35 may be positioned at an exact position inside the door panel 30.

The upper bracket 34 may have a length corresponding to the substrate 351. The upper bracket 34 may be formed to a larger length than the light guide plate 32 and may be accommodated inside the back cover 33. The upper bracket 34 may extend from one end of the back cover 33 to the other end.

The upper bracket 34 may be formed of a plastic material and may have a structure to which the lighting device 35 is fixedly installed. The upper bracket 34 may also be installed while maintaining a set interval between the front plate 31 and the light guide plate 32.

The upper bracket 34 is now described in more detail. The upper bracket 34 may be at least longer than a right and left length of the light guide plate 32 and shorter than a right and left length of the back cover 33.

The upper bracket 34 may be positioned at an upper end inside the door panel 30, and the front plate 31 and the light guide plate 32 may be supported from above, and thus the upper bracket 34 may be referred to as a support bracket.

A substrate accommodator 341 that is recessed with a shape corresponding to the shape of the substrate 351 may be formed on a lower surface of the upper bracket 34. Thus, the substrate 351 of the lighting device 35 may be accommodated on the substrate accommodator 341, a lower surface of the substrate accommodator 341 may support an upper surface of the substrate 351, and a front surface of a rear surface of the substrate accommodator 341 may support a front end and a rear end of the substrate 351, respectively. Thus, the substrate 351 may not move in the state of being mounted on the upper bracket 34 and may be maintained in a stable mounting state.

The substrate accommodator 341 may extend from one side of right and left sides of the upper bracket 34 to the other end, and the both ends of the upper bracket 34 may be opened. An accommodator groove 341*a* that is further recessed upward may be further formed on the substrate accommodator 341. The accommodator groove 341*a* may be recessed to prevent various devices in addition to the substrate connector 353 protruding from an upper surface of the substrate from interfering. The accommodator groove 341*a* may also extend from one end of the right and left side ends of the upper bracket 34 to the other end.

A plurality of hooks 343 may formed along front and rear ends of the substrate accommodator 341. The hooks 343 may protrude downward and may protrude into the substrate accommodator 341 to be restrained in the state in which the substrate 351 is mounted on the substrate accommodator 341.

Bracket supports 342 may be formed on right and left sides of the upper bracket 34. The bracket supports 342 may support upper ends of the front plate 31 and the light guide plate 32 and may maintain an interval between the front plate 31 and the light guide plate 32.

In detail, the bracket supports 342 may protrude downward at both ends of the bracket supports 342 and may be formed with a predetermined width. A through hole 342*a* may be formed in the bracket support 342 to allow the substrate 351 to pass therethrough. The substrate accommodator 341 and the accommodator groove 341*a* may be formed inside the through hole 342*a*. The substrate 351 may be inserted from the side through the through hole 342*a*.

An upper spacer 342*b* protruding downward may be formed on a lower surface of the bracket support 342. The upper spacer 342*b* may extend from one end of right and left sides of the bracket support 342 to the other end and may protrude downward. In this case, the upper spacer 342*b* may protrude to be inserted between the front plate 31 and the light guide plate 32. That is, the protruding lower end of the upper spacer 342*b* may be positioned below compared with the upper end of the front plate 31 and the upper end of the light guide plate 32.

The front surface of the upper spacer 342*b* and may be in contact with the rear surface of the front plate 31, and the rear surface of the upper spacer 342*b* may protrude to be in contact with the front surface of the light guide plate 32. Thus, in the state in which the door panel 30 is assembled, the positions of the upper ends of the front plate 31 and the light guide plate 32 may be determined by the upper spacer 342*b*, and a fixed state may be maintained. In particular, the upper spacer 342*b* may allow the upper end of the light guide plate 32 to be positioned on the same extension line as the light source 352.

An inclined surface 342*c* may be formed on a lower surface and a rear surface of the upper spacer 342*b*. When the upper bracket 34 is installed, the inclined surface 342*c* may allow the upper spacer 342*b* to be easily inserted into a space between the front plate 31 and the light guide plate 32.

The lower surface of the upper bracket 34 may be formed in a flat shape and may include a first bottom support 342*e* formed in the front and a second bottom support 342*d* formed in the rear based on the upper spacer 342*b*.

The first bottom support 342*e* may be formed to support the upper end of the front plate 31. The first bottom support 342*e* may be formed with a front-rear width corresponding to the thickness of the front plate 31 and the upper end of the front plate 31 may be firmly fixed by the upper spacer 342*b* and the out frame 39.

The second bottom support 342*d* may be formed to support the upper end of the light guide plate 32. The height of the second bottom support 342*d* may be positioned further below the lower end of the light source 352. Thus, the upper ends of the light source 352 and the light guide plate 32 may be maintained at an appropriate interval to allow light of the light source 352 to be effectively incident on the light guide plate 32. For example, an interval between the upper ends of the light source 352 and the light guide plate 32 may be formed with several millimeters.

The second bottom support 342*d* may limit upward movement of the light guide plate 32. That is, even if impact is applied in a process of opening and closing the door 20, the light guide plate 32 may be moved upward to prevent colliding with the light source 352. The second bottom support 342*d* may be formed to be slightly spaced apart from the upper end of the light guide plate 32 in consideration of expansion of the light guide plate 32.

An upper end protrusion 345 and an upper end accommodator 344 may be formed on an upper surface of the upper bracket 34. The upper end protrusion 345 may form a protruding upper surface of the upper bracket 34 and may be in close contact with the edge 393 of the out frame 39 in the state in which the door panel 30 is assembled. An inclined surface 345*a* may be formed on the front end of the upper end protrusion 345 to prevent interference with a corner part of the bent out frame 39, and the upper bracket 34 may be in close contact with the out frame 39.

The upper end accommodator 344 may be stepped with a lower height than the upper end protrusion 345. The stepped height of the upper end accommodator 344 may correspond to the thickness of the back cover 33. The upper end accommodator 344 may be formed to accommodate the cover edge 333 of the back cover 33 thereon in the state in which the door panel 30 is assembled. An inclined surface 344*a* may be formed on a rear end of the upper end accommodator 344 to prevent interference with a corner part of the bent back cover 33, and the upper bracket 34 may be in close contact with the back cover 33.

In the state in which the door panel 30 is assembled, the cover edge 333 of the back cover 33 may be inserted between an upper surface of the upper end accommodator 344 and a lower surface of the edge 393 and may surface-contact the upper end accommodator 344 and the edge 393. Thus, the upper bracket 34 may have a firmly coupling structure inside the door panel 30 and may be maintained at a mounting position thereof.

Adhesives may be coated on an upper surface of the upper bracket 34, that is, at least one of the upper end protrusion 345 or the upper end accommodator 344 to maintain the state in which the upper bracket 34 is firmly fixed to the out frame 39 or the back cover 33.

Hereinafter, the structure of the lower bracket 36 will be described in detail with reference to the drawings.

Figure 15:
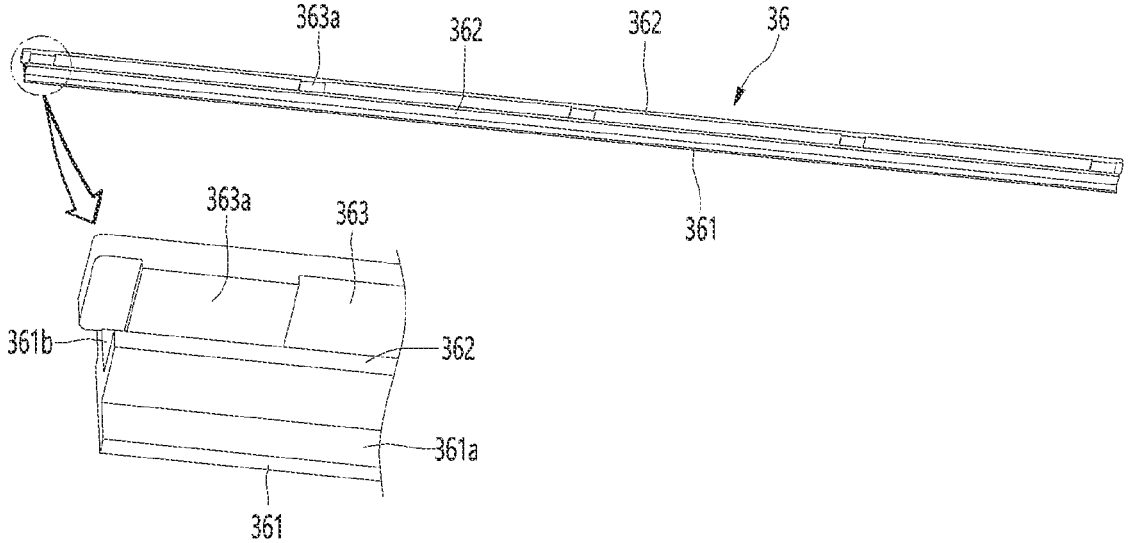
FIG. 15 is a perspective view of a support bracket that is one component of the door panel.
Figure 16:
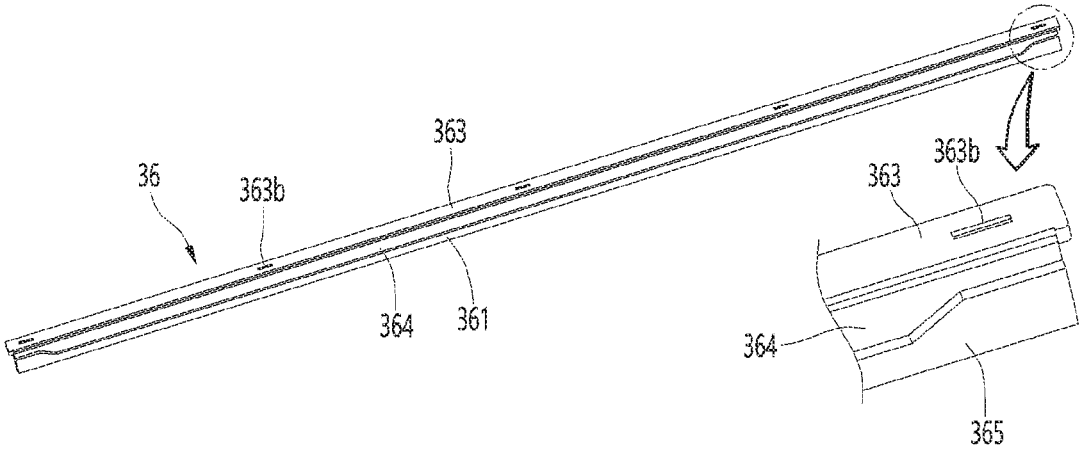
FIG. 16 is a perspective view of the support bracket viewed from below.
Figure 17:
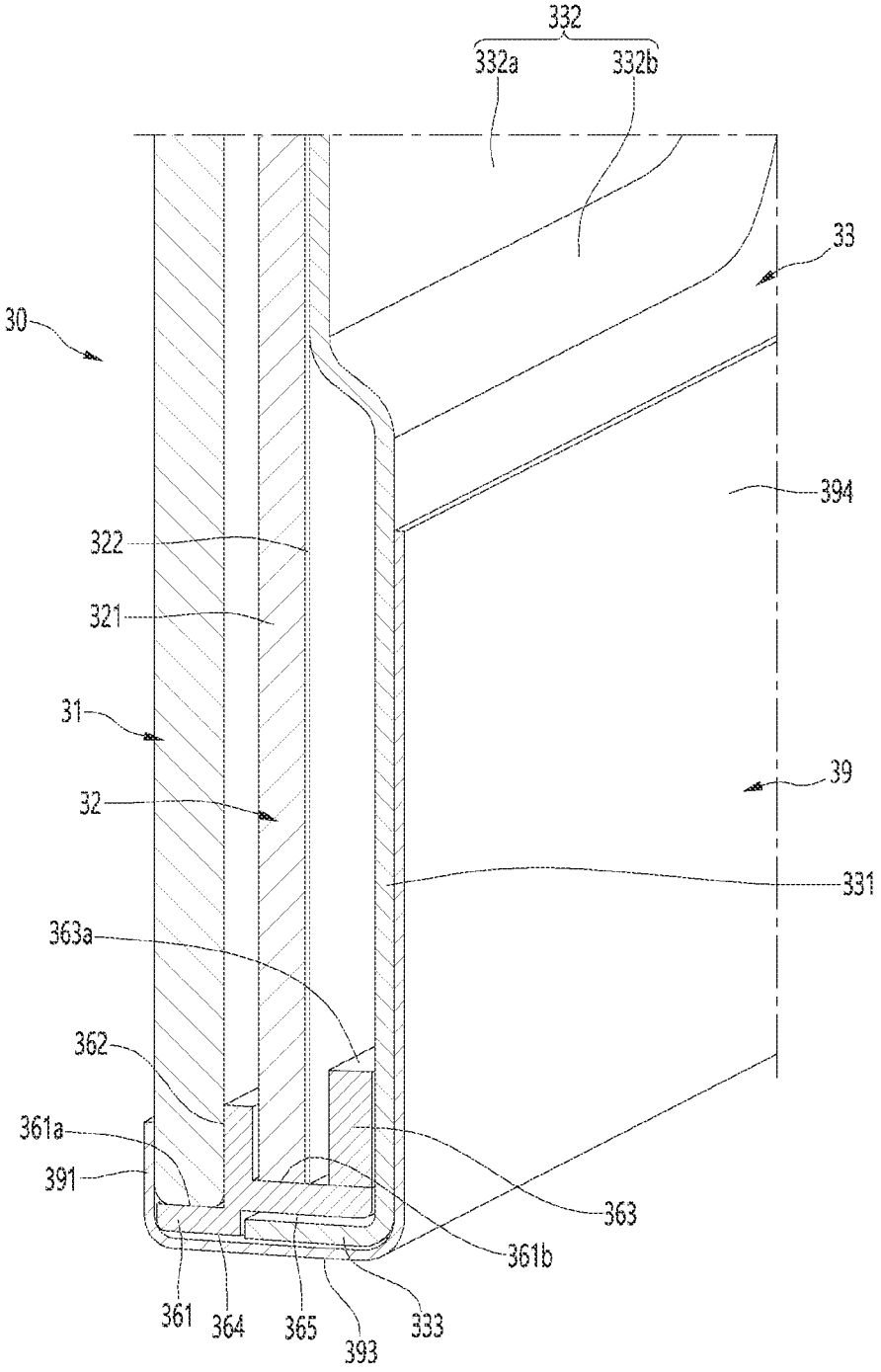
FIG. 17 is an exploded perspective view taken along XVII-XVII' of FIG. 4.
Figure 18:
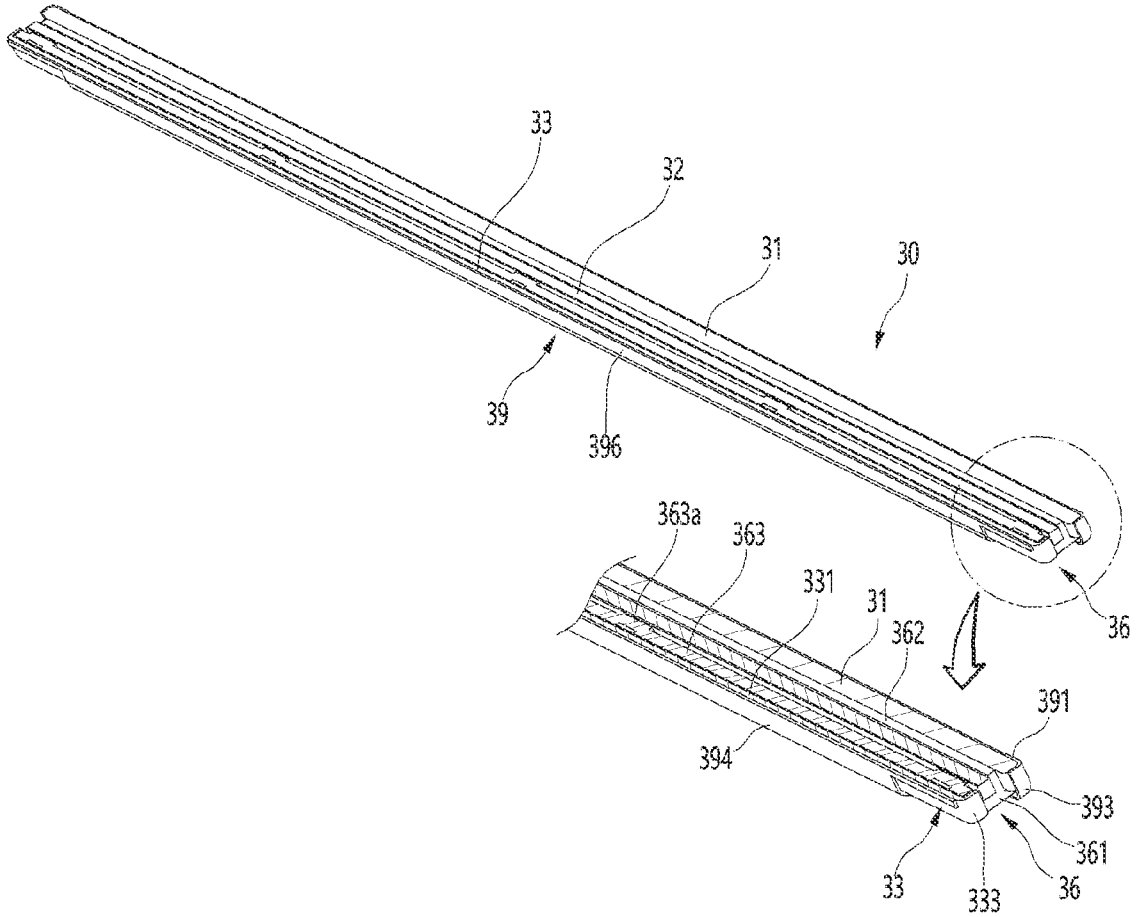
FIG. 18 is an exploded perspective view taken along XVIII-XVIII' of FIG. 4.

FIG. 15 is a perspective view of a support bracket that is one component of the door panel. FIG. 16 is a perspective view of the support bracket viewed from below. FIG. 17 is an exploded perspective view taken along XVII-XVII' of FIG. 4. FIG. 18 is an exploded perspective view taken along XVIII-XVIII' of FIG. 4.

As shown in the drawings, the lower bracket 36 may be formed of a plastic material and may extend long in a right and left direction. The lower bracket 36 may extend from a left end of the back cover 33 to a right end and may be formed with a length corresponding to a right and left direction length of the front plate 31 or the light guide plate 32.

The lower bracket 36 may be mounted on a lower end of the door panel 30 and may support the lower end of the front plate 31 and the lower end of the light guide plate 32 inside the door panel 30. The lower bracket 36 may maintain an interval set by lower ends of the front plate 31 and the light guide plate 32.

The lower bracket 36 is now described in detail. A lower spacer 362 may protrude upward on a bottom surface 361 of the lower bracket 36. The lower spacer 362 may extend from one end of right and left sides of the lower bracket 36 to the other end. The lower spacer 362 may protrude to be inserted between the lower end of the front plate 31 and the light guide plate 32.

A front surface of the lower spacer 362 may be in contact with a rear surface of the front plate 31, and a rear surface of the lower spacer 362 may be in contact with a front surface of the light guide plate 32. Thus, the lower spacer 362 may maintain an interval set by the lower end of the front plate 31 and the lower end of the light guide plate 32. The lower spacer 362 may be positioned vertically below the upper spacer 342*b*, and the lower spacer 362 may be formed with a thickness corresponding to the thickness of the upper spacer 342*b*.

A first top support 361*a* and a second top support 361*b* may be formed on the bottom surface 361 of the lower bracket 36. Based on the lower spacer 362, the first top support 361*a* may be formed in the front and the second top support 361*b* may be formed in the rear.

The first top support 361*a* may support the front plate 31 from below, and the second top support 361*b* may support the light guide plate 32 from below. In this case, the lower and lower length of the front plate 31 may be longer than that of the light guide plate 32. The first top support 361*a* may be formed lower than the second top support 361*b*.

A rear supporter 363 may be further formed on an upper surface of the lower bracket 36. The rear supporter 363 may protrude upward from a rear end of the lower bracket 36 and may be formed in parallel to the lower spacer 362. The rear supporter 363 may extend from a left end of the lower bracket 36 to a right end.

The rear surface of the rear supporter 363 may be supported by being in contact with the cover perimeter part 331 of the back cover 33. A supporter protrusion 363*a* that is in contact with a rear surface of the light guide plate 32 may be formed on a front surface of the rear supporter 363. The plurality of supporter protrusions 363*a* may be formed along the rear supporter 363, and a protruding front surface of the supporter protrusion 363*a* may support the light guide plate 32 from the rear.

A supporter groove 363*b* may be formed on a rear surface of the rear supporter 363 corresponding to the supporter protrusion 363*a*. Due to the supporter groove 363*b*, when the lower bracket 36 is injection-molded, the front surface of the supporter protrusion 363*a* may be molded into a flat shape that is to be closely attached to the rear surface of the light guide plate 32 without shrinking.

The lower bracket 36 may be positioned on the lower end of the door panel 30 in the state in which the door panel 30 is assembled. In this case, the lower bracket 36 may be inserted and fixedly fixed between the bent edge 393 and the lower spacer 362. The light guide plate 32 may be inserted and fixed between the lower spacer 362 and the rear supporter 363.

A lower end protrusion 364 and a lower end accommodator 365 may be formed on a lower end of the lower bracket 36. The lower end protrusion 364 may be formed at a position corresponding to the first top support 361*a* and may be formed at an opposite surface to the first top support 361*a*. The lower end protrusion 364 may form the most protruding lower surface of the lower bracket 36 and may be in contact with the edge 393 of the out frame 39 in the state in which the lower bracket 36 is mounted. In this case, the front end of the lower bracket 36 may be in contact with the bent corner part of the out frame 39 to fix the lower bracket 36.

The lower end accommodator 365 may be stepped at a rear end of the lower end protrusion 364. The lower end accommodator 365 may be formed at a higher position than the lower end protrusion 364 and may extend to a rear end of a lower surface of the lower bracket 36. The lower end accommodator 365 may be formed at a position corresponding to the second top support 361*b* and may be formed on an opposite surface to the second top support 361*b*.

The stepped height of the lower end accommodator 365 may correspond to the thickness of the cover edge 333 of the back cover 33. The lower end accommodator 365 may be formed with a shape corresponding to a shape of a lower surface of the cover edge 333.

That is, both ends of a lower surface of the cover edge 333 may be inclined, and the lower end accommodator 365 may be formed with a shape corresponding thereto. Thus, when the cover edge 333 is coupled to the lower end accommodator 365, the lower bracket 36 may be positioned at an exact position of the lower end of the door panel 30.

In the state in which the cover edge 333 is accommodated on the lower end accommodator 365, the lower surface of the cover edge 333 may be positioned on the same plane as the lower end protrusion 364, and the lower end protrusion 364 and the cover edge 333 may be in close contact with the edge 393 of the out frame 39.

Adhesives may be coated on a lower surface of the lower bracket 36, that is, at least one of the lower end protrusion 364 or the lower end accommodator 365 to firmly fix the lower bracket 36 to the back cover 33 and the out frame 39.

Figure 19:
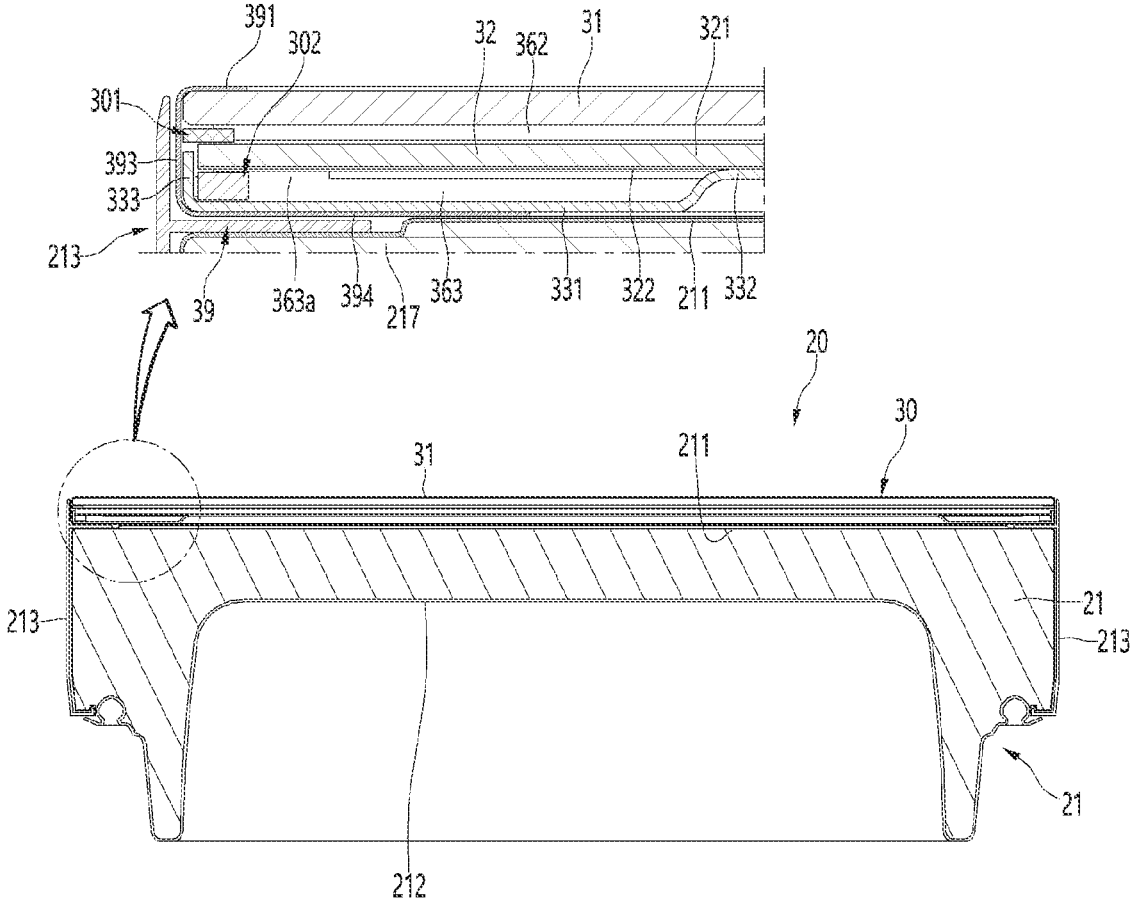
FIG. 19 is an exploded perspective view taken along XIX-XIX' of FIG. 3.

FIG. 19 is an exploded perspective view taken along XIX-XIX' of FIG. 3.

As shown in the drawing, in the state in which the door panel 30 is assembled, a front perimeter of the front plate 31 may be restrained by being in close contact with the front surface part 391 of the out frame 39, and a rear surface perimeter of the back cover 33 may be restrained by being in close contact with the rear surface part 394 of the out frame 39.

In this case, the front spacer 301 may be disposed between both ends of the front plate 31 and the light guide plate 32, and the rear spacer 302 may be disposed between the guide plate 32 and the back cover 33, maintaining a predetermined interval between the front plate 31 and the light guide plate 32.

In particular, right and left side ends of the light guide plate 32 may be supported by the front spacer 301 and the rear spacer 302, and upper and lower ends of the light guide plate 32 may be respectively supported by the upper spacer 342*b* and the lower spacer 362 to maintain an exact position. Thus, even if the door 20 is repeatedly opened and closed and impact is supplied thereto, the light guide plate 32 may be maintained at an original mounting position, and light emitted from the light source 352 may be accurately emitted toward an end of the light guide plate 32.

When the door 20 has a large size, the size of the light guide plate 32 may be large, and in this state, when only a peripheral surface of the light guide plate 32 is supported, there may be a problem in that the light guide plate 32 is bent or deformed, but a central portion of the rear surface of the light guide plate 32 may be supported by the cover protrusion 332 formed on the back cover 33, thereby preventing the light guide plate 32 from being deformed. The cover protrusion 332 may evenly support most of the remaining parts except for the perimeter of the light guide plate 32 to stably support the light guide plate 32.

The front plate 31 and the back cover 33 may be firmly fixed by installing the out frame 39, and the upper bracket 34 and the lower bracket 36 inside the door panel 30 may be firmly fixed.

Hereinafter, the out frame 39 will be described in more detail with reference to the drawings.

Figure 20:
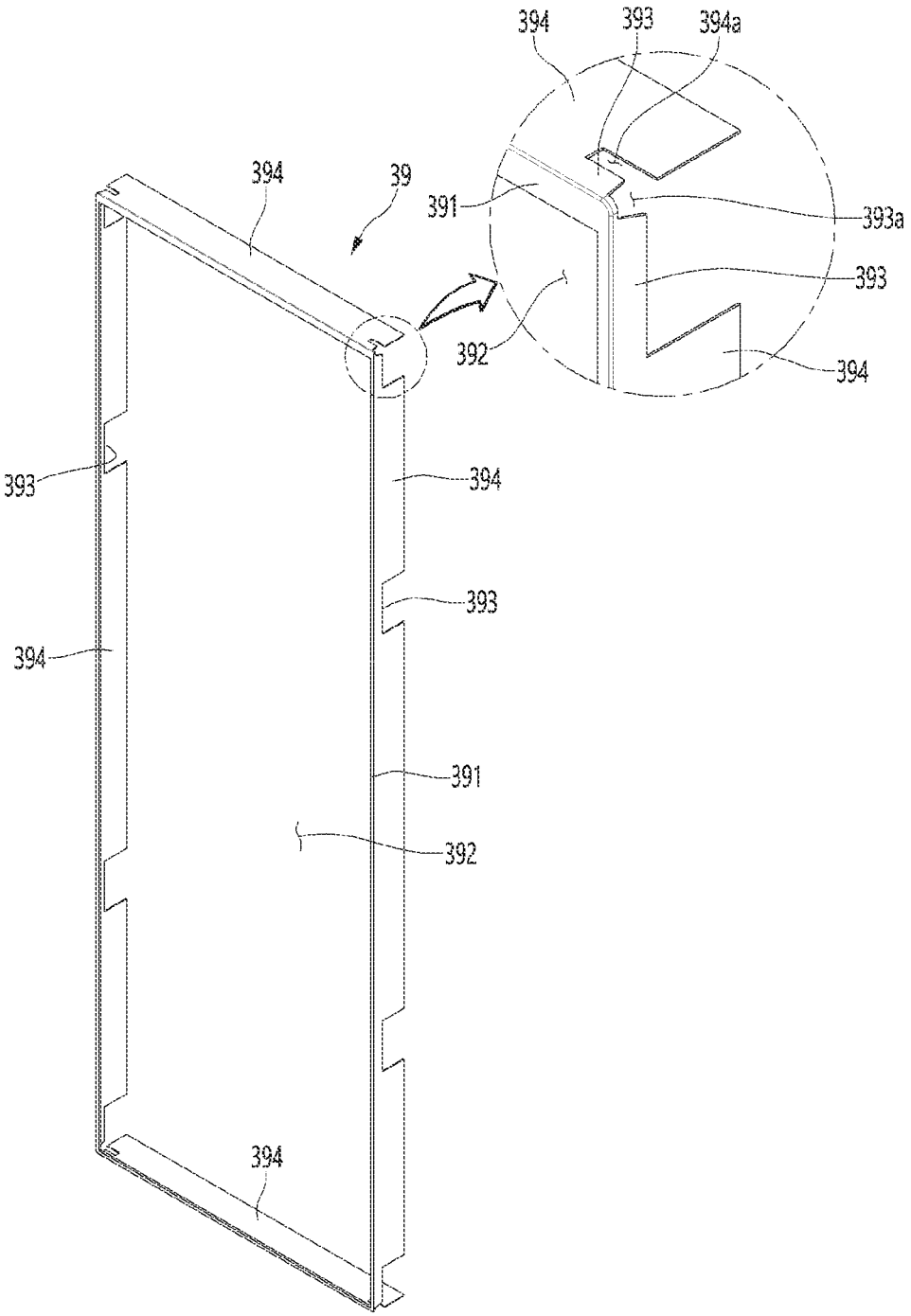
FIG. 20 is a perspective view of an out frame before molding is completed, viewed from the front.
Figure 21:
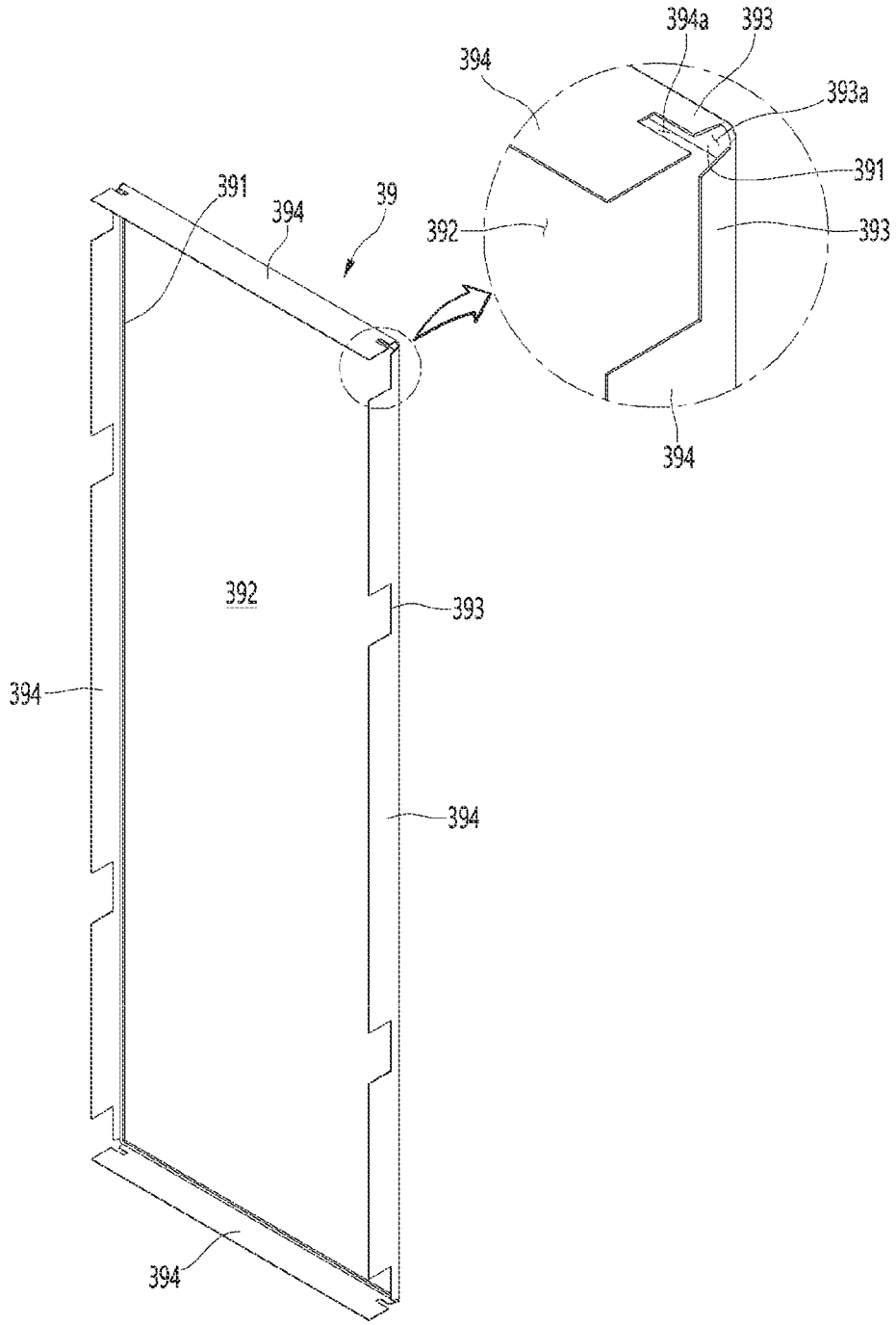
FIG. 21 is a perspective view of an out frame before molding is completed, viewed from the rear.
Figure 22:
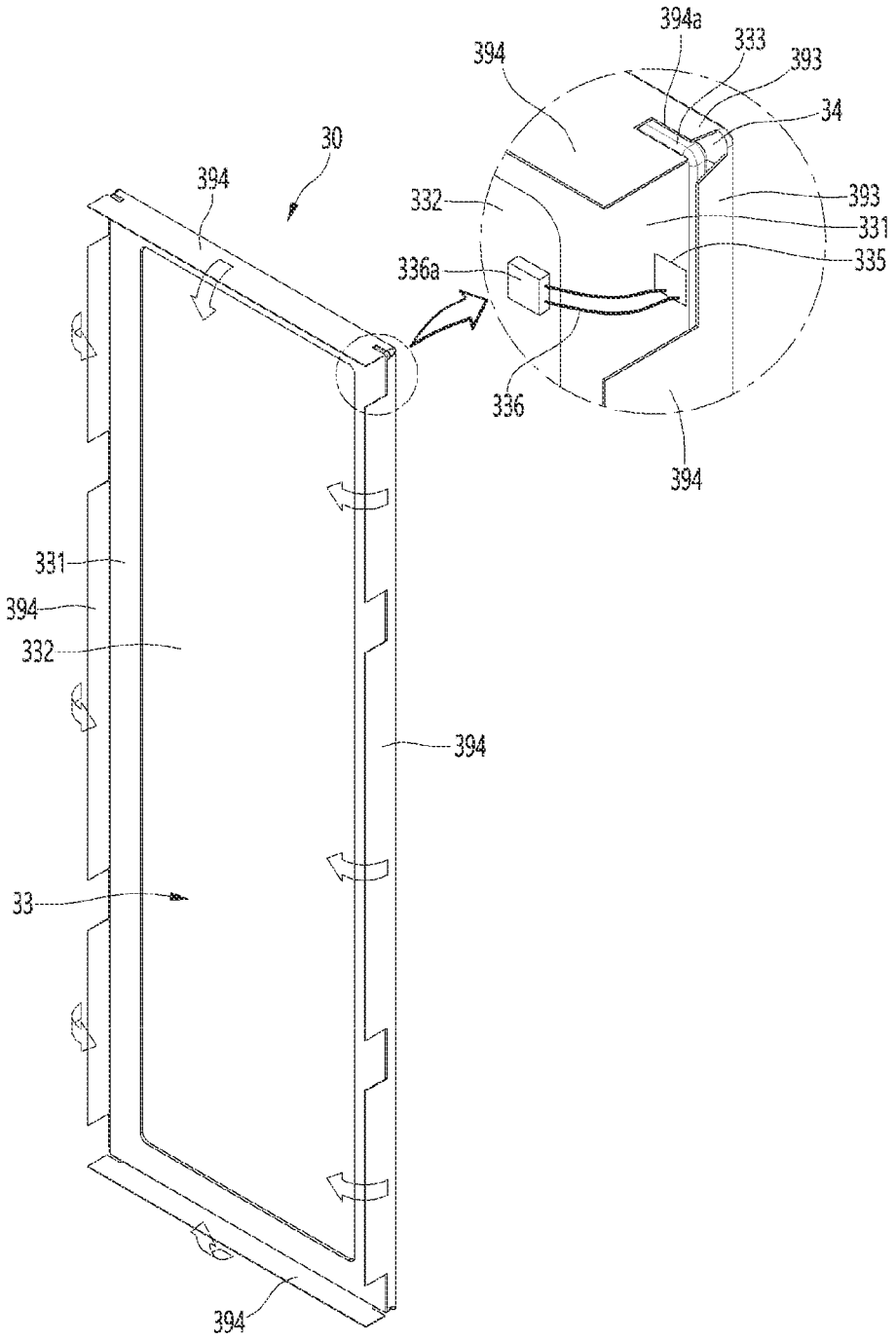
FIG. 22 is a perspective view of the state before the out frame is bent in the state in which the out frame is disposed on the door panel.
Figure 23:
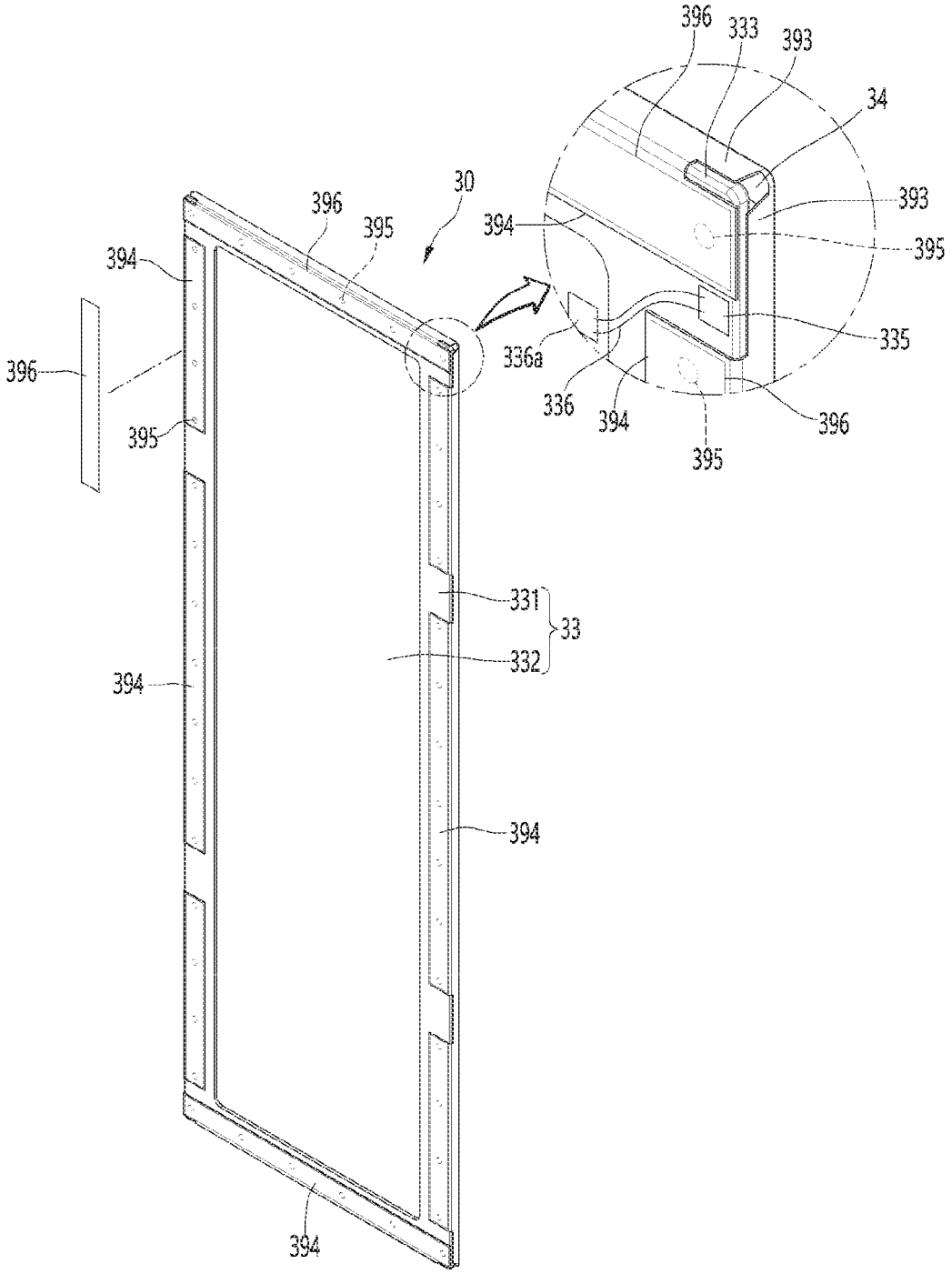
FIG. 23 is a perspective view of the state in which bending and coupling of the out frame is completed in the state in which the out frame is disposed on the door panel.

FIG. 20 is a perspective view of an out frame before molding is completed, viewed from the front. FIG. 21 is a perspective view of an out frame before molding is completed, viewed from the rear. FIG. 22 is a perspective view of the state before the out frame is bent in the state in which the out frame is disposed on the door panel. FIG. 23 is a perspective view of the state in which bending and coupling of the out frame is completed in the state in which the out frame is disposed on the door panel.

As shown in the drawings, a perimeter of the door panel 30 may be formed by the out frame 39. The out frame 39 may be formed of a bendable plate-shaped material, for example, may be formed of a metal material such as stainless or aluminum.

The out frame 39 may be formed of an initial plate-shaped material and may be formed to be bent multiple times to form upper and lower surfaces of the door panel 30 and the perimeters on right and left side surfaces of the door panel 30. The out frame 39 may form the outer appearance of a perimeter of the door panel 30, and simultaneously may restrain the front plate 31 and the back cover 33 to maintain the overall coupling structure of the door panel 30.

In detail, the opening 392 for exposing the front plate 31 forward may be formed in a central part of the out frame 39. The opening 392 may be formed with a smaller size than the front plate 31. Thus, in the state in which the door panel 30 is assembled, the front plate 31 may be exposed forward through the opening 392, and a perimeter of the front plate 31 may be hidden by the out frame 39.

In detail, the out frame 39 may include the front surface part 391, the edge 393, and the rear surface part 394, and the front surface part 391, the edge 393, and the rear surface part 394 may be formed by bending the out frame 39 shaped like a plate.

The front surface part 391 may shield a front perimeter of the front plate 31, and may form a front perimeter of the door panel 30. The opening 392 may be formed inside the front surface part 391.

The edge 393 may be bent backward from the outer end of the front surface part 391. The edge 393 may be bent perpendicularly to the front surface part 391 and may form a side perimeter of the door panel 30. The edge 393 may be formed with a width corresponding to the thickness of the door panel 30.

The edge 393 may form a perimeter of the door panel 30, that is, right and left side surfaces and upper and lower surfaces. An edge cut part 393*a* may be formed in a corner region of the edge 393. Bending molding of the edge 393 may be facilitated by the edge cut part 393*a*, and interference between the right and left side surfaces of the edge 393 and the upper and lower surfaces in a bending process of the edge 393 can be prevented. In addition, interference with components included in the door panel 30 during an assembly process of the door panel 30 may be prevented.

The rear surface part 394 may be molded with the edge 393 and may extend on the edge 393. As shown in FIGS. 20 to 22, the rear surface part 394 may extend in the same direction as an extension direction of the edge 393 before the door panel 30 is assembled. Thus, in order to assemble the door panel 30, the front plate 31, the light guide plate 32, and the back cover 33 may be inserted and mounted from the rear of the out frame 39.

Rear surface cut parts 394*a* recessed inward may be formed at both ends of the rear surface part 394. A boundary between the rear surface part 394 and the edge 393 may be divided by the rear surface cut part 394*a*, and bending of the rear surface part 394 may be facilitated. When the rear surface part 394 is bent, the rear surface cut part 394*a* may be disposed on a corner part between the cover perimeter part 331 and the cover edge 333 of the back cover 33, and an end of the edge 393 may be formed to surround an corner part between the cover perimeter part 331 and the cover edge 333.

As shown in FIG. 22, the rear surface part 394 may be bent in the state in which all components included in the door panel 30 are disposed. The rear surface part 394 may include a bent part of an upper surface of the edge 393, a bent part of a lower surface of the edge 393, and a bent part of right and left side surfaces of the edge 393. In this case, the rear surface part 394 may be formed with a smaller length than upper and lower surfaces or right and left side surfaces of the edge 393. That is, the rear surface part 394 may be formed on a portion of the edge 393.

The rear surface part 394 may be formed with a predetermined width, and when being bent, the rear surface part 394 may be in contact with the cover perimeter part 331 of the back cover 33 and may be formed with a width that does not interfere with the cover protrusion 332.

The rear surface part 394 may be perpendicularly bent into the door panel 30 based on the edge 393. The rear surface part 394 may be bent in parallel to the rear surface of the back cover 33, and in the state in which the rear surface part 394 is bent, the rear surface part 394 and the cover perimeter part 331 may be formed to surface-contact each other.

The rear surface part 394 may extend on upper and lower surfaces and right and left side surfaces of the out frame 39. A portion of the rear surface part 394, which is formed on upper and lower surfaces of the out frame 39, may be formed with a single structure, and a plurality of relatively long portions of the rear surface part 394, which are formed on right and left side surfaces of the out frame 39, may be spaced apart from each other in a length direction.

The rear surface part 394 may be perpendicularly bent to cause the door panel 30 to have a firm coupling structure, and may be in close contact with the back cover 33. As shown in FIG. 23, the rear surface part 394 may be firmly fixed to the back cover 33 via spot welding.

A bonding part 395 on which spot welding is performed may be formed over a plurality of parts in a length direction of the rear surface part 394, and the rear surface part 394 bent from upper and lower surfaces and right and left side surfaces of the out frame 39 may entirely have a firm coupling structure with the back cover 33.

Thus, the out frame 39 may be fixed by the bonding part 395 along the perimeter of the back cover 33, and the door panel 30 may be configured in a slim form without using a separate fastening member and coupling structure.

The door panel 30 may be mounted on the door body 21. An adhesive member 396 for being mounted on the door body 21 may be disposed on a rear surface of the door panel 30. For example, the adhesive member 396 may be formed in the form of sheet such as a double-side tape, and may be disposed on the bent rear surface part 394. The adhesive member 396 may be formed to shield the bonding part 395 of the rear surface.

The adhesive member 396 may cause the rear surface perimeter of the door panel 30 and the front surface of the door body 21 to be in close contact with each other, and as shown in FIG. 4, the door panel 30 may be firmly fixed to the open front surface of the door body 21 in the state of being inserted thereinto. In this case, the perimeter of the door panel 30 may be supported by the upper cap deco 214, the lower cap deco 215, and the side deco 213 to be maintained in a more stable and firm mounting state.

Hereinafter, an operation in which the door panel 30 emits light will be described in detail with reference to the drawings.

Figure 24:
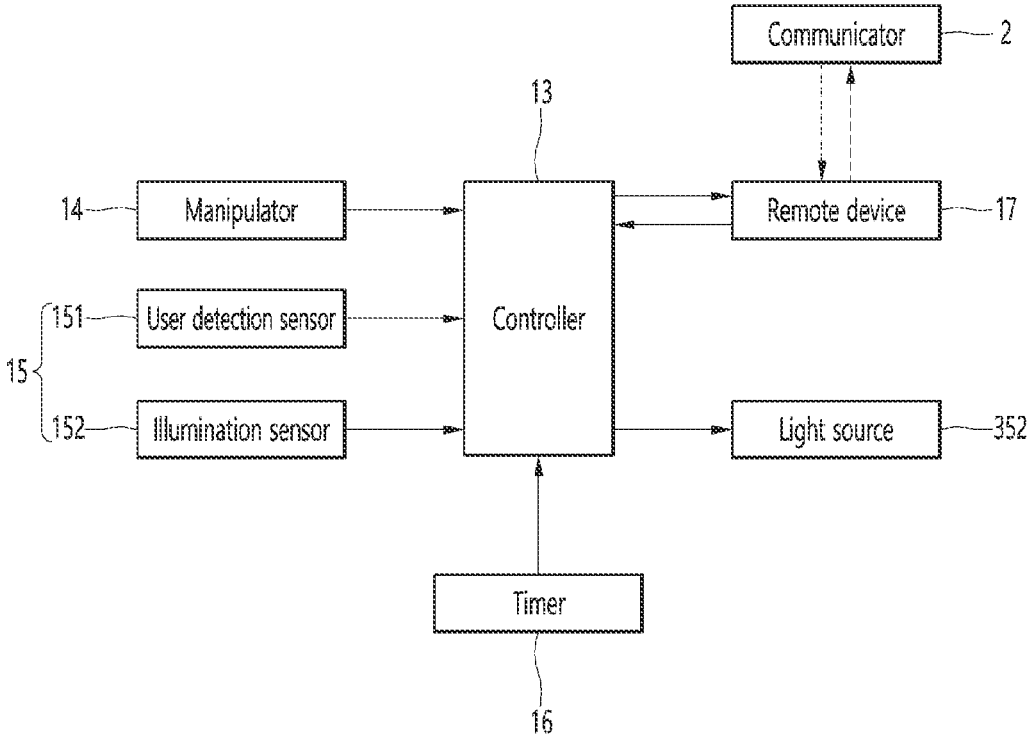
FIG. 24 is a block diagram showing a control signal flow of the refrigerator.
Figure 25:
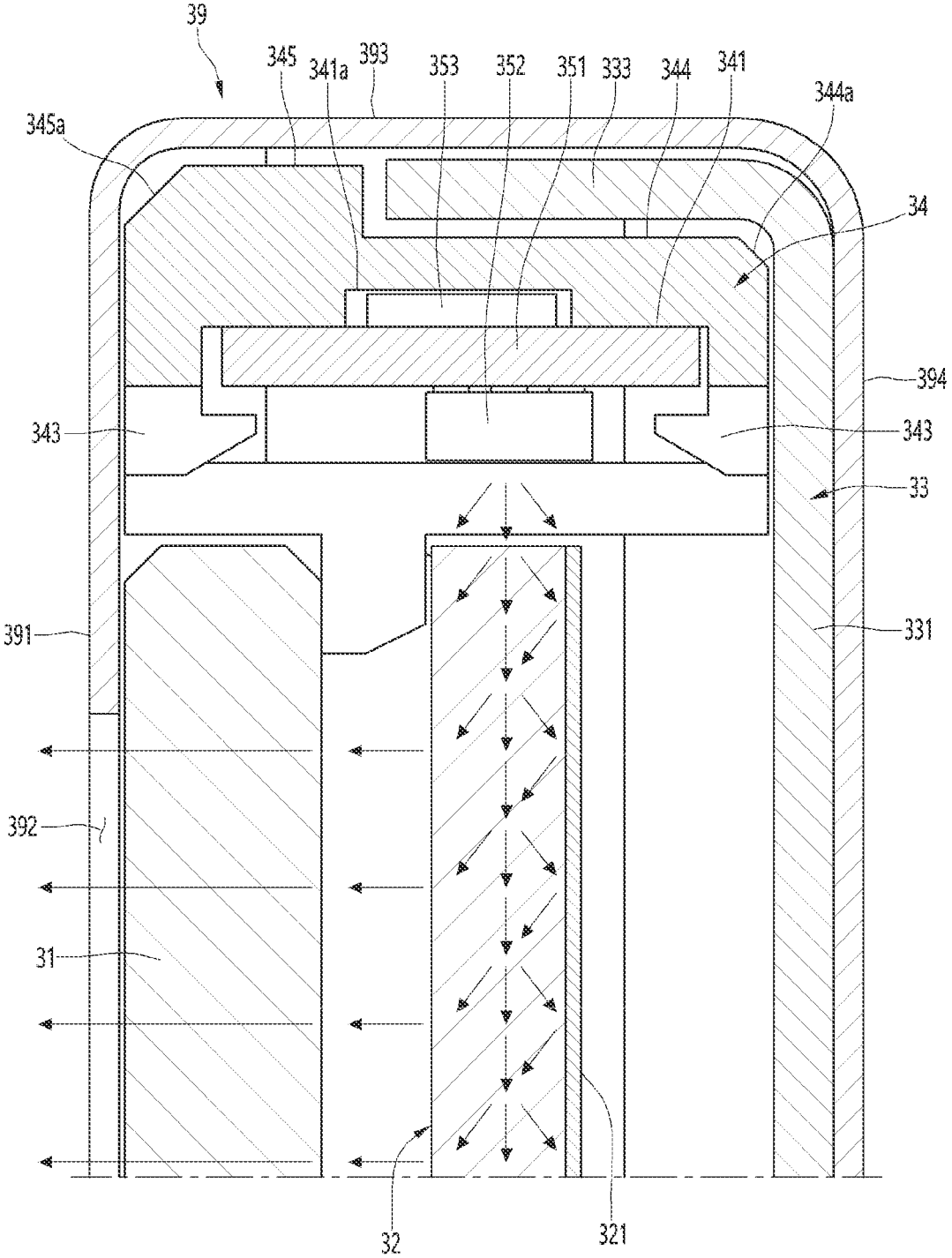
FIG. 25 is a cross-sectional view showing an operation state of the lighting device.
Figure 26:
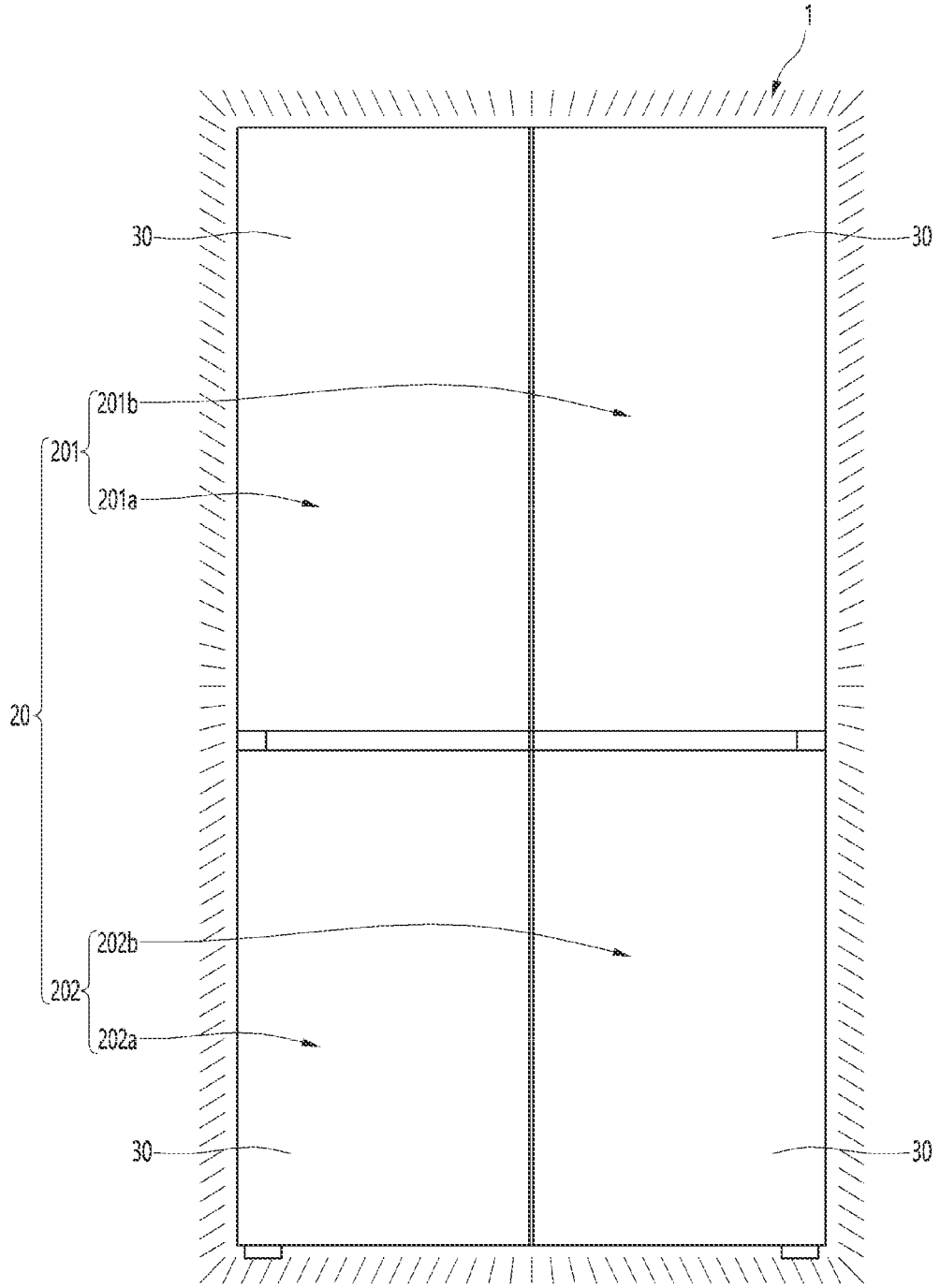
FIG. 26 is a diagram showing the state in which the door panel emits light.

FIG. 24 is a block diagram showing a control signal flow of the refrigerator. FIG. 25 is a cross-sectional view showing an operation state of the lighting device. FIG. 26 is a diagram showing the state in which the door panel emits light.

As shown in the drawings, in the refrigerator 1 according to an embodiment of the present disclosure, a front surface of the door 20 may glow via an operation of the lighting device 35. The front surface of the door 20 may glow with specific color.

The operation of the lighting device 35 may be performed via manipulation of a manipulator 14 of a user. The operation may be performed by directly manipulating the manipulator 14 disposed at one side of the refrigerator 1 by the user. That is, the user may manipulate the manipulator 14 to turn on or off the lighting device 35.

For example, the manipulator 14 may be disposed inside the front surface upper end or the storage space of the cabinet 10. As necessary, the manipulator 14 may be disposed on any one of the plurality of doors 20. Needless to say, the user may set the overall operation state of the lighting device 35, such as an operation time and an operation condition of the lighting device 35 and emission color of the light source 352 through manipulation of the manipulator 14. The manipulator 14 may be configured as a display for information display and manipulation.

The lighting device 35 may also be manipulated and set through a remote device 2 spaced apart from the refrigerator 1. The refrigerator 1 may communicate with the remote device 2 through a communicator 17 connected to a controller 13, and the user may manipulate an operation of the lighting device 35 through the remote device 2. The communicator 17 may communicate with the remote device 2 using various methods such as wired, wireless, or short distance communication (Bluetooth, Wi-Fi, Zigbee, and NFC). The remote device 2 may be various devices that are capable of communicating, such as a dedicated terminal, a mobile phone, a tablet, a portable PC, a desktop PC, and a remote control.

The user may manipulate and set the overall operation state of the lighting device 35, such as an operation time and an operation condition of the lighting device 35 and emission color through manipulation of the remote device 2. For example, the light device 35 may be simply manipulated and set through an application or a dedicated program installed in a portable phone of the user.

The lighting device 35 may also be operated by a sensor 15. The sensor 15 may be, for example, a user detection sensor 151 for detecting proximity of the user. For example, the user detection sensor 151 may use various devices for detecting user approaching near the refrigerator, such as an infrared sensor, an ultrasonic sensor, or a laser sensor.

The sensors 15 may be disposed at various positions for detecting proximity of the user, such as one side of the door 20, one side of the cabinet 10 between the left door 20 and the right door 20, one side of a recessed space between the refrigerating compartment door 201 and the freezing compartment door 202, one side of the handle 203, or one side of a hinge device 204 installed at upper and lower ends of the door 20 and on which the door 20 is rotatably installed, and a plurality of sensors may be disposed at different positions.

Thus, when the user approaches the refrigerator 1 by a set distance for use of the refrigerator 1, the user detection sensor 151 may detect this and may transfer a signal to the controller 13 to turn on the lighting device 35. When the user moves away from the refrigerator 1, the user detection sensor 151 may detect this and may transfer a signal to the controller 13 to turn off the lighting device 35.

When the lighting device 35 is turned on, light emitted from the light source 352 may be emitted to an upper end of the light guide plate 32 and may be diffused and reflected along the light guide plate 32. Light guided by the light guide plate 32 may be reflected forward by the reflective layer 321 and may be transmitted to the outside through the front plate 31. Thus, the entire front plate 31 may glow brightly, and a front surfaced of the door 20 may glow with set brightness or color.

The lighting device 35 may be disposed on an upper end of the door 20, and the light source 352 may emit light downward. Thus, when the user sees from the front of the refrigerator 1, the lighting device 35 may be positioned at a higher position than the user's line of sight, and thus the lighting device 35 may not be exposed directly to the user, thereby preventing glare of the user.

In the state in which the lighting device 35 is turned on and the front surface of the door 20 glows brightly, when the user detection sensor 151 detects that the user is very close to the refrigerator 1, the lighting device 35 may be turned off or the brightness may be gradually dimmed to prevent glare of the user. When the user moves away from the refrigerator 1 again, the lighting device 35 may be turned on again or may return to an original brightness.

The sensor 15 may be an illumination sensor 152. The illumination sensor 152 may detect illumination of an indoor space and may be disposed at the same position as a position at which the user detection sensor 151 is disposed.

The lighting device 35 may be operated according to a detected illumination of the illumination sensor 152. For example, when the detected illumination of the illumination sensor 152 is equal to or less than a set illumination and the lighting device 35 is dimmed, the controller 13 may turn on the lighting device 35, and when the detected illumination of the illumination sensor 152 is equal to or greater than the set illumination and the lighting device 35 becomes brighter, the controller 13 may turn off the lighting device 35.

The sensor 15 may include both the illumination sensor 152 and the user detection sensor 151, and the illumination sensor 152 and the user detection sensor 151 may be operated in a complex way to cause the controller 13 to turn off the lighting device 35.

For example, in the state in which the illumination sensor 152 is detected to be equal to or greater than the set illumination, the lighting device 35 may be maintained in an off state irrespective of whether the user detection sensor 151 detects this. In the state in which the illumination sensor 152 is detected to be equal to or less than the set illumination, when the user detection sensor 151 detects proximity of the user, the lighting device 35 may be turned on.

The lighting device 35 may be turned off at a time set by a timer 16. That is, the lighting device 35 may be turned on according to a time when the user is mainly active and may be maintained off outside a set time range. In addition, the lighting device 35 may be turned off during the day and on during night irrespective of actual illumination.

The lighting device 35 may include the state in which brightness is adjustable in addition to an on state and an off state. That is, according to an operation state of the refrigerator 1, the controller 13 may vary the brightness of the lighting device 35 to adjust an operation state of the refrigerator 1. Irrespective of an operation state of the refrigerator 1, the brightness and color of the front surface of the door 20 may be adjusted according to user settings.

When an on signal of the lighting device 35 is input to the controller 13, the light source 352 of the lighting device 35 may emit light. Light emitted from the light source 352 may be emitted to an end of the light guide plate 32 positioned vertically downward.

Light emitted to the end of the light guide plate 32 may be diffused along the light guide plate 32 and may be emitted from an entire region of the light guide plate 32. When light diffused by the light guide plate 32 is entirely reflected by the reflective layer 321 disposed behind the light guide plate 32 and may proceed toward the front plate 31. While light is emitted through the front plate 31, the front plate 31 may entirely glow.

In this case, some of the plurality of light sources 352 may also be turned on. For example, the light sources 352 having specific color set by the user among the plurality of light sources 352 may be turned on. Thus, the front surface of the door 20, that is, the front plate 31 may glow with specific color, and the front appearance of the refrigerator 1 may glow with specific color. The plurality of lighting devices 35 disposed in the door 20 may be simultaneously turned on to cause the door 20 of the refrigerator 1 to entirely glow brightly.

For example, as shown in FIG. 26, when the blue light source 352*c* of the light source 352 of the lighting device 35 is turned on, blue light may be emitted through the front surface of the front plate 31, and the front surface of the door 20, that is, the front appearance of the refrigerator 1 may have blue color.

Figure 27:
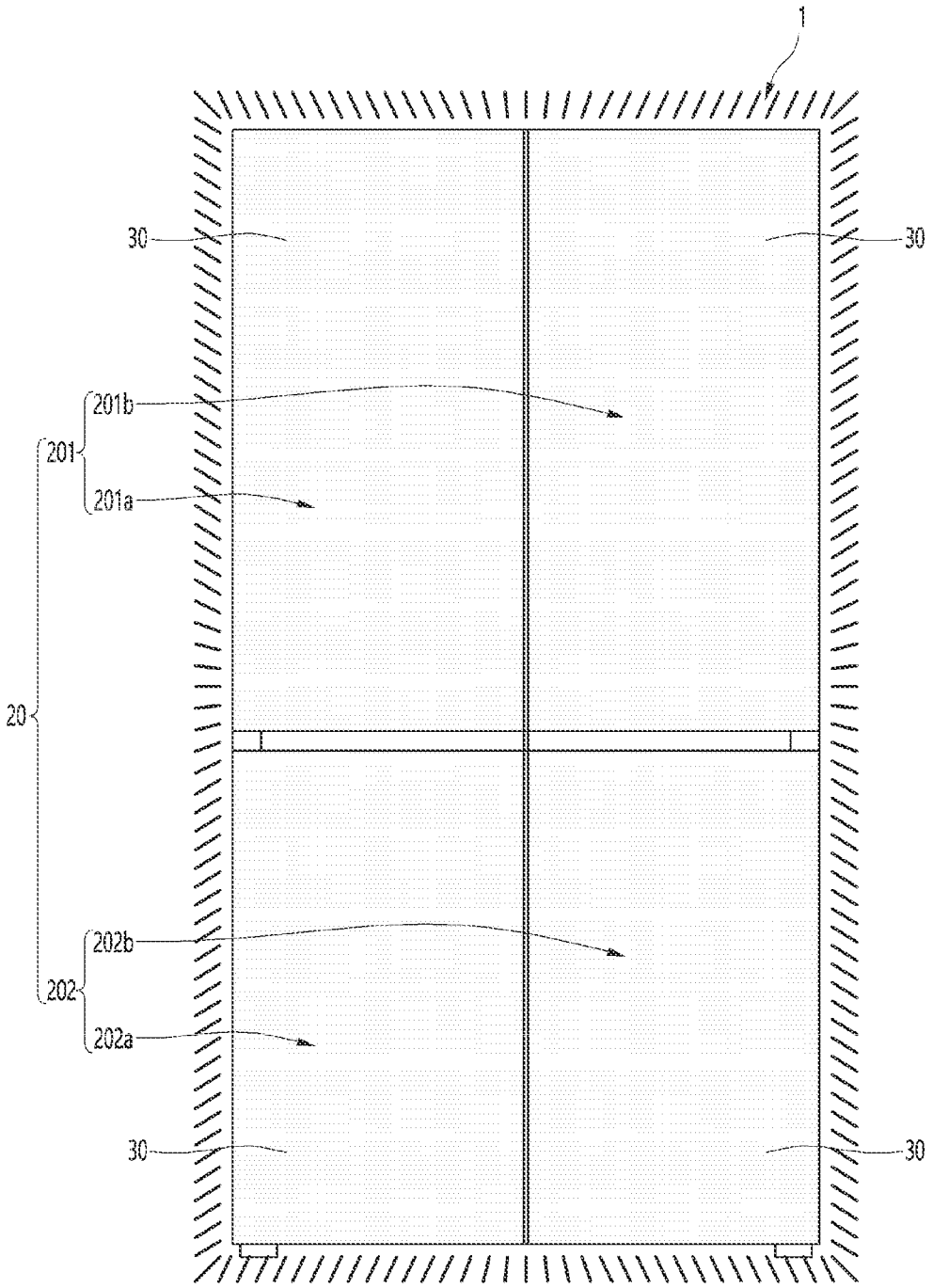
FIG. 27 is a diagram showing the state in which the door panel emits light with different colors.

FIG. 27 is a diagram showing the state in which the door panel emits light with different colors.

As shown in the drawings, when the red light source 352*a* of the light source 352 of the lighting device 35 is turned on, red light may be emitted through the front surface of the front plate 31, the front surface of the door, that is, the front appearance of the refrigerator 1 may have red color.

Needless to say, as necessary, the light sources 352 having different colors among the light sources 352 of the lighting device 35 may be combined and turned on, and all the light sources 352 may be turned on to cause the door panel 30 to glow to the maximum brightness.

Figure 28:
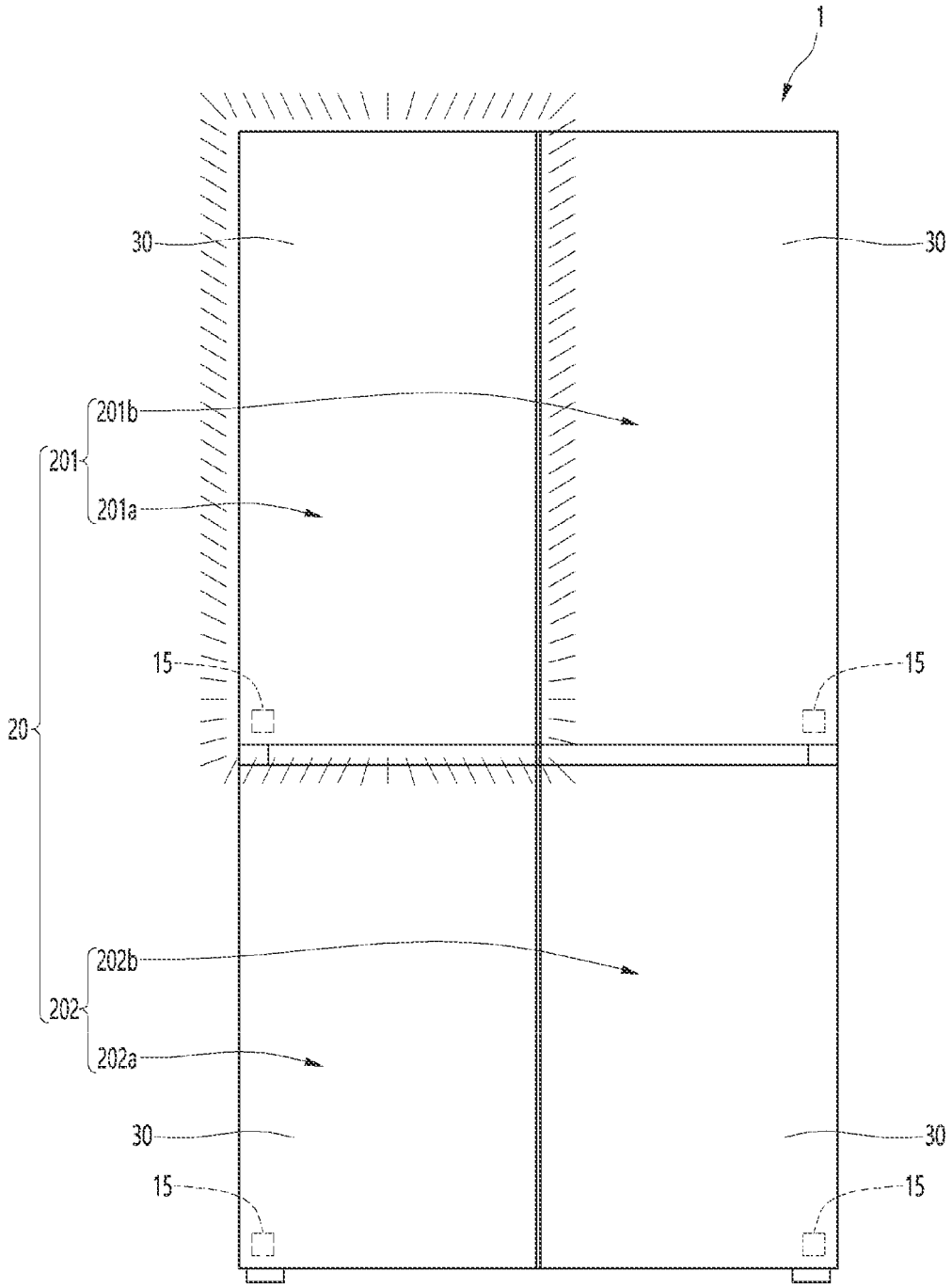
FIG. 28 is a diagram showing the state in which a door panel of some of a plurality of doors glows.

FIG. 28 is a diagram showing the state in which a door panel of some of a plurality of doors glows.

As shown in the drawing, the refrigerator 1 may be operated to cause some doors 20 of a plurality of doors to glow or glow with specific color. That is, all the lighting devices 35 included in the doors 20 may not be operated, but instead, only some of all the doors 20 may glow. For example, any one of the refrigerating compartment door 201 and the freezing compartment door 202 may glow. The left refrigerating compartment door 201*a* among the left refrigerating compartment door 201*a* and the right refrigerating compartment door 201*b* may glow.

In detail, the sensors 15 may be provided on right and left sides of the refrigerator 1, respectively, and may detect proximity of the user. In addition, the sensors 15 may make the door 20 at one side, which the user approaches, glow brightly. Thus, when the user approaches the sensor 15 disposed on the left, the controller 13 may operate the lighting device 35 included in the left refrigerating compartment door 201*a*, and thus the front surface of the door panel 30 constituting the front surface of the left refrigerating compartment door 201*a* may glow brightly or may glow with specific color.

The state in which the front surface of some of the plurality of doors 20 emits light may not be determined by the sensor 15, and instead, some of the plurality of doors 20 may glow brightly for various reasons such as an operation state of the refrigerator 1 or user settings.

In contrast, in a situation in which the entire refrigerator 1 glows brightly, the lighting device 35 provided in a specific door that the user approaches may be dimmed or may be turned off. For example, when the user approaches the refrigerator 1 to open the left refrigerating compartment door 201*a*, the sensor 15 may detect this and may make the lighting device 35 provided in the left refrigerating compartment door 201*a* be dimmed or turned off. Thus, the front surface of the left refrigerating compartment door 201*a* may be dimmed to prevent glare of the user.

Needless to say, some of the doors 20 may not include the lighting device 35, and the lighting device 35 provided in some of the remaining doors 20 may be turned on/off to adjust the brightness and color of front surfaces of some of the doors 20.

In the state in which all the doors 20 emit light, it may be possible to differently change the brightness of some of the doors 20 or to differently change the color thereof.

Figure 29:
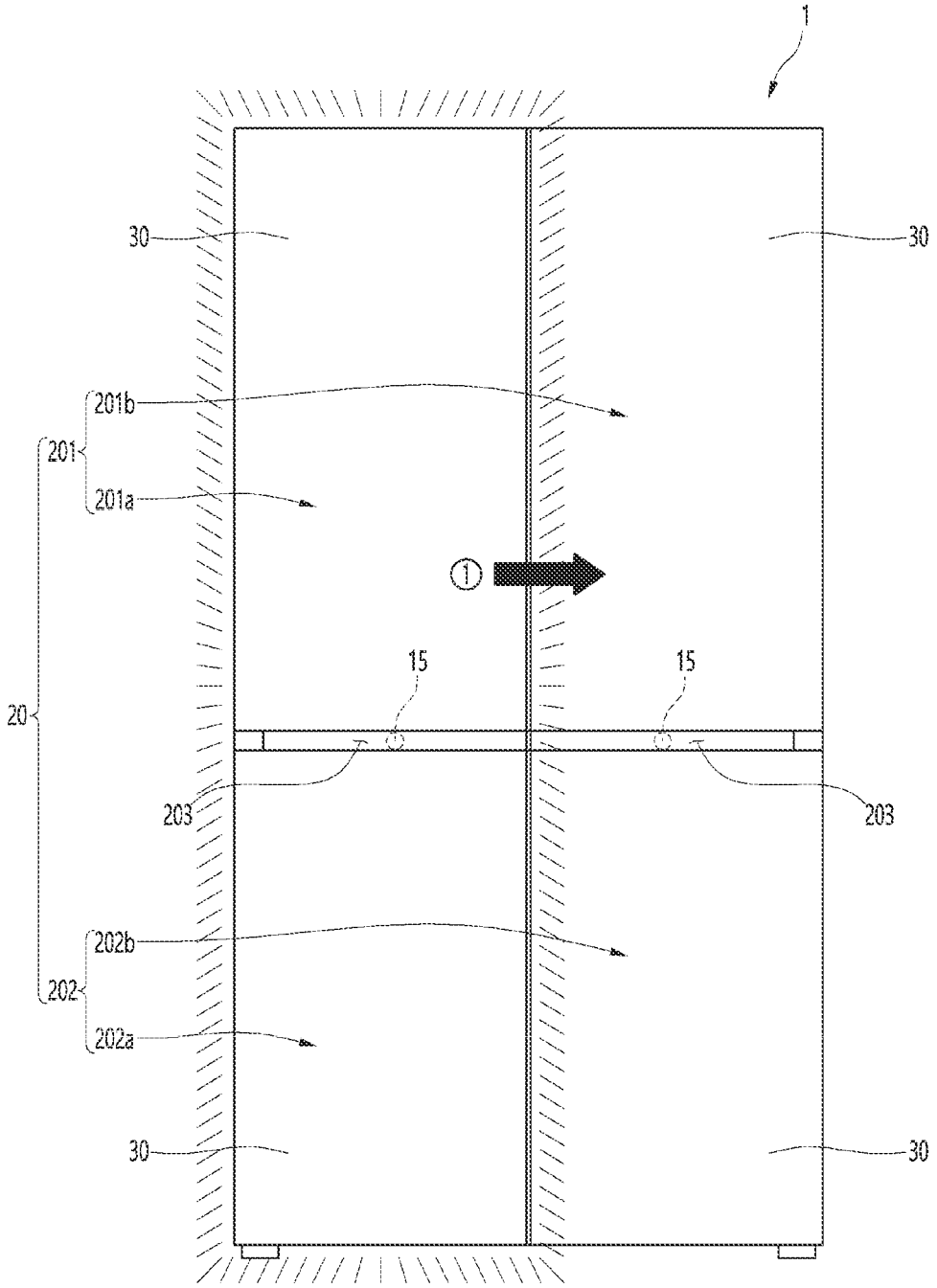
FIGS. 29 and 30 are diagrams showing a state change of a door panel according to user movement.
Figure 30:
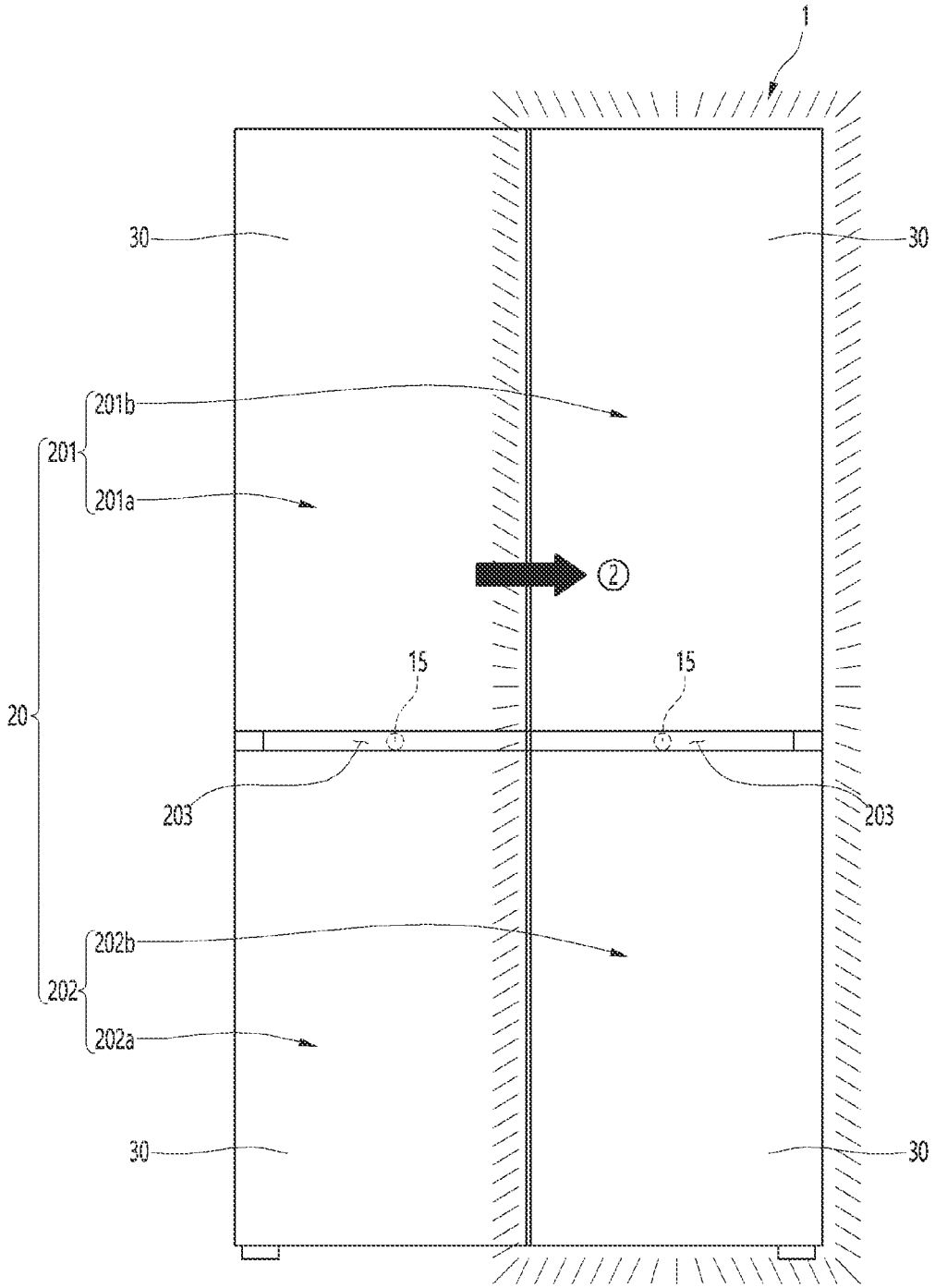

FIGS. 29 and 30 are diagrams showing a state change of a door panel according to user movement.

As shown in the drawings, the plurality of doors 20 of the refrigerator may be configured in such a way that front surfaces of the plurality of doors 20 sequentially glow as necessary. That is, ta front surface of the door 20 at one side may first glow and then the door 20 at another side may glow. When front surfaces of all doors 20 provided on the refrigerator 1 glow, the door 20 at one side may glow brighter and then the door 20 at another side may sequentially glow brighter.

For example, the sensors 15 for detecting proximity of the user may be provided on right and left sides of the refrigerator 1. Thus, the sensors 15 may detect a direction in which the user approaches the refrigerator 1.

As shown in FIG. 29, when the user approaches from the left side of the refrigerator 1, the sensor 15 provided at the left side of the refrigerator 1 may detect proximity of the user. As the user approaches from the left, the controller 13 may turn on the door 20 on the left, that is, the lighting devices 35 of the left refrigerating compartment door 201*a* and the left freezing compartment door 202*a* and may make front surfaces of the left refrigerating compartment door 201*a* and the left freezing compartment door 202*a* glow brightly. That is, the left side of the entire surface of the refrigerator 1 may glow. In this case, the right refrigerating compartment door 201*b* and the right freezing compartment door 202*b* may be turned off or may be relatively dark.

As shown in FIG. 30, when the user moves to the right side of the refrigerator 1 by continuous movement, the sensor 15 provided on the right side of the refrigerator 1 may detect proximity of the user. As the user approaches from the right, the controller 13 may turn on the door 20 on the right, that is, the lighting devices 35 of the right refrigerating compartment door 201*b* and the right freezing compartment door 202*b* and may make front surfaces of the right refrigerating compartment door 201*b* and the right freezing compartment door 202*b* glow brightly. That is, the left refrigerating compartment door 201*a* and the left freezing compartment door 202*a* may be turned off or may be relatively dark.

The plurality of doors 20 of the refrigerator may sequentially brighten or change color of the front surface using various methods in addition to proximity of the user. For example, the front surfaces of the plurality of doors 20 may be sequentially brightened or may be changed in color according to a time or lighting pattern set by the user through the remote device 2 or the manipulator 14.

Although FIGS. 29 and 30 illustrate that an order of the door 20 lit from left to right is changed, the order of the door 20 lit from the upper to the lower may be changed, and the door 20 may be controlled to irregularly and arbitrarily light the door 20 or change the door 20 in color.

The refrigerator 1 according to the embodiment of the present disclosure may have various other embodiments other than the aforementioned embodiment.

According to another embodiment of the present disclosure, a lighting device may be provided at a lower end of a door panel. Thus, another embodiment of the present disclosure may be the same as the aforementioned embodiment in terms of components except for some components of upper and lower ends of the door panel. In addition, a description of the same component as the aforementioned embodiment is omitted, and unexplained reference numerals in the drawings may refer to the aforementioned embodiment.

Hereinafter, other embodiments of the present disclosure will be described in detail with reference to drawings.

Figure 31:
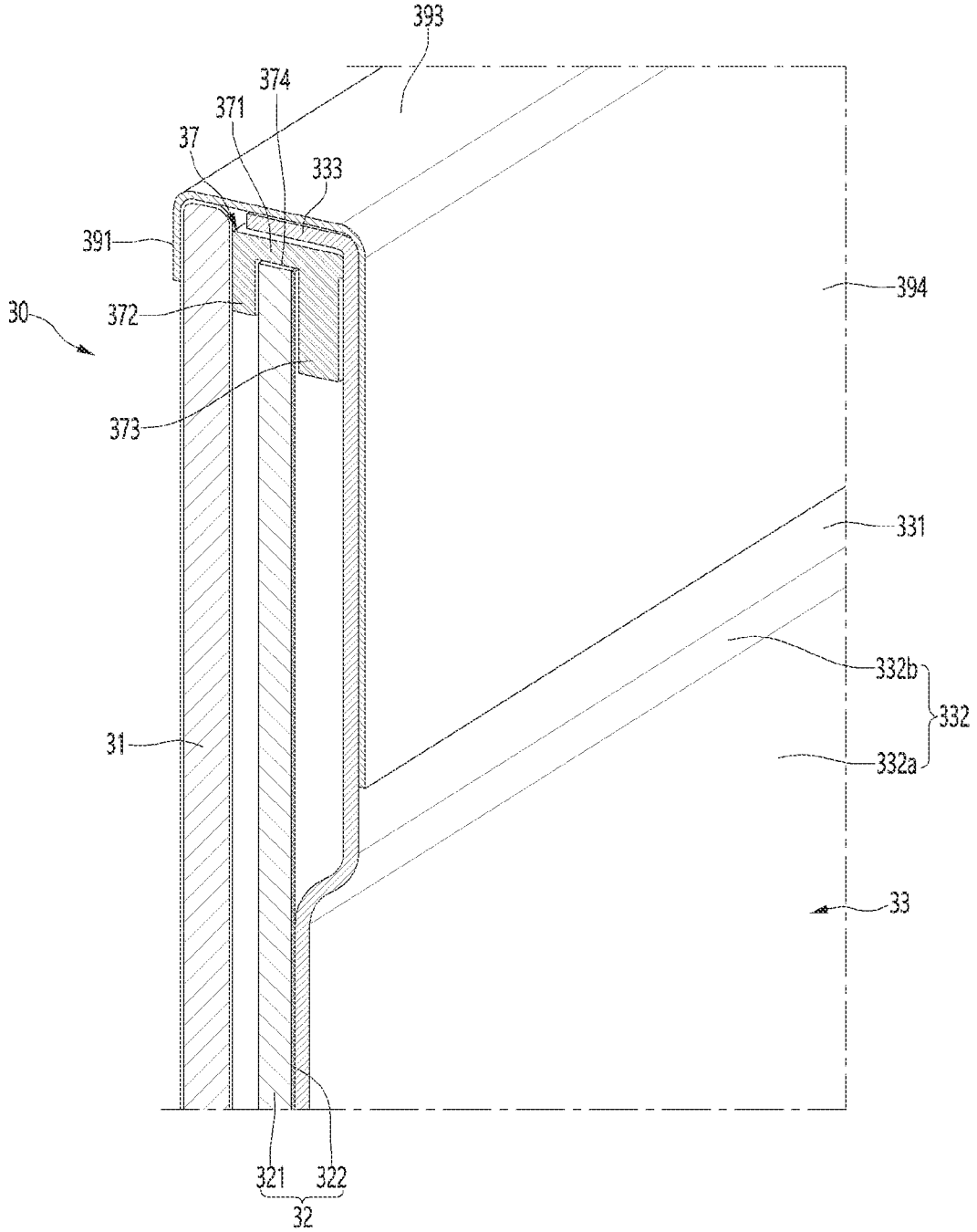
FIG. 31 is a partial perspective view of a cut upper end of a door panel according to a second embodiment of the present disclosure.
Figure 32:
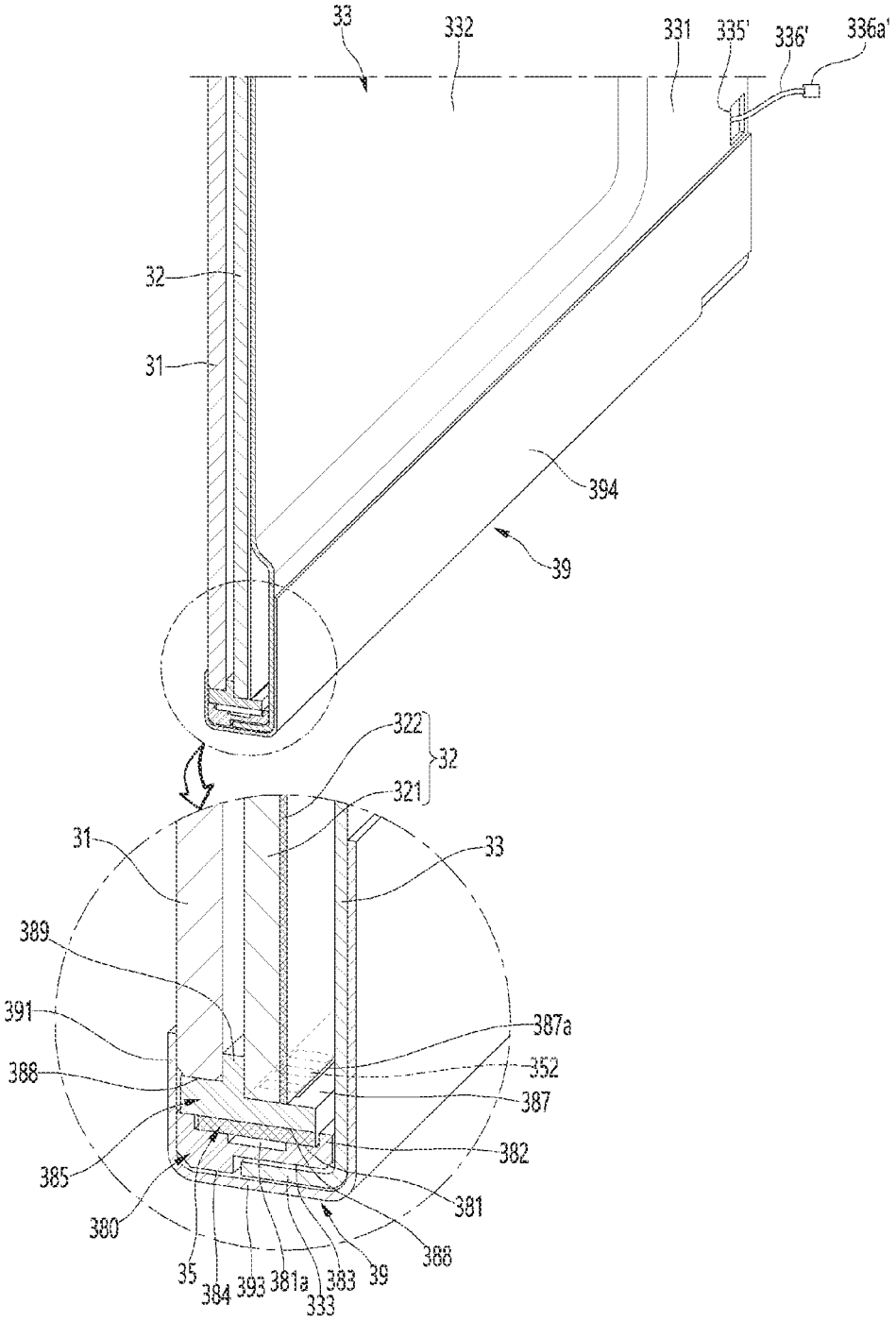
FIG. 32 is a partial perspective view of a cut lower end of the door panel.

FIG. 31 is a partial perspective view of a cut upper end of a door panel according to a second embodiment of the present disclosure. FIG. 32 is a partial perspective view of a cut lower end of the door panel.

As shown in the drawings, the door panel 30 according to the second embodiment of the present disclosure may include the front plate 31, the light guide plate 32, the back cover 33, and the out frame 39, which are the same as in the aforementioned embodiment. Although not illustrated in detail, the front spacer 301 and the rear spacer 302 of the door panel 30 may also be arranged in the same way as in the aforementioned embodiment.

An upper bracket 37 may be provided on an upper end of the door panel 30. The upper bracket 37 may be used to restrain an upper of the light guide plate 32, and the light guide plate 32 may be maintained at a predetermined interval from the front plate 31 and the back cover 33. Thus, the upper bracket 37 may be referred to as a support bracket.

The upper bracket 37 may include a bracket top 371 that extends along an upper end of the light guide plate 32. A front end and a rear end of the bracket top 371 may be formed with predetermined widths to contact a rear surface of the front plate 31 and a front surface of the back cover 33, respectively. Thus, the upper bracket 37 may be fixedly mounted between the front plate 31 and the back cover 33. The cover edge 333 and the cover perimeter part 331 may be in contact to stably mount the bracket top 371 on the upper end of the door panel 30.

A front rib 372 extending downward may be formed at the front end of the bracket top 371. The front rib 372 may be formed along the front end of the bracket top 371 and may extend downward to be inserted between the front plate 31 and the light guide plate 32. The front rib 372 may be formed with a thickness corresponding to an interval between the front plate 31 and the light guide plate 32, and thus the light guide plate 32 may be maintained at a predetermined interval from the front plate 31.

A rear rib 373 extending downward may be further formed at a rear end of the bracket top 371. The rear rib 373 may be inserted between a rear surface of the light guide plate 32 and the back cover 33. In this case, the rear rib 373 may be formed with a thickness corresponding to a distance between the light guide plate 32 and the back cover 33. Thus, the light guide plate 32 may be maintained at a predetermined interval from the back cover 33.

A bracket groove 374 may be formed between the front rib 372 and the rear rib 373, and the upper end of the light guide plate 32 may be inserted into the bracket groove 374. That is, the bracket groove 374 may be formed with a width corresponding to the thickness of the light guide plate 32. The light guide plate 32 may be expanded by a temperature difference, and thus the upper end of the light guide plate 32 may be slightly spaced apart from the bracket top 371 to form a predetermined space.

A lower bracket 380 on which the lighting device 35 is mounted may be provided on the lower end of the door panel 30. The lighting device 35 may be mounted on the lower end of the door panel 30, and simultaneously, a lower assembly 38 that supports the light guide plate 32 from below may be provided thereon.

The lower assembly 38 may include the lower bracket 380, the lighting device 35, and a supporting member 385. The lower bracket 380 may be accommodated on the cover edge 333 of the back cover 33 and the edge 393 of the out frame 39. The lighting device 35 may be disposed on an upper surface of the lower bracket 380. The supporting member 385 may be provided above the lower bracket 380 on which the lighting device 35 is mounted, and may support the light guide plate 32 from below to prevent contact between the light guide plate 32 and the light source 352 of the lighting device 35. The supporting member 385 may support the front plate 31 and may be configured to maintain a predetermined interval between the front plate 31 and the light guide plate 32.

A wire hole 335' may be formed in a lower part of the back cover 33, which is adjacent to a position at which the lower assembly 38 is mounted. The wire hole 335' may be opened at one side of the cover perimeter part 331 forming a lower surface of the back cover 33, which is not shielded by the out frame 39.

The wire hole 335' may be formed at one side close to a rotation axis of the door 20 among right and left sides thereof. A wire 336' connected to the lighting device 35 and a panel connector **336*a*' provided at one end of the wire 336' may be exposed through the wire hole 335'**.

Hereinafter, the structure of the lower assembly 38 will be described in more detail with reference to drawings.

Figure 33:
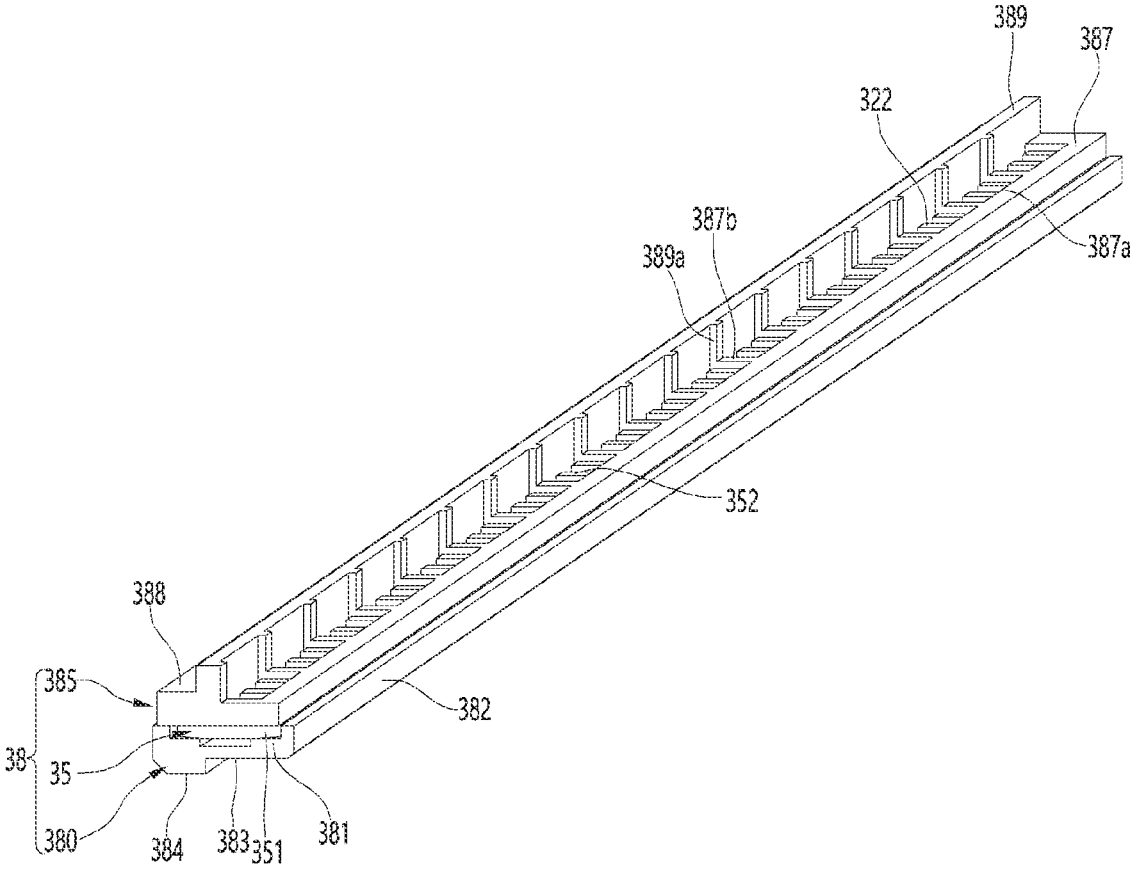
FIG. 33 is a perspective view of the lower assembly according to the second embodiment of the present disclosure.
Figure 34:
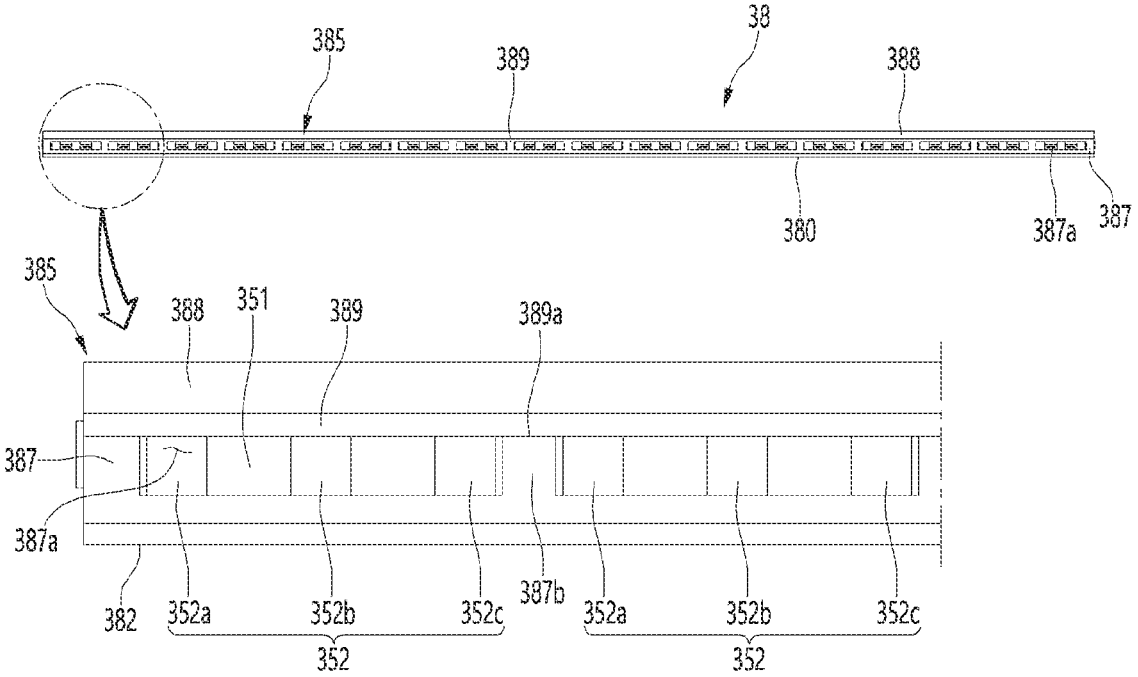
FIG. 34 is a plan view of the lower assembly.
Figure 35:
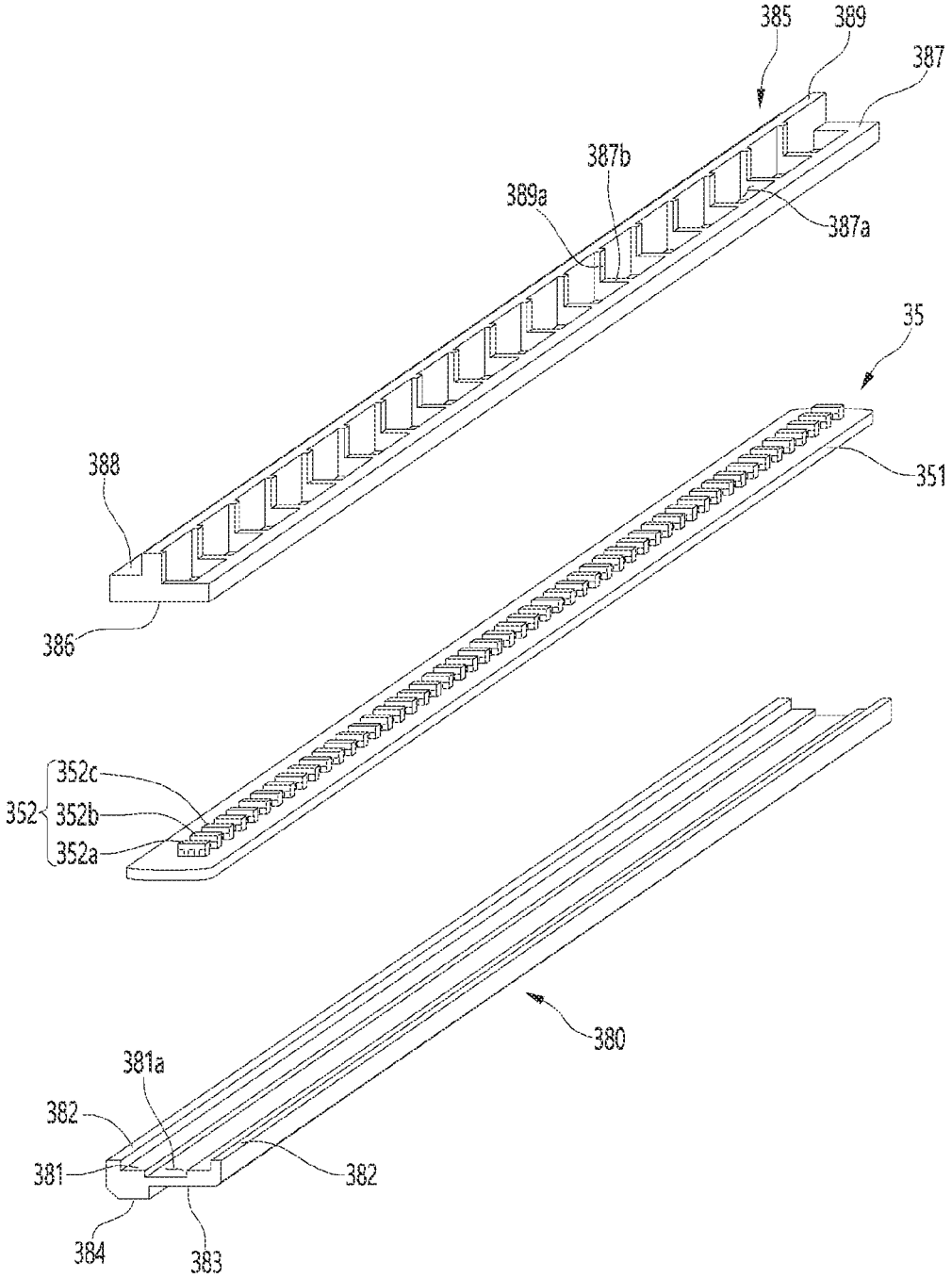
FIG. 35 is an exploded perspective view of the lower assembly.

FIG. 33 is a perspective view of the lower assembly according to the second embodiment of the present disclosure. FIG. 34 is a plan view of the lower assembly. FIG. 35 is an exploded perspective view of the lower assembly.

As shown in the drawings, the lower bracket 380 may extend along a lower surface of the light guide plate 32 and may extend from one end of the door panel 30 to another end. The lighting device 35 may be mounted on an upper surface of the lower bracket 380. Thus, the lower bracket 380 may be referred to as a lighting bracket.

A substrate accommodator 381 recessed with a shape corresponding to a shape of the substrate 351 may be formed on an upper surface of the lower bracket 380. Thus, the substrate 351 of the lighting device 35 may be accommodated on the substrate accommodator 381, and an upper surface of the substrate accommodator 381 may support a lower surface of the substrate 351. An accommodator groove **381*a* that is recessed downward to accommodate the substrate connector 353 may be further formed on the substrate accommodator 381**.

Bracket sides 382 extending upward may be formed on a front end and a rear end of the substrate accommodator 381. The bracket sides 382 may form a front end and a rear end of the lower bracket 380 and may respectively support a front end and a rear end of the substrate 351 to maintain a mounting state of the substrate 351.

A lower end protrusion 384 and a lower end accommodator 383 may be formed on a lower surface of the lower bracket 380. The lower end protrusion 384 may form a protruding lower surface of the lower bracket 380 and may be in close contact with the edge 393 of the out frame 39 in the state in which the door panel 30 is assembled.

The lower end accommodator 383 may be stepped to be positioned higher than the lower end protrusion 384. The stepped height of the lower end accommodator 383 may correspond to the thickness of the back cover 33. The lower end accommodator 383 may be formed to accommodate the cover edge 333 of the back cover 33 thereon.

In the state in which the door panel 30 is assembled, the cover edge 333 of the back cover 33 may be inserted between the lower end accommodator 383 and the edge 393 and may surface-contact the upper end accommodator 344 and the edge 393. Thus, the upper bracket 34 may have a firmly coupling structure inside the door panel 30 and may be maintained at a mounting position thereof.

The lighting device 35 may have the same structure as in the aforementioned embodiment and may include the substrate 351, and the light source 352 mounted on the substrate 351. For example, the light source 352 may include a plurality of LEDs that are arranged in a line to face an end of the light guide plate 32.

The light source 352 may be configured to emit light with various colors. For example, the plurality of light sources 352 may be configured to emit light with different colors, respectively. For example, the light sources 352 may include the red light source **352*a*, the green light source 352*b*, and the blue light source 352*c*. The light sources 352 may be arranged at equal intervals and may be configured as one set of the red light source 352*a*, the green light source 352*b*, and the blue light source 352*c***.

The lighting device 35 may be mounted on the lower bracket 380, and when the lighting device 35 is mounted on the lower bracket 380, the lighting device 35 may be positioned at an exact position inside the door panel 30.

In the state in which the lighting device 35 is mounted on the lower bracket 380, the supporting member 385 may be mounted on an upper surface of the lower bracket 380. The supporting member 385 may support the light guide plate 32 to prevent the light guide plate 32 from being moved downward, and the light guide plate 32 may be maintained to be spaced apart from the light source 352 to prevent the light source 352 from colliding with the light guide plate 32.

In detail, the supporting member 385 may extend along the lower bracket 380 and may extend at least to a length corresponding to a length of the substrate 351. The supporting member 385 may include a supporter lower surface 386 with a planar shape. The supporter lower surface 386 may shield at least the light sources 352 and may be formed with a width for accommodating the supporter lower surface 386 on the lower bracket 380.

For example, the supporter lower surface 386 may have a width to be supported by the bracket sides 382 of the front and rear ends of the lower bracket 380. The width of the supporter lower surface 386 may be slightly smaller than the width of the lower bracket 380. The supporter lower surface 386 may be supported by the bracket sides 382 to achieve a stable mounting structure.

The supporting member 385 may include a first top supporter 387 and a second top supporter 388, which are disposed on an upper surface thereof, and a supporter spacer 389 protruding between the first top supporter 387 and the second top supporter 388.

The first top supporter 387 may form a rear part of the upper surface of the supporting member 385 based on the supporter spacer 389. The first top supporter 387 may be formed to support the lower end of the light guide plate 32. A top the first top supporter 387 may be positioned above the light source 352, and in any state in which the lower end of the light guide plate 32 is accommodated on the first top supporter 387, the light source 352 and the light guide plate 32 may not come into contact with each other.

A lighting opening **387*a* may be formed in the first top supporter 387. The lighting opening 387*a* may be opened vertically above the light source 352. Thus, viewed from above, the light source 352 may be exposed through the lighting opening 387*a***.

In this case, the plurality of lighting openings **387*a* may be formed along the first top supporter 387. The plurality of lighting openings 387*a* may be consecutively arranged and may be spaced apart from each other at a predetermined interval. The plurality of light sources 352 may be consecutively arranged inside the lighting opening 387*a*. For example, the light sources 352 combined as two modules may be arranged in one lighting opening 387***a*. Thus, light emitted from the light source 352 may be transferred to the lower end of the light guide plate 32 through the lighting opening 387*a*.

A space between the supporter lower surface 386 and the first top supporter 387 may be have a set thickness, and thus the lower end of the light guide plate 32 and the light source 352 may also be maintained at a set interval. For example, an interval between the light source 352 and the upper end of the light guide plate 32 may be several millimeters, and light of the light source 352 may be effectively transferred to the light guide plate 32 to prevent direct contact between the light guide plate 32 and the light source 352.

The first top supporter 387 may limit downward movement of the light guide plate 32. That is, the first top supporter 387 may come into contact with the lower end of the light guide plate 32 by its own weight, and even if impact is applied in a process in which the door 20 is opened and opened, the light guide plate 32 may be moved downward to prevent collision with the light source 352.

The second top supporter 388 may be formed at a front part of the upper surface of the lower bracket 380 based on the supporter spacer 389. The second top supporter 388 may be stepped to be higher than the height of the first top supporter 387. The second top supporter 388 may support the lower end of the front plate 31. Thus, the width of the second top supporter 388 may correspond to the thickness of the front plate 31.

In detail, the front surface of the supporter spacer 389 may be in contact with the rear surface of the front plate 31, and the rear surface of the supporter spacer 389 may protrude to come into contact with the front surface of the light guide plate 32. Thus, in the state in which the door panel 30 is assembled, the positions of the front plate 31 and the upper end of the light guide plate 32 may be determined by the supporter spacer 389, and a fixed state may be maintained. In particular, due to the supporter spacer 389, the upper end of the light guide plate 32 may be positioned on the same extension line as the light source 352.

An opening compartment 387*b* may be formed between the plurality of lighting openings 387*a*. The opening compartment 387*b* may also be in contact with the lower end of the light guide plate 32. A spacer support protrusion 389*a* extending up and down may be formed on the rear surface of the supporter spacer 389 corresponding to the opening compartment 387*b*. The spacer support protrusion 389*a* may be in contact with the front surface of the light guide plate 32 to restrain forward and backward movement of the light guide plate 32.

The following diagrams show the state in which the lighting device 35 is operated in the door panel 30 having the above structure according to the second embodiment of the present disclosure.

Figure 36:
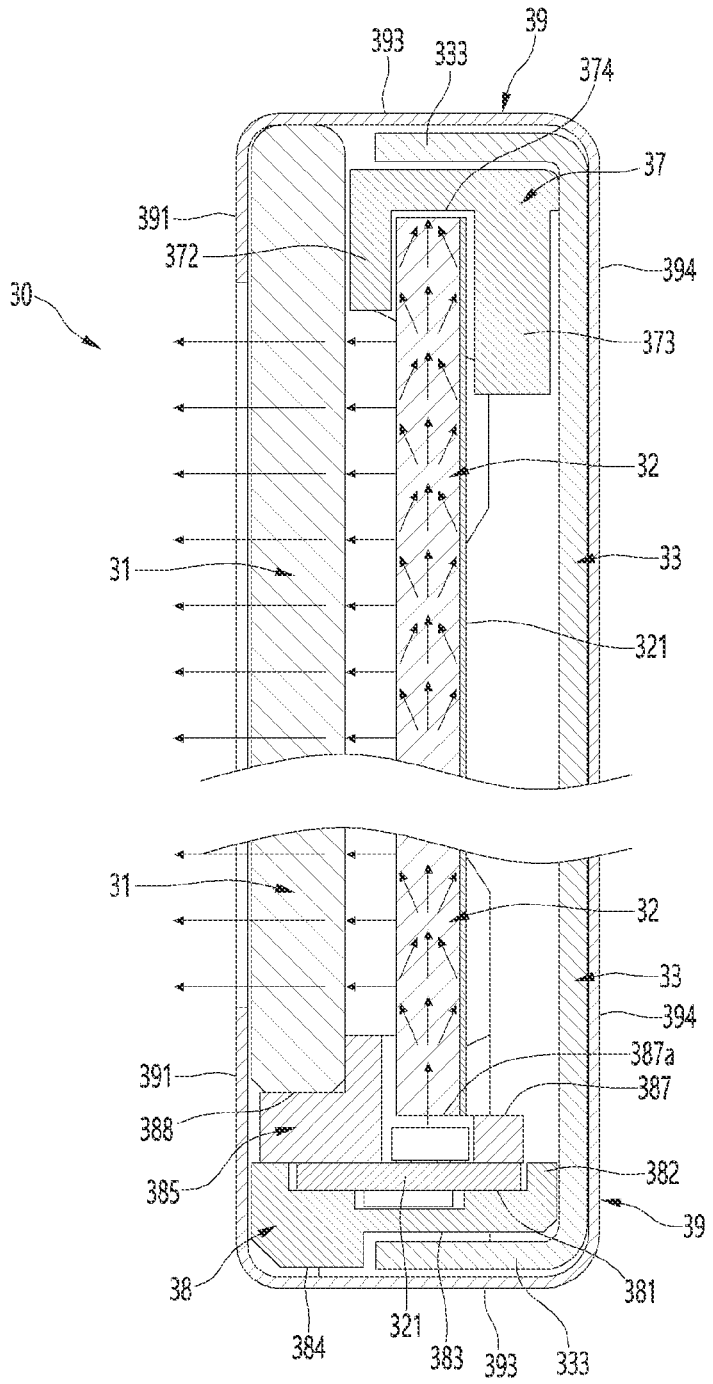
FIG. 36 is a cross-sectional view of an operation state of an operation of a lighting device according to a second embodiment of the present disclosure.

FIG. 36 is a cross-sectional view of an operation state of an operation of the lighting device according to a second embodiment of the present disclosure.

As shown in the drawing, the lighting device 35 may be turned on to make a front surface of the door panel 30 glow or to express the front surface with specific color. Light emitted from the light source 352 may be directed upward and may be moved upward while being diffusing and reflected along the light guide plate 32 through the lower end of the light guide plate 32.

Light moved along the light guide plate 32 may be repeatedly reflected and diffused to the upper end of the light guide plate 32 and may make the entire light guide plate 32 glow brightly. In this case, light may be reflected to a front side of the light guide plate 32 by the reflective layer 321 of the light guide plate 32, and the light emitted forward from the light guide plate 32 may be emitted to the outside while passing through the front plate 31.

Thus, the entire front plate 31 may glow with set color or brightness, and the front appearance of the door panel 30, that is, the door 20 may be expressed as desired.

The refrigerator 1 according to the embodiment of the present disclosure may have various other embodiments other than the aforementioned embodiment.

According to another embodiment of the present disclosure, illumination devices may be disposed on both upper and lower ends of the door panel. Thus, another embodiment of the present disclosure may have partially the same structure as components of the first and third embodiments. Thus, the same components as in the aforementioned embodiment use the same reference numeral, and a detailed description or illustration thereof may be omitted.

Hereinafter, another embodiment of the present disclosure will be described in detail with reference to drawings.

Figure 37:
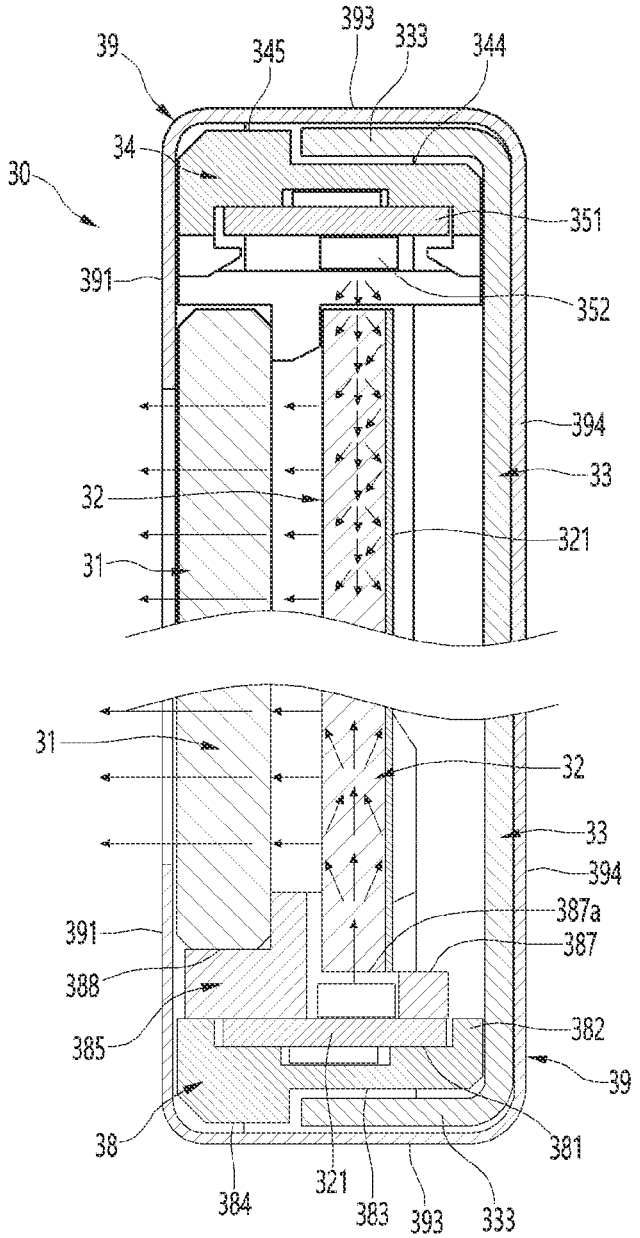
FIG. 37 is a cross-sectional view of a door panel according to a third embodiment of the present disclosure.

FIG. 37 is a cross-sectional view of a door panel according to a third embodiment of the present disclosure.

As shown in the drawing, the door panel 30 according to the third embodiment of the present disclosure may include the front plate 31, the light guide plate 32, the back cover 33, and the out frame 39, which are the same as in the aforementioned embodiment. Although not illustrated in detail, the front spacer 301 and the rear spacer 302 of the door panel 30 may also be arranged in the same way as in the aforementioned embodiment.

The upper bracket 34 may be provided on an upper end of the door panel 30. The lighting device 35 may be mounted on the upper bracket 34, and simultaneously, the front plate 31, the light guide plate 32, and the back cover 33 may be restrained to be maintained at a predetermined interval. The structure of the upper bracket 34 may be completely the same as the upper bracket 34 according to the aforementioned first embodiment, and thus in order to avoid a repeated description, the same component as in the aforementioned embodiment is not described, and the same reference numeral is used therefor.

The lower bracket 380 may be provided on the lower end of the door panel 30. The lighting device 35 may be mounted on the lower bracket 380, and the supporting member 385 for supporting the front plate 31 and the light guide plate 32 may be further mounted thereon. The lower bracket 380, the lighting device 35, and the supporting member 385 may be collectively referred to as the lower assembly 38.

The lighting devices 35 mounted on the upper bracket 34 and the lower bracket 380 may have the same structure as in the aforementioned embodiment. The light sources 352 mounted in the lighting device 35 may be arranged to have the same number and to face each other. The light sources 352 having the same color may be arranged to face each other. The lighting device 35 may be mounted on both the upper bracket 34 and the lower bracket 380, and the upper bracket 34 and the lower bracket 380 may be referred to as a lighting bracket.

The lighting devices 35 provided on the upper and lower ends of the door panel 30 may be turned on to make a front surface of the door panel 30 glow or to express the front surface with specific color. Light emitted from the light source 352 may be moved while being diffused and reflected along the light guide plate 32 through the upper and lower ends of the light guide plate 32.

Light moved along the light guide plate 32 may make the entire light guide plate 32 glow brightly. In this case, light may be reflected to the front of the light guide plate 32 by the reflective layer 321 of the light guide plate 32, and light emitted toward the front from the light guide plate 32 may be emitted to the outside while being passed through the front plate 31.

Thus, the entire front plate 31 may glow with set color or brightness, and the front appearance of the door panel 30, that is, the door 20 may be expressed as desired.

The refrigerator 1 according to the embodiment of the present disclosure may have various other embodiments other than the aforementioned embodiment.

According to another embodiment of the present disclosure, the door panel may directly contact an insulator inside the door.

Thus, another embodiment of the present disclosure may be the same as the aforementioned embodiment in terms of components except for some components of the door body. In addition, the same component as the aforementioned embodiment use the same reference numeral, and a detailed description or illustration thereof may be omitted.

Hereinafter, another embodiment of the present disclosure will be described in detail with reference to drawings.

Figure 38:
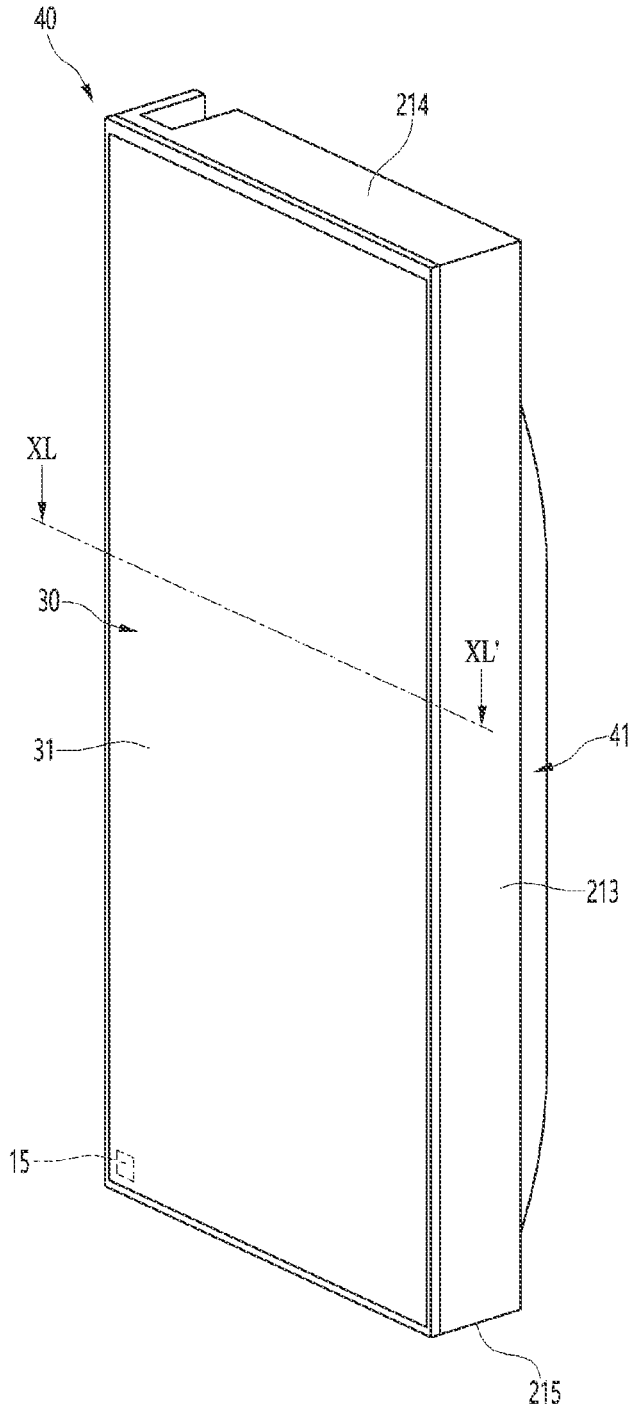
FIG. 38 is a perspective view of a refrigerator door according to a fourth embodiment of the present disclosure.
Figure 39:
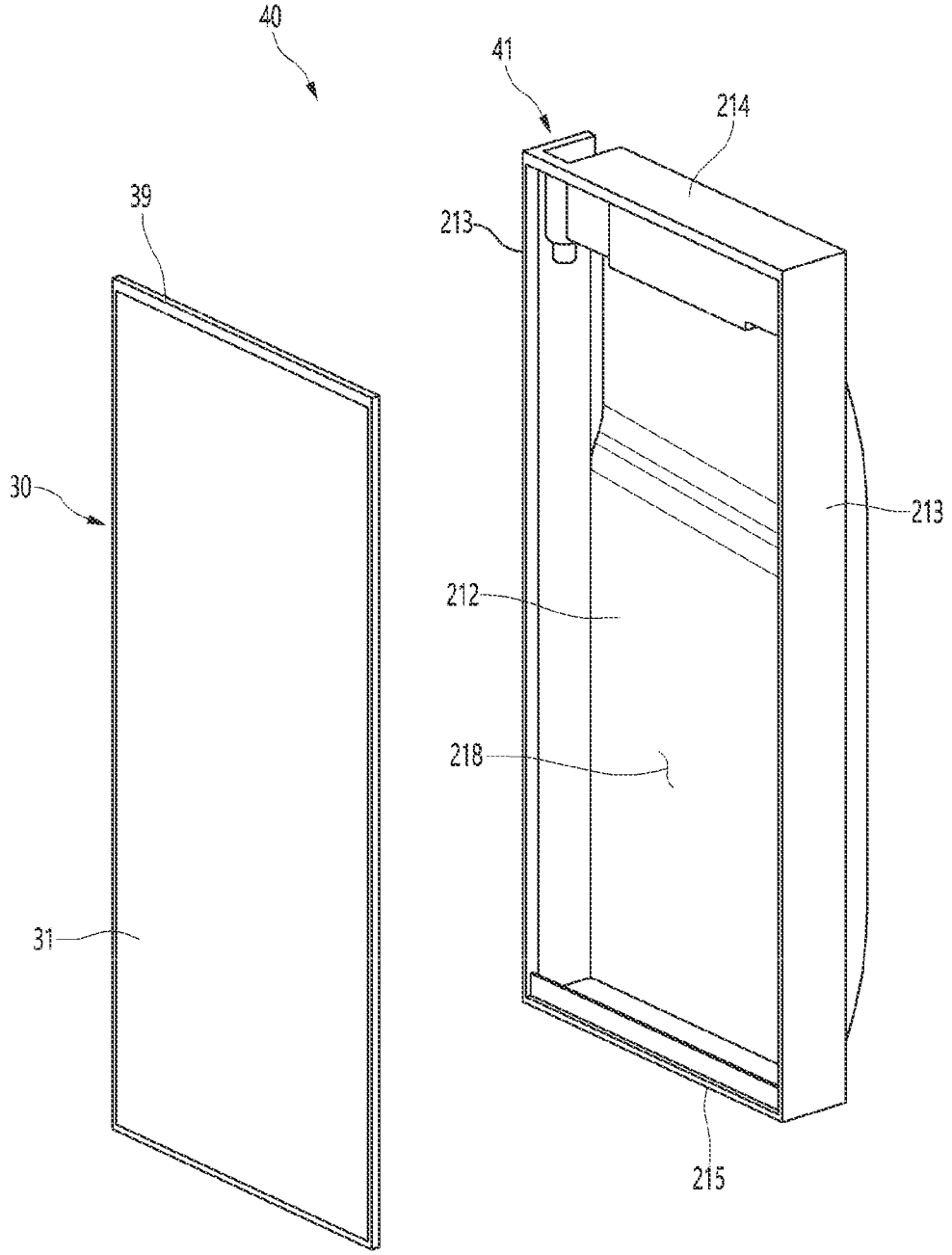
FIG. 39 is an exploded perspective view of the refrigerator door.
Figure 40:
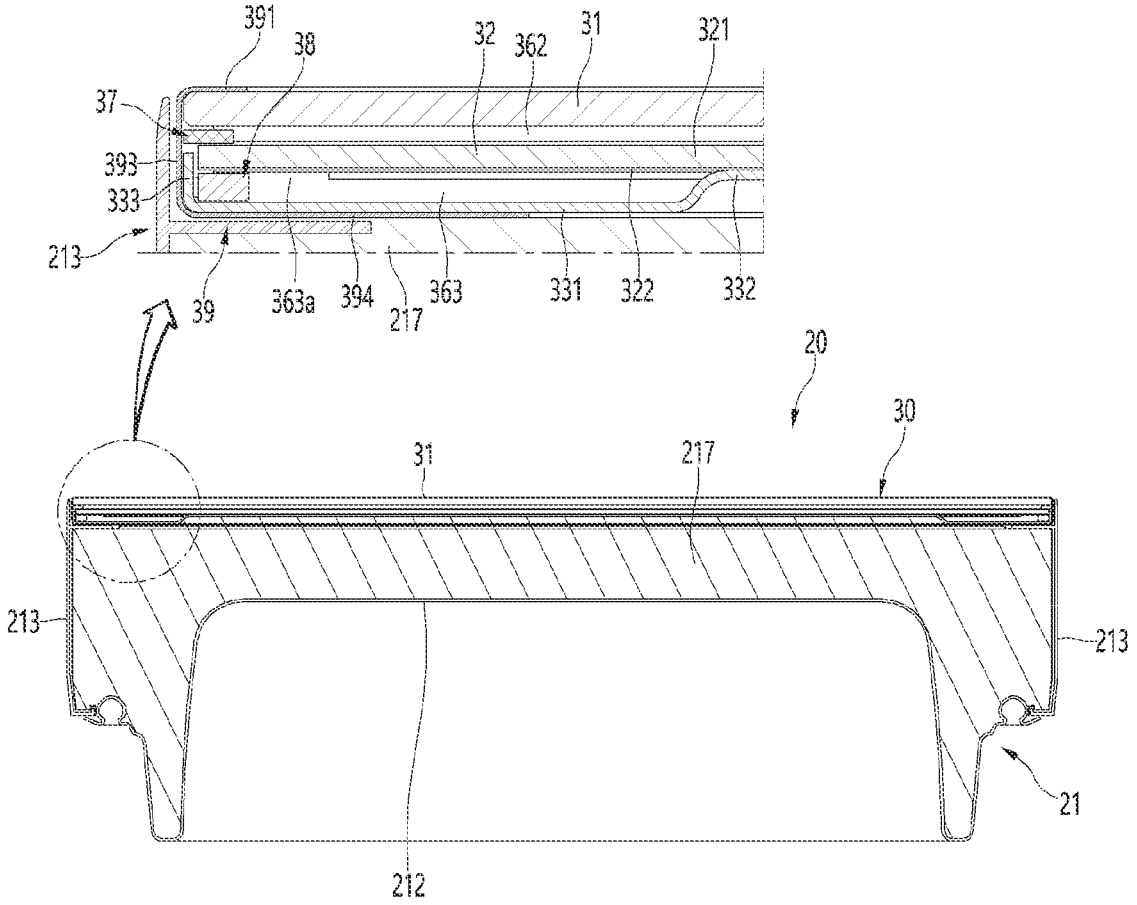
FIG. 40 is a cross-sectional view taken along XL-XL' of FIG. 38.

FIG. 38 is a perspective view of a refrigerator door according to a fourth embodiment of the present disclosure. FIG. 39 is an exploded perspective view of the refrigerator door. FIG. 40 is a cross-sectional view taken along XL-XL' of FIG. 38.

As shown in the drawings, a refrigerator door 40 according to the fourth embodiment of the present disclosure may include the door panel 30 and a door body 41. The door panel 30 may be coupled to the door body 41 to form the front surface of the refrigerator door 40.

The overall structure of the door panel 30 may be the same as in the aforementioned embodiment. That is, the door panel 30 may include the front plate 31, the light guide plate 32, the lighting device 35, the upper bracket 34, the lower bracket 36, the back cover 33, and the out frame 39, which are the same as in the aforementioned embodiment, and thus a detailed description thereof will be omitted.

The door body 41 may include the door liner 212 forming the back of the refrigerator door 40, the upper cap deco 214 disposed on upper and lower ends of the door liner 212, and the side deco 213 disposed on right and left side ends of the door liner 212. The upper cap deco 214 and the lower cap deco 215 may form an upper surface and a lower surface of the refrigerator door 40, respectively, and the side deco 213 may form the right and left side surfaces of the refrigerator door 40.

In the state in which the door liner 212 is coupled to the upper cap deco 214, the lower cap deco 215, and the side deco 213, a body space 218 with an open front surface may be formed. The body space 218 may be shielded by the door panel.

That is, the door panel 30 may be coupled to the upper cap deco 214, the lower cap deco 215, and a front end of the side deco 213 and may form a space inside the refrigerator door 40, in which the insulator 217 is filled, with the door liner 212.

In the state in which the door panel 30 and the door body 41 are coupled, the insulator 217 may be injected into the refrigerator door 40, and the body space 218 may be filled with the insulator 217 to satisfy thermal insulation capability of the refrigerator door 40.

In the state in which the refrigerator door 40 is assembled, the back of the door panel 30, that is, the rear part of the back cover 33 may be in contact with the insulator 217. Thus, the insulator 217 may not penetrate into a space inside the door panel 30 and may be protected by the back cover 33. The rear surface of the back cover 33 may be coupled to the insulator 217, and the door panel 30 may be firmly fixed to the refrigerator door 40.

The refrigerator according to the embodiment of the present disclosure may have various other embodiments other than the aforementioned embodiment.

According to another embodiment of the present disclosure, the perimeter of the door panel may be formed by the side bracket, the right bracket, and the support bracket.

Thus, another embodiment of the present disclosure may be the same as the aforementioned embodiment in terms of components except for some components of the door panel. In addition, the same component as the aforementioned embodiment use the same reference numeral, and a detailed description or illustration thereof may be omitted.

Hereinafter, another embodiment of the present disclosure will be described in detail with reference to drawings.

Figure 41:
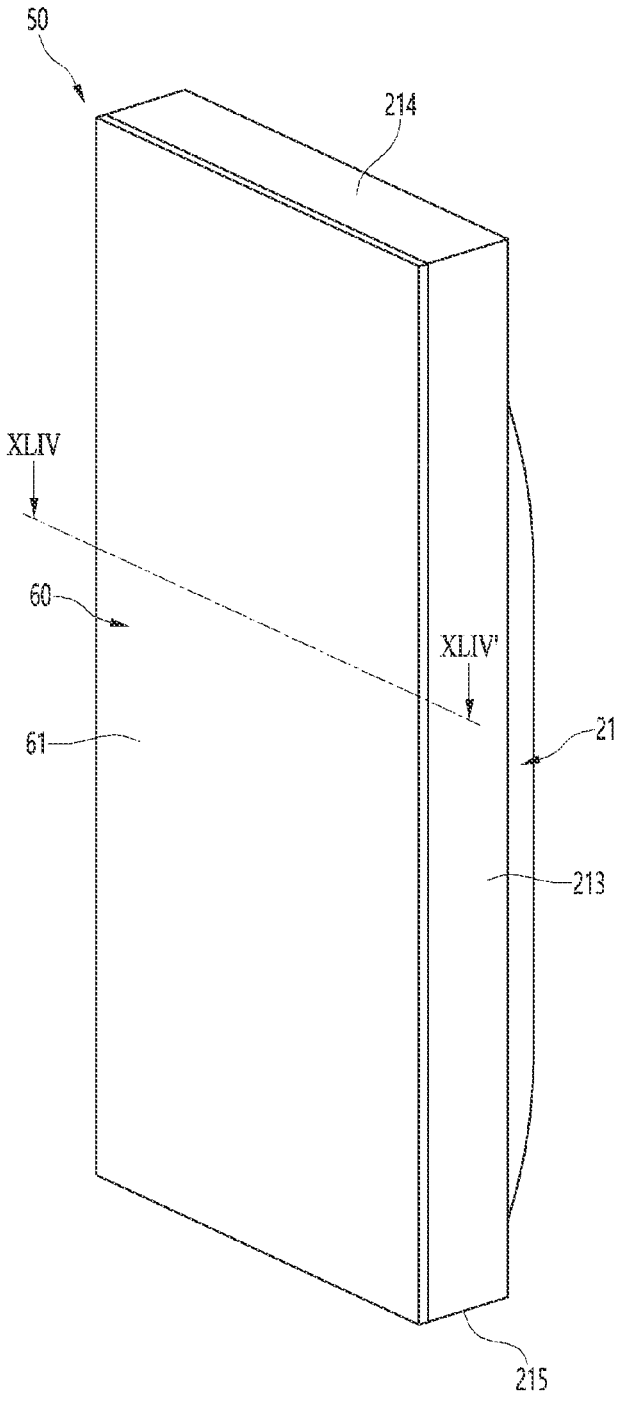
FIG. 41 is a perspective view of a refrigerator door according to a fifth embodiment of the present disclosure.
Figure 42:
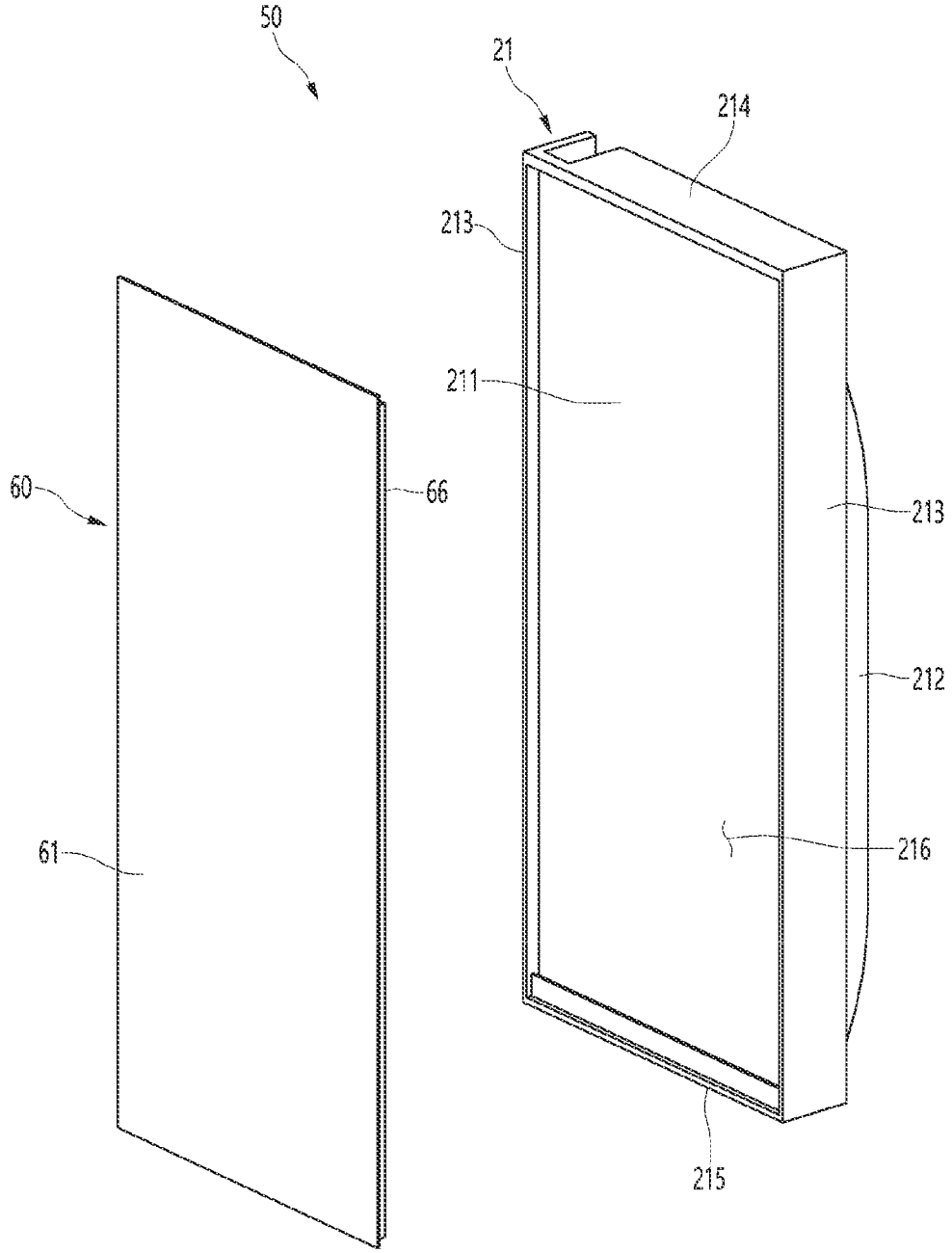
FIG. 42 is an exploded perspective view of the refrigerator door.
Figure 43:
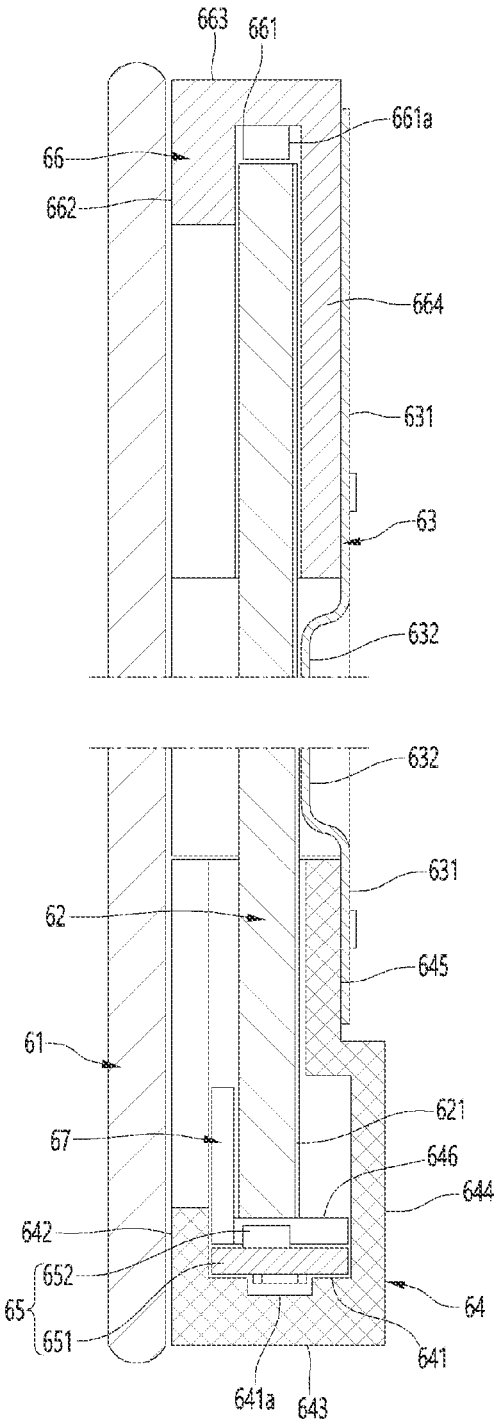
FIG. 43 is a longitudinal cross-sectional view of a door panel as one component of the refrigerator door.
Figure 44:
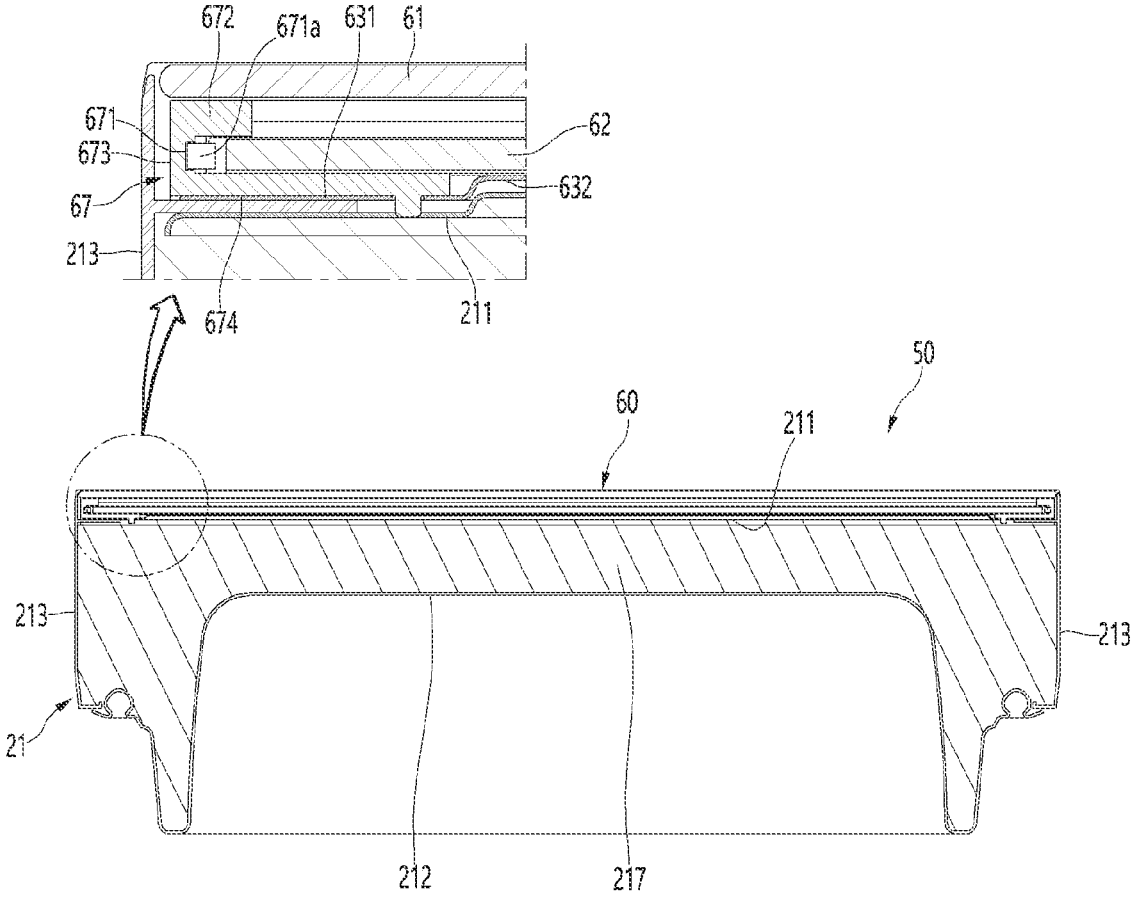
FIG. 44 is a cross-sectional view taken along XLIV-XLIV' of FIG. 41.

FIG. 41 is a perspective view of a refrigerator door according to a fifth embodiment of the present disclosure. FIG. 42 is an exploded perspective view of the refrigerator door. FIG. 43 is a longitudinal cross-sectional view of a door panel as one component of the refrigerator door. FIG. 44 is a cross-sectional view taken along XLIV-XLIV' of FIG. 41.

As shown in the drawing, a refrigerator door 50 according to the fifth embodiment of the present disclosure may include a door panel 60 and the door body 21. The door panel 60 may be coupled to an open front surface of the door body 21, and in the coupled state, may form the front appearance of the refrigerator door 50.

The door body 21 may have the same structure as in the aforementioned embodiment. That is, the door body 21 may include the body plate 211, the door liner 212, the upper cap deco 214, the lower cap deco 215, the side deco 213, and the insulator 217. A detailed structure of the door body 21 is the same as in the aforementioned embodiment, and a detailed description thereof is omitted.

The door panel 60 may be mounted on the front surface of the door body 21, and may be accommodated inside the panel receiving space 216. The peripheral surface of the door panel 60 may be supported by the upper cap deco 214, the lower cap deco 215, and the side deco 213. The rear surface of the door panel 60 may be coupled to the body plate 211.

The door panel 60 may broadly include a front plate 61, a light guide plate 62, a lighting device 65, a right bracket 64, a support bracket 66, a side bracket 67, and a back cover 63.

The door panel 60 may also include a front plate 61, a lighting device 65, a right bracket 64, a support bracket 66, and a back cover 63.

In detail, the front plate 61 may form a front appearance of the door panel 60 and may be formed of a plate-shaped metal material for transmitting light therethrough. The front plate 61 may be formed in the same way as the aforementioned front plate 31.

The light guide plate 62 may be provided behind the front plate 61. The light guide plate 62 may guide light emitted from the lighting device 65, light emitted from the lighting device 65 may be diffused and reflected and may be directed toward the front plate 61, and the entire front plate 61 may glow with uniform brightness. In particular, a reflective layer 621 may be formed on the back of the light guide plate 62. The structure of the light guide plate 62 and the reflective layer 621 may be the same as the light guide plate 32 and the reflective layer 321 according to the aforementioned embodiment.

The right bracket 64 may be formed along a lower end of the rear surface of the front plate 61. The right bracket 64 may also be referred to as a lower bracket. The right bracket 64 may form a lower surface of the perimeter of the door panel 60. The lighting device 65 may be mounted on the right bracket 64.

In detail, the right bracket 64 may include a bracket front part 642, a bracket lower part 643, and a bracket rear part 644.

The bracket front part 642 may form a front surface of the right bracket 64 and may be bent to be in contact with a rear surface of the front plate 61. The bracket front part 642 may be adhered to the rear surface of the front plate 61 to be coupled to the front plate 61 by an adhesive or an adhesive sheet.

The bracket lower part 643 may form a lower surface of the right bracket 64 and may extend rearward from the lower end of the bracket front part 642. The bracket lower part 643 may form a lower surface of the door panel 60. The lighting device 65 may be mounted on an upper surface of the bracket lower part 643. The bracket lower part 643 may be formed with a front-rear width corresponding to the lighting device 65.

The lighting device 65 may include a substrate 651 and a plurality of light sources 652 arranged along the substrate 651. The lighting device 65 may be configured in the same way as the lighting device 35 according to the aforementioned embodiment.

A substrate accommodator 641 for supporting the substrate 651 may be formed on the bracket lower part 643. An accommodator groove 641*a* that is further recessed downward and accommodates a connector or a device that protrudes on a lower surface of the substrate 651 may be formed on the substrate accommodator 641.

Bracket supports 646 protruding upward may be further formed on both ends of the bracket lower part 643. The bracket support 646 may further protrude compared with the upper end of the light source 652 and may support the lower end of the light guide plate 62 from below. Thus, the light guide plate 62 positioned above the light sources 652 may be prevented from contacting with or colliding with the light sources 652.

The bracket rear part 644 may extend upward from the rear end of the bracket lower part 643. The bracket rear part 644 may extend upward by a predetermined length. The bracket rear part 644 may be in contact with the body plate 211 when the door panel 60 is coupled to the door body 21. The body plate 211 and the bracket rear part 644 may be firmly coupled to each other.

A plate mount 645 formed to be stepped may be formed on the upper end of the bracket rear part 644. The plate mount 645 may be stepped forward may be formed to mount the lower end of the back cover 63 thereon.

The support bracket 66 may be provided on an upper end of the front plate 61. The support bracket 66 may be referred to as an upper bracket. The support bracket 66 may extend along an upper end of a rear surface of the front plate 61. The support bracket 66 may form an upper surface of the door panel 60. In the support bracket 66, the front plate 61 and the light guide plate 62 may be spaced apart from each other at an equal interval.

In detail, the support bracket 66 may include a support front part 662, a support upper part 663, and a support rear part 664. The support front part 662 may support a rear surface of the front plate 61 and may be coupled to the front plate 61 by an adhesive or an adhesive sheet. The support front part 662 may make the front plate 61 and the light guide plate 62 be maintained at a set interval between the front plate 61 and the light guide plate 62.

The support front part 662 may extend downward between the rear surface of the front plate 61 and the front surface of the light guide plate 62. The front surface of the support front part 662 may be in contact with the rear surface of the front plate 61, and the rear surface of the support front part 662 may be in contact with the front surface of the light guide plate 62. Thus, the front plate 61 and the light guide plate 62 may be supported by the support front part 662 to be maintained at an interval therebetween.

The support upper part 663 may extend rearward from the upper end of the support front part 662 and may form an upper surface of the door panel 60. A top support 661 for supporting the light guide plate 62 from above may be formed on a lower surface of the support upper part 663. The top support 661 may be positioned above the upper end of the light guide plate 62 and may also be spaced apart from the upper end of the light guide plate 62. The support upper part 663 may provide an interval with the light guide plate 62 for extending the light guide plate 62 to prevent the light guide plate 62 from being bent or damaged even if the light guide plate 62 is expanded by a temperature difference.

A buffer member 661*a* may be provided between the top support 661 and an upper end of the light guide plate 62. The buffer member 661*a* may be formed of an elastically deformable material and may support the light guide plate 62 to prevent the light guide plate 62 from being excessively moved while expanding the light guide plate 62.

The support rear part 664 may extend downward from the rear end of the support upper part 663. The support rear part 664 may extend to be coupled to a rear end of the back cover 63. The support rear part 664 may be spaced apart from the support front part 662 and may be arranged in parallel thereto. An interval between the support rear part 664 and the support front part 662 may correspond to the thickness of the light guide plate 62. Thus, the rear surface of the support front part 662 may support the front surface of the light guide plate 62, and the front surface of the support rear part 664 may support the rear surface of the light guide plate 62. That is, the upper end of the light guide plate 62 may be inserted into the support bracket 66 to be fixedly spaced apart from the front plate 61.

When the lighting device 65 is provided at a lower part, the right bracket 64 may be disposed at the lower end of the door panel 60, and the support bracket 66 may be disposed at the upper end of the door panel 60. However, when the lighting device 65 is provided at an upper art, the right bracket 64 may be disposed at the upper end of the door panel 60, and the support bracket 66 may be disposed at the lower end of the door panel 60.

The side bracket 67 may be provided at right and left side ends of the front plate 61. The side bracket 67 may extend in a vertical direction along the right and left side ends of the front plate 61. The side bracket 67 may form right and left side surfaces of the door panel 60 and may simultaneously support the light guide plate 62.

In detail, the side bracket 67 may include a side front part 672, a side lateral part 673, and a side rear part 674.

The side front part 672 may be coupled to right and left side ends of the front plate 61. The side front part 672 may extend to be in contact with the rear surface of the front plate 61 and may be inserted between both ends of the front plate 61 and the light guide plate 62.

That is, the front surface of the side front part 672 may support the rear surface of the front plate 61, and the rear surface of the side front part 672 may support the front surface of the light guide plate 62. Thus, a predetermined interval between the front plate 61 and the light guide plate 62 may be maintained by the side front part 672.

The side rear part 674 may extend to be coupled to right and left side ends of the back cover 63. The side rear part 674 may extend in parallel to the side front part 672 and the back cover 63. A protrusion may be formed on the side rear part 674 to be coupled to the back cover 63 through the back cover 63.

The side lateral part 673 may connect the side front part 672 and an end of the side rear part 674 and may form a side surface of the door panel 60. A lateral surface support 671 into which a side end of the light guide plate 62 is to be inserted may be formed inside the side lateral part 673. The lateral surface support 671 may be spaced apart from the side end of the light guide plate 62, and the lateral surface support 671 may include a lateral surface buffer member 671*a*. Thus, when the light guide plate 62 extends, the light guide plate 62 may be supported by the lateral surface buffer member 671*a*.

A spacer 67 may be provided between the front plate 61 and the light guide plate 62. The spacer 67 may maintain a distance between the front plate 61 and the light guide plate 62 and may be disposed at one side of a perimeter of the front plate 61.

The back cover 63 may form a rear surface of the door panel 60 and may be formed of a plate-shaped metal material. For example, the back cover 63 may be formed of a stainless material.

Upper and lower ends of the back cover 63 may be coupled to the support bracket 66 and the right bracket 64. The right and left side ends of the back cover 63 may be fixed to the side bracket 67.

In detail, the back cover 63 may include a cover perimeter part 631 and a cover protrusion 632. The overall shape of the back cover 63 may be formed by a foaming process. In particular, the cover protrusion 632 may protrude forward by a foaming process, and may be formed forward with respect to the cover perimeter part 631.

The cover perimeter part 631 may be formed along a perimeter of the back cover 63 and may be formed with a predetermined width, and may provide a surface coupled to the support bracket 66, the right bracket 64, and the side bracket 67.

The cover protrusion 632 may protrude forward with respect to the cover perimeter part 631, and may form an internal shape of the cover perimeter part 631. The cover protrusion 632 may protrude forward in a region including the center of the back cover 63, and a protruding surface may be in close contact with the back of the light guide plate 62. In this case, the cover protrusion 632 may support a region, which is not supported by the support bracket 66, the right bracket 64, and the side bracket 67, from the rear. Thus, when the light guide plate 62 has a large size, the light guide plate 62 may also be maintained in a stable supported state to maintain an exact mounting position.

When the door panel 60 having this structure is mounted on the door body 21, the front plate 61 may form the overall front appearance of the door panel 60, that is, the refrigerator door 50. In particular, differently from the aforementioned embodiment, the out frame 39 may not be exposed to the outside, and the front appearance may be formed only by the front plate 61, achieving a very simple outer appearance.

When the lighting device 65 is turned on, light emitted from the lighting device 65 may be emitted toward a lower end of the light guide plate 62, and light diffused and reflected along the light guide plate 62 may be reflected forward by the reflective layer 621 to make the entire front plate 61 glow brightly. As a result, the entire front surface of the refrigerator door 50 may glow brightly and may have an outer appearance with set color.

The door panel 60 according to the embodiment of the present disclosure may include the lighting devices 65 provided on both an upper end and a lower end thereof as necessary. To this end, the right brackets 64 may be provided on both the upper end and the lower end, and light may be emitted to an upper end and a lower end of the light guide plate 32 to make the front plate 61 glow more brightly.

The refrigerator according to the embodiment of the present disclosure may have various other embodiments other than the aforementioned embodiments.

According to another embodiment of the present disclosure, the perimeter of the door panel may be formed by a side bracket, a right bracket, and a support bracket, and a rear surface of the door panel may directly contact with an insulator inside a door.

Thus, another embodiment of the present disclosure may be the same as the aforementioned embodiment in terms of components except for some components of the door panel and the door body. In addition, the same component as the aforementioned embodiment use the same reference numeral, and a detailed description or illustration thereof may be omitted.

Hereinafter, another embodiment of the present disclosure will be described in detail with reference to drawings.

Figure 45:
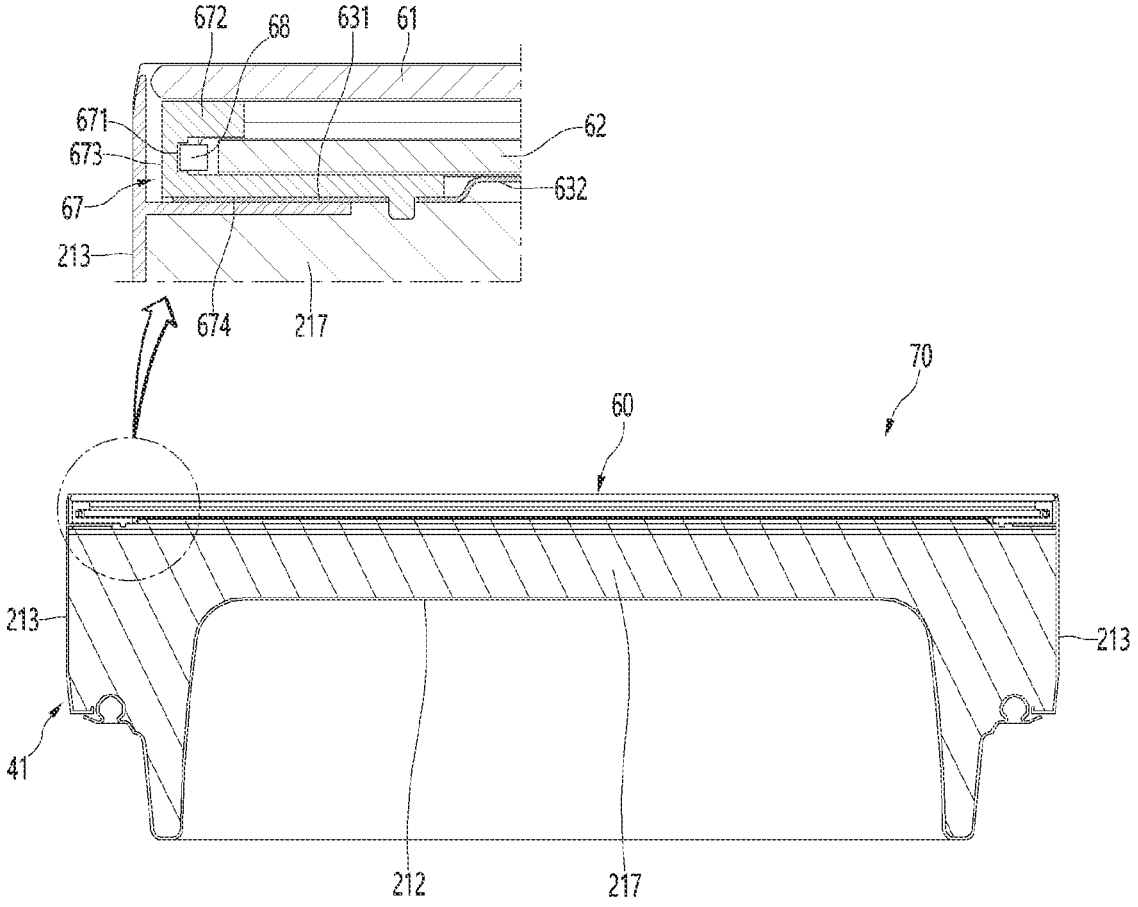
FIG. 45 is a cross-sectional view of a refrigerator door according to a sixth embodiment of the present disclosure.

FIG. 45 is a cross-sectional view of a refrigerator door according to a sixth embodiment of the present disclosure.

As shown in the drawing, a refrigerator door 70 according to the sixth embodiment of the present disclosure may include the door panel 60 and the door body 41. The door panel 60 may be coupled to the door body 41 and may form a front surface of the refrigerator door 70.

The overall structure of the door panel 60 may be the same as the door panel 60 according to the aforementioned embodiment. That is, the door panel 60 may include the front plate 61, the light guide plate 62, the lighting device 65, the right bracket 64, the support bracket 66, the side bracket 67, and the back cover 63, which are the same as the door panel 60 according to the aforementioned embodiment, and thus a detailed description thereof will be omitted.

The door body 41 may have the same structure as the door body 41 shown in FIG. 39. That is, the door body 41 may include the door liner 212 forming the back of the refrigerator door 70, the upper cap deco 214 disposed on upper and lower ends of the door liner 212, and the side deco 213 disposed on right and left side ends of the door liner 212. The upper cap deco 214 and the lower cap deco 215 may form upper and lower surfaces of the refrigerator door 70, and the side deco 213 may form the right and left side surfaces of the refrigerator door 70.

In the state in which the door liner 212 is coupled to the upper cap deco 214, the lower cap deco 215, and the side deco 213, an internal space of the door body 41 with an open front surface may be formed. The internal space of the door body 41 may be shielded by the door panel 60.

That is, the door panel 60 may be coupled to the upper cap deco 214 and front ends of the lower cap deco 215 and the side deco 213, and may form a space inside the refrigerator door 70, in which the insulator 217 is filled.

In the state in which the door panel 60 and the door body 41 are coupled, the insulator 217 may be injected into the refrigerator door 70, and the internal space of the door body 41 may be filled with the insulator 217 to satisfy thermal insulation capability of the refrigerator door 70.

In the state in which the refrigerator door 70 is assembled, the back of the door panel 60, that is, the rear part of the back cover 63 may be in contact with the insulator 217. Thus, the insulator 217 may not penetrate into a space inside the door panel 60 and may be protected by the back cover 63. The rear surface of the back cover 63 may be coupled to the insulator 217, and the door panel 60 may be firmly fixed to the refrigerator door 70.

INDUSTRIAL APPLICABILITY

Refrigerators according to embodiments of the present invention may have an improved appearance and improved ease of use, and thus have high industrial availability.

The invention claimed is:

1. A refrigerator, comprising:

a cabinet having a storage space; and a door configured to open and close at least a portion of the storage space, the door including a door body and a door panel that is disposed at a front surface of the door body, wherein the door panel comprises:

a front plate that is configured to provide a front exterior appearance of the door and made of a transparent material, an upper bracket coupled to an upper portion of the front plate, a lower bracket coupled to a lower portion of the front plate, a lighting device mounted to the upper bracket or the lower bracket, a back cover that is made from a metal plate and connected to the upper bracket and the lower bracket, the back cover being configured to provide a rear surface of the door panel and having a wire hole defined through the rear surface of the door panel, a first wire that extends from the lighting device and passes through the wire hole, and a light guide plate disposed between the front plate and the back cover and configured to guide light emitted from the lighting device to the front plate, and wherein the door body includes:

a connector receiver recessed in the front surface of the door body, a second wire that extends from the door body, and a body connector that is disposed within the connector receiver and connects the first wire and the second wire.

2. The refrigerator of claim 1, wherein the door body further comprises a body plate that defines the front surface of the door body, the body plate defining a body hole, and wherein the second wire passes through the body hole and extends toward the door panel.

3. The refrigerator of claim 2, wherein the body connector is disposed between the back cover and the body plate.

4. The refrigerator of claim 1, wherein the door further comprises:

a panel connector disposed at an end of the first wire and connected to the body connector.

5. The refrigerator of claim 2, wherein the connector receiver is recessed into an inside of the door body and faces the wire hole, and wherein the body hole is defined in the connector receiver.

6. The refrigerator of claim 1, wherein the back cover comprises a cover protrusion that protrudes toward the light guide plate and supports the light guide plate.

7. The refrigerator of claim 6, wherein the back cover further comprises a cover perimeter part that defines a perimeter of the cover protrusion and protrudes rearward relative to the cover protrusion, the cover perimeter part being spaced apart from the light guide plate.

8. The refrigerator of claim 7, wherein the upper bracket and the lower bracket are disposed at the cover perimeter part, and wherein the lighting device is configured to emit light toward an end of the light guide plate.

9. The refrigerator of claim 1, wherein the door body comprises a body plate that defines the front surface of the door body, and wherein the back cover is disposed between the front plate and the body plate.

10. The refrigerator of claim 9, wherein the body plate is in contact with the back cover.

11. The refrigerator of claim 1, wherein the lighting device comprises:

a substrate; and a light source disposed on the substrate and spaced apart from an end of the light guide plate, the light source comprising one or more light emitting diodes.

12. The refrigerator of claim 1, wherein the door panel is detachably mounted on the door body.

13. The refrigerator of claim 1, wherein the lighting device comprises:

a substrate; and a light source disposed on the substrate, and wherein the upper bracket or the lower bracket defines a substrate accommodator that receives and supports at least a portion of the substrate.

14. The refrigerator of claim 1, wherein the lighting device is configured to emit light in a plurality of set colors, wherein the door panel covers the front surface of the door body, and the front plate defines a front appearance of the door panel, and wherein an entirety of the front plate configured to glow with a selected color from among the plurality of set colors based on the light emitted from the lighting device.

* * * * *